US007892717B2

(12) United States Patent
Sato et al.

(10) Patent No.: US 7,892,717 B2
(45) Date of Patent: Feb. 22, 2011

(54) TONER FOR ELECTROSTATIC IMAGE DEVELOPMENT, ELECTROSTATIC IMAGE DEVELOPER AND IMAGE FORMING METHOD USING THE SAME

(75) Inventors: Shuji Sato, Minamiashigara (JP); Hiroshi Nakazawa, Minamiashigara (JP); Masanobu Ninomiya, Minamiashigara (JP); Takeshi Shoji, Minamiashigara (JP); Eiji Kawakami, Minamiashigara (JP); Atsushi Sugawara, Minamiashigara (JP); Shinya Nakashima, Minamiashigara (JP)

(73) Assignee: Fuji Xerox Co., Ltd., Tokyo (JP)

( * ) Notice: Subject to any disclaimer, the term of this patent is extended or adjusted under 35 U.S.C. 154(b) by 589 days.

(21) Appl. No.: 11/707,074

(22) Filed: Feb. 16, 2007

(65) Prior Publication Data

US 2008/0008944 A1 Jan. 10, 2008

(30) Foreign Application Priority Data

Jul. 7, 2006 (JP) ..... 2006-188061

(51) Int. Cl.
*G03G 9/00* (2006.01)

(52) U.S. Cl. ..... 430/111.4; 430/48; 430/105

(58) Field of Classification Search ..... 430/111.4, 430/48, 105
See application file for complete search history.

(56) References Cited

U.S. PATENT DOCUMENTS 6,022,659 A 2/2000 Kanbayashi et al.
2002/0081130 A1 6/2002 Endo et al.
2003/0219669 A1 * 11/2003 Yamashita et al. ..... 430/109.4

FOREIGN PATENT DOCUMENTS

| | | |
|---|---|---|
| JP | A-11-237765 | 8/1999 |
| JP | A-2000-267344 | 9/2000 |
| JP | A 2002-49180 | 2/2002 |
| JP | A-2002-196645 | 7/2002 |
| JP | A-2003-122039 | 4/2003 |
| JP | 2004-198752 | 7/2004 |
| JP | A 2004-264331 | 9/2004 |
| JP | A 2005-62510 | 3/2005 |
| JP | A-2006-91379 | 4/2006 |

OTHER PUBLICATIONS

Submission of Information issued in Japanese Patent Application No. 2006-188061 on Aug. 8, 2010 (with English translation).
Oct. 13, 2010 Japanese Office Action issued in Japanese Patent Application No. 2006-188061 (with translation).

* cited by examiner

*Primary Examiner*—Mark A Chapman
(74) *Attorney, Agent, or Firm*—Oliff & Berridge, PLC

(57) ABSTRACT

The invention provides a toner for electrostatic image development having at least a binder resin and a colorant and having an existence ratio of an IA Group element, from which hydrogen is excluded, measured by XPS (X-ray Photoelectron Spectroscopy) in a range of about 0.03 to 1.0 atom % and a total of existence ratios of an IIA Group element, an IIIB Group element and an IVB Group element, from which carbon is excluded, measured by XPS in a range of about 0.05 to 2.0 atom %. The invention further provides an electrostatic image developer having at least a carrier and the toner, and an image forming method including at least developing an electrostatic latent image with a developer containing at least the toner to form a toner image.

17 Claims, No Drawings

TONER FOR ELECTROSTATIC IMAGE DEVELOPMENT, ELECTROSTATIC IMAGE DEVELOPER AND IMAGE FORMING METHOD USING THE SAME

BACKGROUND

1. Technical Field

The present invention relates to a toner for electrostatic image development used in forming an image by electrophotography, an electrostatic image developer and an image forming method using the same.

2. Related Art

In electrophotography, an electrostatic image is formed on a photoreceptor (latent image carrier) through a process of charging and light exposure, the electrostatic latent image is developed by a developer containing a toner to form a toner image, and this toner image is transferred onto a recording medium and fixed to form an image. As the developer used herein, there are two-component developers of a toner and a carrier, and one-component developers using either a magnetic toner or a nonmagnetic toner. Production of the toner generally uses a kneading milling process including melting and kneading a thermoplastic resin with a pigment, a charge controlling agent, and a releasing agent such as wax, then cooling the mixture, pulverizing it and further size classifying the particles.

With respect to the toner produced by the conventional kneading milling process, the shape of the toner particle is indefinite, and the surface structure of the toner particle is changed subtly depending on the pulverizability of the materials used and conditions in the milling process, thus making it difficult to systematically regulate the shape and surface structure of the toner particles.

On the other hand, recently a method of producing a toner by wet processes is proposed as a means capable of systematically regulating the shape and surface structure of the toner. Among wet processes, there are wet globularization methods capable of shape regulation, suspension particle formation methods capable of regulating the surface composition, suspension polymerization methods capable of regulating an internal composition, and emulsion polymerization aggregation methods.

As demand for energy saving is increased, there is need for energy saving in the fixation process that uses a certain amount of electric power in a copier, and for reducing the fixation temperature of toner in order to enlarge the fixation region. Reduction in the fixation temperature of a toner enables reduction in waiting time until the fixation temperature of the surface of a fixation roll is reached after inputting electric power to a copier etc., that is, reduction in warm-up time, as well as long life of a fixation roll, in addition to the energy saving and enlargement of fixation region.

Reduction in the fixation temperature of a toner brings about reduction in the glass transition point of the toner causing a problem of deterioration in the storage stability of the toner, and thus it is difficult to get a reduction in the fixation temperature together with storage stability of the toner. To satisfy both fixability at low-temperature and toner storage stability, the toner should have "sharp" melting properties, by which the glass transition point of the toner remains at a high temperature while the viscosity of the toner rapidly reduces at the high-temperature region.

However, the glass transition point and molecular weight of resin used in toners usually have a certain range of variation, and to attain sharp melting properties, the composition and molecular weight of resin need to be closely regulated.

For obtaining such a resin, since the molecular weight of the resin needs to be regulated by using a special process or by subjecting the resin to chromatography, is significantly increases the production cost of the resin, and in such processes unrequired resin is formed as a byproduct. That is not preferable from an environmental viewpoint.

SUMMARY

The present provides a toner for electrostatic image development, which is capable of being fixed at low temperature, a releasing agent contained therein is excellent in the dispersibility, compatibility and enclosability in binder resin, and has a high strength, as well as an electrostatic image developer and an image forming method using the same.

Namely, one aspect of the invention provides a toner for electrostatic image development comprising a binder resin and a colorant, wherein an existence ratio of an IA Group element, from which hydrogen is excluded, measured by XPS (X-ray Photoelectron Spectroscopy) is in a range of about 0.03 to 1.0 atom %, and a total of existence ratios of an IIA Group element, an IIIB Group element and an IVB Group element, from which carbon is excluded, measured by XPS is in a range of about 0.05 to 2.0 atom %.

DETAILED DESCRIPTION

The invention will be hereinafter explained in detail.

Toner for Electrostatic Image Development

The toner for electrostatic image development of the invention (hereinafter, abbreviated as "toner" in some cases) is a toner for electrostatic image development having at least a binder resin and a colorant and having an existence ratio of an IA Group element, from which hydrogen is excluded, measured by XPS (X-ray Photoelectron Spectroscopy) in a range of about 0.03 to 1.0 atom % and a total of existence ratios of an IIA Group element, an IIIB Group element and an IVB Group element, from which carbon is excluded, measured by by XPS in a range of about 0.05 to 2.0 atom %.

An existence ratio of an IIA Group element (group number according to the IUPAC 1989 Inorganic Chemistry Nomenclature Revision of 1) (excluding hydrogen) in a vicinity of a surface of a toner particle of the toner of the invention is set in a specific range. As a result, hygroscopicity of the toner can be suppressed, and a stable toner electrification property is obtained. Accordingly, it becomes possible to obtain high image quality with no image defects over a long period of time. In addition, a total of existence ratios of an IIA Group element, an IIIB Group element, and an IVB Group element (group numbers according to the IUPAC 1989 Inorganic Chemistry Nomenclature Revision are 2, 13 of 14, respectively) (excluding carbon) in the toner particle of the invention is set in a specific range. As a result, includability of a crystalline resin and a releasing agent in the toner particle is improved, and it becomes possible to further improve a strength of the toner particle. Accordingly, it becomes possible to obtain high image quality over a long period of time in an image forming method using an electrophotographic photosensitive material having a surface layer, or an image forming method adopting a toner recycling format.

Specifically, it is necessary that an existence ratio of an IA Group element (excluding hydrogen) after ion etching by XPS (X-ray Photoelectron Spectroscopy) is in a range of about 0.03 to 1.0 atom %. Since Na and K which are representative examples of an IA Group element are easily ionized and have high hygroscopicity, when they are contained in too large an amount there is a possibility that a problem causing leakage of a charge on a toner surface occurs. In addition, since there is a possibility that swelling action due to acting on a molecular chain terminal of a binder resin is caused, a toner strength is reduced.

By setting the existence ratio of an IA Group element in the above range, a toner particle having no charge leakage and no reduction in a strength can be obtained. The existence ratio is preferably in a range of about 0.04 to 0.8 atom %, and more preferably in a range of about 0.1 to 0.6 atom %.

In addition, it is preferable that Na or K is contained as the IA Group element.

In addition, it is also necessary that a total of existence ratios of an IIA Group element, an IIIB Group element and an IVB Group element (excluding carbon) is in a range of about 0.05 to 2.0 atom %. It is thought that these elements mainly form a crosslinked structure of a molecular chain terminal of a toner resin, and this improves a toner strength. Further, since growth of a releasing agent and a crystalline resin in the toner particle is suppressed, dispersability and includability are improved, and a toner particle undergoing no toner destruction and no filming even in long term use can be obtained.

The existence ratio is preferably in a range of about 0.06 to 1.80 atom %, and more preferably in a range of about 0.1 to 1.5 atom %. In addition, it is preferable that Mg or Ca is contained as the IIA Group element, Al is contained as the IIIB Group element, and Si is contained as the IVB Group element.

In particular, when a polyester resin particle described later is aggregated in an aqueous system, there is a tendency that affinity for water is high, and it is difficult to include a material inferior in affinity such as a colorant and a releasing agent other than a resin particle. However, due to the presence of the IIA Group element, the IIIB Group element and the IVB Group element (excluding carbon), includability can be improved in the invention.

The XPS measurement can be performed by using an apparatus such as a JPS9000MX (trade name, manufactured by JEOL. Ltd.). The measuring conditions are an acceleration voltage of about 10 kV and a current value of about 30 mA. Further, a measured value is obtained after ion etching (to a depth from the toner particle surface in a range of about 1 to 10 nm) for about 180 seconds under an Ar atmosphere at an acceleration voltage of about 400 V and a vacuum degree of about 1 to $10^{-2}$ Pa.

It is noted that there has not been conventionally known an example having a composition of a toner surface which is controlled by ion etching as in the invention. While it may be common to simply add an inorganic particle to a toner particle surface, an inorganic particle obtained thereby does not form a structure crosslinked with a binder resin as in the toner obtained in the invention. Accordingly, an effect of improvement in toner strength such as exhibited in the invention cannot not be obtained by the simple addition process. Further, since the conventional inorganic particle is added after granulation of the toner particle, it does not contribute to includability and dispersability of the crystalline resin and the releasing agent.

First, constituent materials and the like of the toner of the invention will be explained in detail. The toner of the invention contains at least a binder resin and a colorant.

Binder Resin

While the binder resin used in the toner for electrostatic development of the invention is not particularly limited, a binder resin synthesized by a polyaddition reaction or a polycondensation reaction is preferable from the viewpoints of low fixability and storage stability. Specific examples thereof include a polyester resin, a polyurethane resin, an epoxy resin, a polyol resin and the like. Among them, a polyester resin is preferably used from the viewpoints of relative easiness of melt viscosity adjustment, compatibility with the crystalline resin to be used in combination, and includability of the releasing agent.

As described above, in the invention, the binder resin preferably includes a crystalline resin in addition to an amorphous resin from the viewpoint of obtaining sharp melting property at fixation.

In the invention, "crystalline resin" refers to a resin not having a step-like endothermic amount change, but instead having a clear endothermic peak in differential scanning calorimetry (DSC), and means a crystalline resin having a weight average molecular weight exceeding at least about 5,000, and, usually, means a crystalline resin having a weight average molecular weight of not less than about 10,000.

Crystalline Resin

The crystalline resin can provide further excellent fixability at low-temperature to the toner because it has a melting point thus significantly reducing viscosity at the specific temperature, and upon heating of the toner at the time of fixation, can reduce the difference between the temperature upon initiation of thermal activity of crystalline resin molecules and the temperature at which fixation is feasible. The amount of the crystalline resin in the toner is preferably in the range of about 1 to 10% by mass, and more preferably about 2 to 8% by mass relative to the total amount of the toner particle.

Preferably the crystalline resin used in the invention has a melting point in the range of about 45 to 110° C. to secure fixability at low-temperature and the storage stability of the toner. When the melting point is lower than about 45° C., storage of the toner is difficult, while when the melting point is higher than about 110° C., the effect of fixability at low-temperature cannot be enjoyed. The melting point of the crystalline resin is preferably in the range of about 50 to 100° C., more preferably in the range of about 55 to 90° C. The melting point of the resin is determined by a method shown in ASTMD3418-8, the disclosure of which is incorporated herein by reference.

The number-average molecular weight (Mn) of the crystalline resin is preferably about 2,000 or more, and is more preferably about 4,000 or more. When the number-average molecular weight (Mn) is less than about 1,500, the toner may penetrate into the surface of a recording medium such as paper, thus causing uneven fixation at the time of fixation or reducing the resistance of a fixed image to bending.

The crystalline resin used in the invention is not particularly limited insofar as it is a resin having crystallinity and a weight-average molecular weight of about 5,000 or more. Specific examples thereof include crystalline polyester resin, crystalline vinyl resin and the like. Among them, the crystalline polyester resin is preferable from the viewpoints of charging properties and adhesion to paper at the time of fixation and regulation of the melting point in the preferable range. The crystalline resin is more preferably aliphatic crystalline polyester resin having a suitable melting point.

Specific examples of the crystalline vinyl resin include vinyl resins using long-chain alkyl or alkenyl(meth)acrylates such as amyl(meth)acrylate, hexyl(meth)acrylate, heptyl (meth)acrylate, octyl(meth)acrylate, nonyl(meth)acrylate, decyl(meth)acrylate, undecyl(meth)acrylate, tridecyl(meth) acrylate, myristyl(meth)acrylate, cetyl(meth)acrylate, stearyl (meth)acrylate, oleyl(meth)acrylate and behenyl(meth)acrylate. In the specification, the term "(meth)acryl" includes both "acryl" and "methacryl" in its scope.

The crystalline polyester resin is synthesized from a carboxylic acid (dicarboxylic acid) component and an alcohol (diol) component. Hereinafter, the carboxylic acid component and the alcohol component are described in more detail. In the invention, the scope of the "crystalline polyester resin" includes a copolymer produced by copolymerizing a crystalline polyester resin with another component so that an amount of the another component becomes 50% by mass or less based on an amount of the main chain of the crystalline polyester resin.

The carboxylic acid component is preferably an aliphatic dicarboxylic acid, and is particularly preferably a linear carboxylic acid. Examples thereof include, but are not limited to, oxalic acid, malonic acid, succinic acid, glutaric acid, adipic acid, pimelic acid, suberic acid, azelaic acid, sebacic acid, 1,9-nonanedicarboxylic acid, 1,10-decanedicarboxylic acid, 1,11-undecanedicarboxylic acid, 1,12-dodecanedicarboxylic acid, 1,13-tridecanedicarboxylic acid, 1,14-tetradecanedicarboxylic acid, 1,16-hexadecanedicarboxylic acid and 1,18-octadecanedicarboxylic acid, and lower alkyl esters and acid anhydrides thereof.

The carboxylic acid component preferably includes components such as a dicarboxylic acid component having a double bond and a dicarboxylic acid component having a sulfonic acid group, besides the aliphatic dicarboxylic acid component. The scope of the "dicarboxylic acid component having a double bond" includes not only components derived from dicarboxylic acids having double bonds but also components derived from lower alkyl esters or acid anhydrides of dicarboxylic acids having double bonds. The scope of the "dicarboxylic acid component having a sulfonic acid group" includes not only components derived from dicarboxylic acids having sulfonic acid groups but also components derived from lower alkyl esters or acid anhydrides of dicarboxylic acids having sulfonic acid groups.

The dicarboxylic acid having a double bond can be preferably used due to its ability to crosslink the entire resin by utilizing double bonds so as to prevent hot offset upon fixation. Examples of the dicarboxylic acid include, but are not limited to, fumaric acid, maleic acid, 3-hexenedioic acid and 3-octenedioic acid, and lower alkyl esters and acid anhydrides thereof. Among them, fumaric acid and maleic acid are preferable from the viewpoint of costs.

The dicarboxylic acid having a sulfonic acid group is effective due to its ability to improve dispersing of a colorant such as a pigment or the like. When the entire resin is emulsified or suspended in water to form particles, presence of the sulfonic group enables the emulsification or suspension of the resins without a surfactant as will be described hereinafter. Examples of the dicarboxylic acid having a sulfonic acid group include, but are not limited to, sodium salt of 2-sulfoterephthalate, sodium salt of 5-sulfoisophthalate and sodium salt of sulfosuccinate, and lower alkyl esters and acid anhydrides thereof. Among them, sodium 5-sulfoisophthalate and the like is preferable from the viewpoint of costs.

The content of the carboxylic acid component other than the aliphatic dicarboxylic acid component in the carboxylic acid component (the dicarboxylic acid component having a double bond and/or the dicarboxylic acid component having a sulfonic acid group) is preferably about 1 to 20% by constitutional mole, more preferably about 2 to 10% by constitutional mole.

When the content is less than about 1% by constitutional mole, the dispersibility of a pigment in the toner may be insufficient. When the toner is prepared by the emulsion polymerization aggregation method, the diameter of the emulsified particle in the dispersion increases, and regulation of the toner diameter by aggregation may become difficult.

On the other hand, when the content is greater than about 20% by constitutional mole, the crystallinity of the crystalline polyester resin may be lowered, the melting point decreases, and the storability of an image may be deteriorated.

When the toner is prepared by the emulsion polymerization aggregation method, the diameter of the emulsified particle in the dispersion is too small to form latex by dissolving the particle in water. In the invention, the "% by constitutional mole" refers to percentage where the amount of each component (carboxylic acid component, alcohol component) in the polyester resin is 1 unit (mol).

The alcohol component is preferably an aliphatic diol, and examples thereof include, but are not limited to, ethylene glycol, 1,3-propane diol, 1,4-butane diol, 1,5-pentane diol, 1,6-hexane diol, 1,7-heptane diol, 1,8-octane diol, 1,9-nonane diol, 1,10-decane diol, 1,11-undecane diol, 1,12-dodecane diol, 1,13-tridecane diol, 1,14-tetradecane diol, 1,18-octadecane diol, 1,20-eicosane diol, and the like.

The alcohol component contains preferably about 80% by constitutional mole or more of aliphatic diol component. The alcohol component may further contain other components if necessary. More preferably, the alcohol component contains about 90% by constitutional mole or more of the aliphatic diol component.

When the content is less than about 80% by constitutional mole, the melting point is lowered due to a decrease of the crystallinity of the polyester resin, and thus toner blocking properties, image storability, and fixability at low-temperature may be deteriorated.

Examples of the other components contained if necessary include components such as a diol component having a double bond or a diol component having a sulfonic acid group.

Examples of the diol component having a double bond includes 2-butene-1,4-diol, 3-butene-1,6-diol, 4-butene-1,8-diol, etc. On the other hand, examples of the diol component having a sulfonic acid group includes sodium salt of benzene 1,4-dihydroxy-2-sulfonate, sodium salt of benzene 1,3-dihydroxymethyl-5-sulfonate, sodium salt of 2-sulfo-1,4-butanediol and the like.

When these alcohol components (the diol component having a double bond and/or the diol component having a sulfonic acid group) other than the linear aliphatic diol component are added, the content thereof in the alcohol component is preferably about 1 to 20 mol %, more preferably about 2 to 10 mol %. When the content is less than about 1 mol %, there is the case where the dispersion of a pigment is insufficient, the diameter of the emulsified particle is increased, and regulation of the toner diameter by aggregation becomes difficult. On the other hand, when the content is greater than about 20 mol %, there is the case where the crystallinity of the polyester resin is decreased, the melting point is lowered, the storability of an image is deteriorated, and the diameter of the emulsified particle is so small that the toner may be dissolved in water, thus failing to form latex.

The method of producing the crystalline polyester resin is not particularly limited, and the resin can be produced by a general method of polymerizing a polyester by reacting a carboxylic acid component with an alcohol component, such as a direct polycondensation method or an ester exchange method, and a suitable method is selected depending on the type of monomer. The molar ratio of the acid component to the alcohol component (acid component/alcohol component)

to be reacted with each other varies depending on reaction conditions etc., and cannot be generalized, but is usually about 1/1.

Production of the crystalline polyester resin can be carried out at a polymerization temperature of about 180 to 230° C., and the reaction is carried out in the reaction system if necessary under reduced pressure while water and alcohol generated upon condensation are removed. When the monomers are not dissolved or compatible with each other at the reaction temperature, a high-boiling solvent may be added as a solubilizer to dissolve the monomers. Polycondensation is carried out while the solubilizer solvent is distilled away. When there is a monomer which is poor in compatibility in copolymerization, the monomer which is poor in compatibility may be previously condensed with an intended carboxylic acid component or alcohol component and then copolymerized with a major component.

A catalyst usable in production of the crystalline polyester resin includes alkali metals such as sodium, lithium etc.; alkaline earth metals such as magnesium, calcium etc.; metals such as zinc, manganese, antimony, titanium, tin, zirconium, germanium etc.; and phosphorous acids, phosphoric acids and amine compounds, and the like.

Specific examples of the catalyst include sodium acetate, sodium carbonate, lithium acetate, calcium acetate, zinc stearate, zinc naphthenate, zinc chloride, manganese acetate, manganese naphthenate, titanium tetraethoxide, titanium tetrapropoxide, titanium tetraisopropoxide, titanium tetrabutoxide, antimony trioxide, triphenyl antimony, tributyl antimony, tin formate, tin oxalate, tetraphenyl tin, dibutyltin dichloride, dibutyltin oxide, diphenyltin oxide, zirconium tetrabutoxide, zirconium naphthenate, zirconyl carbonate, zirconyl acetate, zirconyl stearate, zirconyl octylate, germanium oxide, triphenyl phosphite, tris(2,4-di-t-butylphenyl)phosphite, ethyltriphenyl phosphonium bromide, triethylamine, triphenylamine etc.

For regulating the melting point, molecular weight etc. of the crystalline resin, in addition to the polymerizable monomers described above, compounds having a shorter-chain alkyl or alkenyl group, an aromatic ring, etc. can be used.

Specific examples of such compounds include, for the dicarboxylic acid, alkyl dicarboxylic acids such as succinic acid, malonic acid and oxalic acid, aromatic dicarboxylic acids such as phthalic acid, isophthalic acid, terephthalic acid, homophthalic acid, 4,4'-bibenzoic acid, 2,6-naphthalene dicarboxylic acid and 1,4-naphthalene dicarboxylic acid, and nitrogen-containing aromatic dicarboxylic acids such as dipicolinic acid, dinicotinic acid, quinolinic acid and 2,3-pyrazine dicarboxylic acid; for the diols, short-alkyl diols such as succinic acid, malonic acid, acetone dicarboxylic acid and diglycolic acid; and for the vinyl polymerizable monomers containing the short-chain alkyl group, short-chain alkyl or alkenyl(meth)acrylates such as methyl (meth)acrylate, ethyl (meth)acrylate, propyl(meth)acrylate and butyl(meth)acrylate, vinyl nitriles such as acrylonitrile and methacrylonitrile, vinyl ethers such as vinyl methyl ether and vinyl isobutyl ether, isopropenyl ketones such as vinyl methyl ketone, vinyl ethyl ketone and vinyl isopropenyl ketone, and olefins such as ethylene, propylene, butadiene and isoprene. These polymerizable monomers may be used singly or two or more thereof may be used in combination.

Non-crystalline Resin

As the non-crystalline resin used in the invention, known non-crystalline binder resin for toner can be used, and for example, styrene-acryl resin or the like can be used, but non-crystalline polyester resin is preferably used.

The glass transition point of the non-crystalline polyester resin used is preferably in the range of 50 to 80° C., and more preferably in the range of about 55 to 65° C. The weight-average molecular weight is preferably in the range of about 8,000 to 30,000, and from the viewpoint of fixability at low-temperature and mechanical strength, the weight-average molecular weight is more preferably in the range of about 8,000 to 16,000. From the viewpoint of fixability at low-temperature and capacity for mixing, the non-crystalline polyester resin may be copolymerized with a third component.

Preferably, the non-crystalline polyester resin has the same alcohol component or carboxylic acid component as that in the crystalline ester compound used in combination therewith in order to improve compatibility with the crystalline ester compound.

Similarly to the method of producing the crystalline polyester resin, the method of producing the non-crystalline polyester resin is not particularly limited, and the non-crystalline polyester resin can be produced by the general polyester polymerization method.

Examples of the carboxylic acid component used in synthesis of the non-crystalline polyester resin include various dicarboxylic acids mentioned for the crystalline polyester resin.

Examples of the alcohol component also include various diols used in synthesis of the non-crystalline polyester resin, and it is possible to use bisphenol A, ethylene oxide adduct of bisphenol A, propylene oxide adduct of bisphenol A, hydrogenated bisphenol A, bisphenol S, ethylene oxide adduct of bisphenol S, propylene oxide adduct of bisphenol S or the like in addition to the aliphatic diols mentioned for the crystalline polyester resin.

From the viewpoints of toner productivity, heat resistance and transparency, bisphenol S and bisphenol S compounds such as ethylene oxide adduct of bisphenol S and propylene oxide adduct of bisphenol S are preferably used. The carboxylic acid component or alcohol component may contain plural components, and particularly, bisphenol S has an effect of improving heat resistance.

Further, crosslinking treatment of the non-crystalline resin used as binder resin, crosslinking treatment of the crystalline resin which is used if necessary, and copolymerizable components usable in synthesis of the binder resin, are explained in detail.

For synthesis of the binder resin, other additional components can be copolymerized, and compounds having hydrophphilic polar groups can be used.

When the binder resin is polyester resin, specific examples of the other additional components include dicarboxylic acid compounds having an aromatic ring substituted directly with a sulfonyl group, such as sodium sulfonyl-terephthalate and sodium 3-sulfonyl isophthalate.

When the binder resin is vinyl resin, specific examples of other additional components include unsaturated fatty carboxylic acids such as (meth)acrylic acid and itaconic acid, esters of (meth)acrylic acids and alcohols, such as glycerin mono(meth)acrylate, fatty acid-modified glycidyl(meth) acrylate, zinc mono(meth)acrylate, zinc di(meth)acrylate, 2-hydroxyethyl(meth)acrylate, polyethylene glycol(meth) acrylate and polypropylene glycol(meth)acrylate, styrene compounds having a sulfonyl group in the ortho-, meta- or para-position, and a sulfonyl group-substituted aromatic vinyl such as sulfonyl group-containing vinyl naphthalene and the like.

A crosslinking agent can be added if necessary to the binder resin for the purpose of preventing uneven gloss, uneven coloration and hot offset, upon fixation at a high-temperature region.

Specific examples of the crosslinking agent include aromatic polyvinyl compounds such as divinyl benzene and divinyl naphthalene, polyvinyl esters of aromatic polyvalent carboxylic acids such as divinyl phthalate, divinyl isophthalate, divinyl terephthalate, divinyl homophthalate, divinyl/trivinyl trimesate, divinyl naphthalene dicarboxylate and divinyl biphenyl carboxylate, divinyl esters of nitrogen-containing aromatic compounds, such as divinyl pyridine dicarboxylate, unsaturated heterocyclic compounds such as pyrrole and thiophene, vinyl esters of unsaturated heterocyclic carboxylic acids, such as vinyl pyromucate, vinyl furan carboxylate, vinyl pyrrole-2-carboxylate and vinyl thiophene carboxylate, (meth)acrylates of linear polyvalent alcohols, such as butane diol methacrylate, hexane diol acrylate, octane diol methacrylate, decane diol acrylate and dodecane diol methacrylate, branched, substituted polyvalent alcohol(meth)acrylates such as neopentyl glycol dimethacrylate, 2-hydroxy-1,3-diacryloxy propane, and polyvalent polyvinyl carboxylates such as polyethylene glycol di(meth)acrylate, polypropylene polyethylene glycol di(meth)acrylates, divinyl succinate, divinyl fumarate, vinyl/divinyl maleate, divinyl diglycolate, vinyl/divinyl itaconate, divinyl acetone dicarboxylate, divinyl glutarate, divinyl 3,3'-thiodipropionate, divinyl/trivinyl transaconate, divinyl adipate, divinyl pimelate, divinyl suberate, divinyl azelate, divinyl sebacate, dodecane diacid divinyl, divinyl brassylate etc.

Particularly in the crystalline polyester resin, unsaturated polycarboxylic acids such as fumaric acid, maleic acid, itaconic acid and trans-aconic acid are copolymerized with polyester, and then multiple bonds in the resin may be crosslinked with one another or other vinyl compounds may be crosslinked therewith. In the invention, the crosslinking agents may be used singly or two or more thereof may be used in combination.

The method of crosslinking by the crosslinking agent may be a method of crosslinking by polymerizing the polymerizable monomer together with the crosslinking agent to crosslink the monomer or a method wherein after the binder resin is polymerized while unsaturated portions are allowed to remain in the binder resin, or after the toner is prepared, the unsaturated portions are crosslinked by crosslinking reaction.

When the binder resin is polyester resin, the polymerizable monomer can be polymerized by condensation polymerization. As the catalyst for condensation polymerization, a known catalyst can be used, and specific examples thereof include titanium tetrabutoxide, dibutyltin oxide, germanium dioxide, antimony trioxide, tin acetate, zinc acetate and tin disulfide. When the binder resin is vinyl resin, the polymerizable monomer can be polymerized by radical polymerization.

The radical polymerization initiator is not particularly limited insofar as it is capable of emulsion polymerization. Specific examples of the radical polymerization initiator include peroxides such as hydrogen peroxide, acetyl peroxide, cumyl peroxide, tert-butyl peroxide, propionyl peroxide, benzoyl peroxide, chlorobenzoyl peroxide, dichlorobenzoyl peroxide, bromomethyl benzoyl peroxide, lauroyl peroxide, ammonium persulfate, sodium persulfate, potassium persulfate, peroxy carbonate, diisopropyl tetralin hydroperoxide, 1-phenyl-2-methylpropyl-1-hydroperoxide, pertriphenyl acetate-tert-butyl hydroperoxide, tert-butyl performate, tert-butyl peracetate, tert-butyl perbenzoate, tert-butyl perphenylacetate, tert-butyl permethoxyacetate, and tert-butyl perN-(3-toluyl) carbamate, azo compounds such as 2,2'-azobispropane, 2,2'-dichloro-2,2'-azobispropane, 1,1'-azo(methylethyl)diacetate, 2,2'-azobis(2-amidinopropane) hydrochloride, 2,2'-azobis(2-amidinopropane)nitrate, 2,2'-azobisisobutane, 2,2'-azobisisobutylamide, 2,2'-azobisisobutyronitrile, methyl 2,2'-azobis-2-methylpropionate, 2,2'-dichloro-2,2'-azobisbutane, 2,2'-azobis-2-methylbutyronitrile, dimethyl 2,2'-azobisisobutyrate, 1,1'-azobis(sodium 1-methylbutyronitrile-3-sulfonate), 2-(4-methylphenylazo)-2-methylmalonodinitrile, 4,4'-azobis-4-cyanovaleric acid, 3,5-dihydroxymethylphenylazo-2-methylmalonodinitrile, 2-(4-bromophenylazo)-2-allylmalonodinitrile, 2,2'-azobis-2-methylvaleronitrile, dimethyl 4,4'-azobis-4-cyanovalerate, 2,2'-azobis-2,4-dimethylvaleronitrile, 1,1'-azobiscyclohexanenitrile, 2,2'-azobis-2-propylbutyronitrile, 1,1'-azobis-1-chlorophenylethane, 1,1'-azobis-1-cyclohexanecarbonitrile, 1,1'-azobis-1-cycloheptanenitrile, 1,1'-azobis-1-phenylethane, 1,1'-azobiscumene, ethyl 4-nitrophenylazobenzylcyanoacetate, phenyl azodiphenyl methane, phenyl azotriphenyl methane, 4-nitrophenyl azotriphenyl methane, 1,1'-azobis-1,2-diphenyl ethane and poly(bisphenol A-4,4'-azobis-4-cyanopentanoate), poly(tetraethyleneglycol-2,2'-azobisisobutyrate), and 1,4-bis(pentaethylene)-2-tetrazene, 1,4-dimethoxycarbonyl-1,4-diphenyl-2-tetrazene. These polymerization initiators can also be used as initiators for the crosslinking reaction.

The binder resin has been described by referring mainly to the crystalline polyester resin and non-crystalline polyester resin, and if necessary it is also possible to use styrene and styrene compounds such as parachlorostyrene and α-methyl styrene; acrylate monomers such as methyl acrylate, ethyl acrylate, n-propyl acrylate, butyl acrylate, lauryl acrylate and 2-ethylhexyl acrylate; methacrylate monomers such as methyl methacrylate, ethyl methacrylate, n-propyl methacrylate, lauryl methacrylate and 2-ethylhexyl methacrylate; ethylenically unsaturated monomers such as acrylic acid, methacrylic acid and sodium styrenesulfonate; vinyl nitriles such as acrylonitrile and methacrylonitrile; vinyl ethers such as vinyl methyl ether and vinyl isobutyl ether; vinyl ketones such as vinyl methyl ketone, vinyl ethyl ketone and vinyl isopropenyl ketone; homopolymers of olefinic monomers such as ethylene, propylene and butadiene, copolymers comprising a combination of two or more of these monomers, or mixtures thereof; non-vinyl condensed resins such as epoxy resin, polyester resin, polyurethane resin, polyamide resin, cellulose resin and polyether resin, or mixtures thereof with the vinyl resin, and graft polymers obtained by polymerizing the vinyl monomers in the presence of these resins.

In the case where the resin particle dispersion is formed by emulsion polymerization aggregation method, the resin is prepared in a form of a resin particle dispersion liquid. The resin particle dispersion liquid can be easily obtained by emulsion polymerization or by polymerization which uses a dispersion system similar to emulsion polymerization. Alternatively, the resin particle dispersion liquid can be obtained by any methods such as a method which includes adding, together with a stabilizer, a polymer, which has been uniformly polymerized in advance by solution polymerization or bulk polymerization, to a solvent in which the polymer is not dissolved, and mechanically mixing so as to disperse the resultant.

For example, when a vinyl monomer is used, a resin particle dispersion can be prepared by emulsion polymerization or seed polymerization using an ionic surfactant or the like, preferably a combination of an ionic surfactant and a nonionic surfactant.

Examples of the surfactant used include, but is not limited to, anionic surfactants such as sulfate compounds, sulfonate compounds, phosphate compounds or soap; cationic surfactants such as amine compounds or quaternary ammonium salt compounds; nonionic surfactants such as polyethylene glycol compounds, alkyl phenol/ethylene oxide adduct compounds, alkyl alcohol/ethylene oxide adduct compounds, or polyhydric alcohol compounds, as well as various graft polymers.

When the resin particle dispersion is produced by emulsion polymerization, a small amount of unsaturated acid, for example, acrylic acid, methacrylic acid, maleic acid or styrenesulfonic acid is preferably used as a part of the monomer component so that a protective colloidal layer can be formed on the surfaces of particles to realize soap-free polymerization.

The volume-average particle diameter of the resin particles is preferably about 1 mm or less, more preferably in a range of about 0.01 to 1 mm. When the volume-average particle diameter of the resin particles is greater than about 1 mm, the particle size distribution of the finally obtained toner for electrostatic image development is broadened, and free particles are generated to cause deterioration in performance and reliability. On the other hand, when the volume-average particle diameter of the resin particles is within the range described above, there does not arise the disadvantage described above, and there is an advantage that the uneven distribution of the resin particles among toner particles is decreased, and the dispersion thereof in the toner is improved, thus reducing fluctuation in performance and reliability. The volume-average particle diameter of the resin particles can be measured by using a laser diffraction particle size measuring instrument (trade name: SALD2000A, manufactured by Shimadzu Corporation) or the like.

Releasing Agent

The releasing agent used in the invention includes low-molecular polyolefins such as polyethylene, polypropylene and polybutene; fatty acid amides such as silicones, oleic acid amide, erucic acid amide, ricinoleic acid amide and stearic acid amide; vegetable wax such as carnauba wax, rice wax, candelila wax, haze wax and jojoba oil; animal wax such as beeswax; mineral or petroleum wax such as montan wax, ozokerite, ceresin, paraffin wax, microcrystalline wax and Fischer Tropsch wax, and modified products thereof.

When the toner is produced by the emulsion polymerization aggregation method, the releasing agent may also be heated to the melting point or more and simultaneously dispersed in water together with an ionic surfactant, a polymeric acid, and a polymeric electrolyte such as polymeric base, finely divided by a homogenizer capable of giving strong shearing force or a pressure discharging dispersing machine, and used as a releasing agent particle dispersion containing releasing agent particles having an average particle diameter of about 1 μm or less.

To prepare the toner, these releasing agent particles together with the other resin particle components may be added to a mixed solvent all at once or several times in divided portions.

The amount of the releasing agent to be added is preferably in the range of about 0.5 to 50% by mass relative to an amount of the toner. The amount is more preferably in the range of about 1 to 30% by mass, still more preferably in the range of about 5 to 15% by mass. An amount outside the above range is not preferable, because when the amount is lower than about 0.5% by mass, the effect of the releasing agent added is not brought about, while when the amount is higher than about 50% by mass, the surface of an image is insufficiently dyed at fixation, and the releasing agent easily remains in the image and the transparency deteriorates.

An average dispersion diameter of the releasing agent which is dispersed and contained in the toner of the invention is preferably in a range of about 0.3 to 0.8 μm, and more preferably in a range of about 0.4 to 0.8 μm. When the average dispersion diameter of the releasing agent is less than about 0.3 μm, releaseability becomes insufficient in some cases, and particularly when a process speed is high, this tendency becomes more remarkable. On the other hand, when the average dispersion diameter exceeds about 0.8 μm, reduction in transparency upon use of an OHP sheet and exposure of a releasing agent component on a toner surface become remarkable in some cases.

A standard deviation of the dispersion diameter of the releasing agent is preferably not more than about 0.05, and more preferably not more than about 0.04. When the standard deviation of the dispersion diameter of the releasing agent exceeds about 0.05, this adversely influences releaseability, transparency upon use of an OHP sheet, and exposure of the releasing agent on a toner surface in some cases.

The average dispersion diameter of the releasing agent which is dispersed and contained in the toner is obtained by analyzing a TEM (transmission electron microscope) photograph with an image analyzing apparatus (Luzex image analyzing apparatus manufactured by Nireco Corporation), and calculating an average of a dispersion diameter (=(long diameter+short diametr)/2 of the releasing agent in 100 toner particles, and a standard deviation is obtained based on individual dispersion diameters obtained in this process.

An exposure ratio of the releasing agent on the toner surface (namely, a ratio of the surface area coverage of the releasing agent exposed on the toner surface with respect to the total surface area of the toner particles) is preferably in a range of about 5 to 12 atom %, and further preferably in a range of about 6 to 11 atom %. When the exposure ratio is less than about 5 atom %, fixability on a high temperature side may be deteriorated in some cases particularly in a system which is used at a high speed, and when the exposure ratio exceeds about 12 atom %, reduction in developability and transference property due to uneven distribution and embedding of an external additive may be observed in some cases in long term use.

Herein, the exposure ratio is obtained by XPS (X-ray Photoelectron Spectroscopy) measurement. A JPS-9000MX (trade name, manufactured by JEOL Ltd) is used as the XPS measuring apparatus, and measurement is performed by using a MgK α-ray as an X-ray source. An acceleration voltage is set at about 10 kV, and an emission current is set at about 30 mA. Herein, an amount of a releasing agent on a toner surface is quantitated by a method of separating peaks of C I S spectrum. The peak separating method separates the measured a C1S spectrum into each component using curve fitting by a least square method. As a component spectrum serving as a basis for separation, C1S spectra obtained by measuring each of the releasing agent, the binder resin, and the crystalline resin, which are used for manufacturing the toner, alone are used.

Colorant

A colorant used in the invention includes various pigments such as carbon black, chrome yellow, hanza yellow, benzidine yellow, threne yellow, quinoline yellow, permanent orange GTR, pyrazolone orange, vulcan orange, Watchung red, permanent red, brilliant carmine 3B, brilliant carmine 6B, DuPont oil red, pyrazolone red, lithol red, rhodamine B lake, lake red C, rose Bengal, aniline blue, ultramarine blue, chalco oil blue, methylene blue chloride, phthalocyanine blue, phthalocyanine green and malachite green oxalate, various dyes formed of compounds of acridine, xanthene, azo, benzoquinone, azine, anthraquinone, thioindigo, dioxazine, thiazine, azomethine, indigo, phthalocyanine, aniline black, polymethine, triphenyl methane, diphenyl methane or thiazole, and a mixture of two or more thereof.

When the toner is prepared by the emulsion polymerization aggregation method, these colorants are dispersed in a solvent and used as a colorant particle dispersion. The volume-average particle diameter of the colorant particles in the dispersion is preferably about 0.8 mm or less, more preferably in a range of about 0.05 to 0.5 mm. When the volume-average particle diameter of the colorant particles is greater than about 0.8 mm, the particle size distribution of the finally obtained toner for electrostatic image development is broadened, and free particles are generated, resulting in deterioration in performance and reliability. When the volume-average particle diameter of the colorant particles is smaller than about 0.05 mm, coloring properties in the toner are reduced, and shape regulation that is one feature of the emulsion aggregation method is lost, so a truly spherical toner cannot be obtained.

The ratio of the number of coarse particles having a volume-average particle diameter of about 0.8 μm or more to the number of the total particles in the colorant particle dispersion is preferably less than about 10% and preferably substantially 0%. The presence of such coarse particles causes deterioration in the stability of the aggregating, generation of free coarse colored particles, and broader particle-size distribution.

The ratio of the number of particles having a volume-average particle diameter of about 0.05 μm or less to the number of the total particles in the colorant particle dispersion is preferably about 5% or less. The presence of such particles causes deterioration in regulation of the shape in the melt-coalescing, so smooth colorant particles having an average circularity of about 0.940 or less may not be obtained.

On the other hand, when the volume-average particle diameter of the colorant particles, coarse particles and particles are in the ranges described above, there does not arise the disadvantage described above, and there is an advantage that the uneven distribution of the colorant particles among toner particles is decreased, and the dispersion thereof in the toner is improved, thus reducing fluctuation in performance and reliability.

The volume-average particle diameter of the colorant particles can be measured by using a laser diffraction particle size measuring instrument (trade name: SALD2000A, described above) or the like. The amount of the colorant added is preferably in the range of about 1 to 20% by mass relative to the toner.

A method of dispersing the colorant in a solvent is not particularly limited, and any method such as that using a rotating shearing homogenizer, a ball mill having a medium, a sand mill or a DYNO-mill can be arbitrarily used.

Examples of the colorant which may be used further include those which are surface-modified with rosin, polymer or the like. The surface-modified colorant is advantageous in that it is sufficiently stabilized in the colorant particle dispersion, and when the colorant is dispersed to a desired average particle diameter in the colorant particle dispersion and mixed with the resin particle dispersion or subjected to the aggregating etc., the colorant particles are not aggregated with one another and can be maintained in an excellent dispersed state. However, a colorant subjected to excessive surface modification may become free without aggregation with the resin particles in the aggregating. Accordingly, the surface modification is conducted under suitably selected optimum conditions.

Examples of the polymer used in surface treatment of the colorant include an acrylonitrile polymer, methyl methacrylate polymer etc.

Examples of the conditions for surface modification include, in general, a polymerization method of polymerizing a monomer in the presence of the colorant (pigment), a phase separation method which includes dispersing the colorant (pigment) in a polymer solution and lowering the solubility of the polymer to precipitate it on the surface of the colorant (pigment), and the like.

Other Additives

When the toner of the invention is used as a magnetic toner, magnetic powder is contained therein, and examples of the magnetic powder used include metals such as ferrite, magnetite, reduced iron, cobalt, nickel and manganese, alloys thereof and compounds containing the metals. If necessary, a wide variety of ordinarily used charge controlling agents such as quaternary ammonium salts, Nigrosine compounds and triphenyl methane pigments may also be added.

In the toner of the invention, inorganic particles can also be contained if necessary. From the viewpoint of durability, it is preferable that inorganic particles having a median particle diameter of about 5 to 30 nm and inorganic particles having a median particle diameter of about 30 to 100 nm are contained in the range of about 0.5 to 10% by mass relative to the toner.

Specific examples of the inorganic particles include silica, hydrophobated silica, titanium oxide, alumina, calcium carbonate, magnesium carbonate, tricalcium phosphate, colloidal silica, cation surface-treated colloidal silica and anion surface-treated colloidal silica. These inorganic particles have been previously treated in the presence of an ionic surfactant by a sonicator, and colloidal silica which does not require this dispersion treatment is more preferably used.

When the amount of the inorganic particles added is less than about 0.5% by mass, sufficient toughness cannot be achieved at the time of toner melting even if the inorganic particles are added, and releasability at oil-less fixation cannot be improved and coarse dispersion of fine toner particles in the toner upon melting increases viscosity only, resulting in deterioration to cause stringiness which deteriorates releasability of releasing at oil-less fixation. When the content of the inorganic particles is higher than about 10% by mass, although sufficient toughness can be attained, fluidity upon toner melting is significantly reduced to deteriorate image glossiness.

A known external additive can be externally added to the toner of the invention. Examples of the external additive include inorganic particles such as silica, alumina, titania, calcium carbonate, magnesium carbonate or tricalcium phosphate. For example, inorganic particles such as silica, alumina, titania and calcium carbonate and resin particles such as vinyl resin, polyester and silicone can be used as a flowability auxiliary agent, a cleaning auxiliary agent or the like. The method of adding the external additive is not particularly limited, and the external additive in a dried state can be added onto the surfaces of the toner particles with shearing force.

Next, manufacturing of the toner of the invention will be explained.

While the toner of the invention can be manufactured by any one of known toner manufacturing methods, in view of controlling an element composition in a vicinity of the toner particle surface, it is preferable that the toner is manufactured via a wet process. The wet process includes forming in water, an organic solvent, or a mixed solvent thereof, colored particle containing at least a binder resin and a colorant, and washing and drying the colored particle.

Examples of the wet process include: a suspension polymerization method including suspending a colorant, a releasing agent, and other components which are used as necessary, together with a polymerizable monomer for forming a binder resin such as an amorphous resin, and polymerizing the polymerizable monomer; a dissolution suspension method including dissolving toner-constituting materials such as the compound having an ionic dissociating group, the binder resin, the colorant, and the releasing agent in the organic solvent, dispersing this in an aqueous solvent in the suspended state, and removing the organic solvent; and an emulsion polymerization aggregation method including preparing a binder resin component such as an amorphous resin by emulsion polymerization, and hetero-aggregating this with a dispersion of a pigment and a releasing agent, followed by melt-coalescence, while the wet process is not limited to these examples. Among these, the emulsion polymerization aggregation method is most suitable for the invention, due to its excellence in particle diameter controllability, narrow particle size distribution, shape controllability, narrow shape distribution, and interior dispersion controllability of the toner.

When the emulsion polymerization aggregation method is utilized, the toner of the invention can be manufactured by, for example, at least aggregating including mixing a resin particle dispersion in which an amorphous resin is dispersed, a colorant particle dispersion in which a colorant is dispersed, and a releasing agent particle dispersion in which a releasing agent is dispersed, so as to form aggregated particles in a raw material dispersion, and melt-coalescing including heating the raw material dispersion, in which the aggregated particles have been formed, to a temperature which is equal to or higher than a glass transition temperature of the binder resin (if necessary, equal to or higher than a melting point of a crystalline resin) to coalesce each of the aggregated particles.

If necessary, other dispersions such as an inorganic fine particle dispersion or a crystalline resin particle dispersion in which a crystalline resin is dispersed may be added to the raw material dispersion. Specifically, when a dispersion of an inorganic fine particle having a hydrophobicized surface is added, dispersability of the releasing agent and the crystalline resin in a toner interior can be controlled by the degree of hydrophobicization.

Hereinafter, the method of producing the toner of the invention is described in more detail by reference to the emulsion polymerization aggregation method.

When the toner of the invention is prepared by the emulsion polymerization aggregation method, the toner can be produced by processes including at least aggregating and melt-coalescing as described above, which may further include adhering resin particles to the surface of an aggregated particle (core particle) formed through the aggregating so as to form an aggregated particle having a core/shell structure.

Aggregating

In the aggregating, aggregated particles are formed in a starting dispersion formed as a mixture of a resin particle dispersion having the non-crystalline resin dispersed therein, a colorant particle dispersion having the colorant dispersed therein and a releasing agent particle dispersion having the releasing agent dispersed therein.

Specifically, a starting dispersion obtained by mixing the respective dispersions is heated to aggregate particles in the starting dispersion, thereby forming aggregated particles. The heating is carried out at a temperature slightly lower than the glass transition temperature of the non-crystalline resin. The heating temperature is preferably lower by about 5 to 25° C. than the melting point or the glass transition temperature.

Formation of aggregated particles is carried out by adding an aggregating agent at room temperature under stirring in a rotating shearing homogenizer and then acidifying the starting dispersion.

As the aggregating agent used in the aggregating, a surfactant having reverse polarity to that of the surfactant used as a dispersant to be added to the starting dispersion, that is, a metal complex having two or more valency can be preferably used in addition to an inorganic metal salt. Particularly preferable aggregating agent is a metal complex because the amount of the surfactant used can be reduced and charging properties are improved in a case where the metal complex is used.

Examples of the inorganic metal salt include metal salts such as calcium chloride, calcium nitrate, barium chloride, magnesium chloride, zinc chloride, aluminum chloride or aluminum sulfate, and inorganic metal salt polymers such as poly(aluminum chloride), poly(aluminum hydroxide) or poly (calcium sulfide). Among these compounds, aluminum salts and polymers formed thereof are particularly preferable. In view of attaining a sharper particle-size distribution, the valence of the inorganic metal salt is more preferably divalent than monovalent, trivalent than divalent, or tetravalent than trivalent, and given the same valence, an inorganic metal salt polymer having polymerization structure is more preferable than monomeric metal salt.

In view of controlling the existence ratios of the IIA Group element, the IIIB Group element and the IVB Group element (excluding carbon), it is particularly preferable in the invention that an inorganic particle dispersion prepared from the inorganic metal salt is added so as to simultaneously aggregate the salt in the aggregating. This can effectively allow the inorganic metal salt act on a molecular chain terminal of a binder resin, and can contribute to formation of a crosslinked structure.

The inorganic particle dispersion can be prepared in a similar manner as that for the colorant particle dispersion, and it is preferable that a dispersion volume-average particle diameter of the inorganic particle is in a range of about 100 to 500 nm.

In the aggregating, an inorganic particle dispersion may be added to the raw material dispersion either in a stepwise manner or in a continuous manner. These methods are effective for attaining a uniform existence ratio from a surface to an interior of the toner. It is particularly preferable that, when the dispersion is added in a stepwise manner, the dispersion is added at three or more stages and that, when the dispersion is added to the raw material dispersion in a continuous manner, the dispersion is added at a slow speed of not higher than around 0.1 g/m.

An amount of the inorganic particle dispersion to be added varies depending on a kind of metal that is needed and an extent of formation of a crosslinked structure, and is preferably in a range of about 0.5 to 10 parts by mass, and more preferably in a range of about 1 to 5 parts by mass, based on 100 parts by mass of the binder resin component.

If necessary, adhering may be carried out after the aggregating. In the adhering, resin particles are allowed to adhere to the surfaces of aggregated particles formed through the aggregating, whereby a coating layer is formed. A toner having a core/shell structure which consists of the core layer and a shell layer coated thereon can be obtained.

The coating layer can be usually formed by additionally adding a dispersion containing non-crystalline resin particles to a dispersion having aggregated particles (core particles) formed in the aggregating. The non-crystalline resin used in the adhering may be the same as, or different from, the one used in the aggregating.

In general, the adhering is used in preparing a toner having a core/shell structure wherein together with the releasing agent, the crystalline resin as binder resin is contained as a main component, and the major object thereof is to prevent depression of the exposure, to the toner surface, of the releasing agent and crystalline resin contained in the core layer and to compensate for the strength of toner particles which may be insufficient when the toner particles are made of the core alone.

In the toner of the invention, however, the releasing agent is excellent in dispersibility and compatibility, and non-crystalline resin is used as binder resin, so that even if the shell layer is not formed in the adhering, components such as the releasing agent adversely influencing charging properties and storage stability can be prevented from being exposed to the surface of the toner, and sufficient strength can also be achieved. Accordingly, when the emulsion polymerization aggregation method is used, there is no problem even if the adhering is omitted, and thus production of the toner can be further simplified.

Melt-coalescing

In the meli-coalescing, which is carried out after the aggregating or after both the aggregating and adhering, includes: adjusting a pH of the suspension containing aggregated particles formed through these processes to be in the range of 6.5 to 8.5 so as to terminate progress of the aggregating; and heating so as to melt-coalescing the aggregated particles.

Specifically, an existing ratio of the IA group element (except for hydrogen) can be controlled to be in a preferable range depending on an aimed value of the pH.

Adjusting of the pH is performed by adding an acid and/or an alkali. While the acid is not particularly limited, an aqueous solution containing about 0.1 to 50% of an inorganic acid such as hydrochloric acid, nitric acid, sulfuric acid or the like is preferable. While the alkali is not particularly limited, an aqueous solution containing about 0.1 to 50% of an alkali metal hydroxide such as sodium hydroxide, potassium hydroxide or the like is preferable. In adjusting the pH, when a local change in the pH occurs, local destruction of an aggregated particle itself or local excessive aggregation is caused, and the change leads to deterioration in a shape distribution. Particularly, as a scale becomes large, an amount of an acid and/or an alkali is increased. Generally, since the acid and the alkali are introduced at one place, when treatment is performed at the same time, a concentration of the acid and the alkali becomes higher at a larger scale.

In order to set an existence ratio of the IA Group element (excluding hydrogen) in the range of the invention, a pH is preferably in a range of about 6.0 to 8.0, and more preferably in a range of about 6.5 to 7.5.

After the composition control is performed, aggregated particles are melt-coalesced by heating. Upon this heating, each of the elements and the molecular chain terminal of the resin are reacted to form a crosslinked structure.

In the melt-coalescing, the aggregated particles are melt-coalesced by heating at a temperature which is equal to or higher than a glass transition temperature of the amorphous resin (if necessary, equal to or higher than a melting point of the crystalline resin).

When heating is carried out for the melt-coalescing or after the melt-coalescing is completed, crosslinking may be carried out. Crosslinking may be alternatively carried out simultaneously the melt-coalescing. When crosslinking is carried out, the crosslinking agent and polymerization initiator described above are used in preparation of the toner.

The polymerization initiator may be mixed with the dispersion before the stage of preparing the starting dispersion or may be incorporated into the aggregated particles in the aggregating. Alternatively, the polymerization initiator maybe introduced during the melt-coalescing or after the melt-coalescing. When the polymerization initiator is introduced during the aggregating, during the adhering, during the melt-coalescing or after the melt-coalescing, a solution or emulsion of the polymerization initiator is added to the dispersion. For the purpose of regulating the degree of polymerization, a known crosslinking agent, chain transfer agent, polymerization inhibitor or the like may be added to the polymerization initiator.

Washing, Drying and the Like

After the melt-coalescing of the aggregated particles is completed, desired toner particles are obtained through arbitrary washing, solid/liquid separating and drying. In consideration of charging properties, the washing preferably sufficiently conducted by replacement washing using ion-exchanged water. While the solid/liquid separating is not particularly limited, from the viewpoint of productivity, filtration under suction, filtration under pressure and the like are preferable. Further, while the drying is not particularly limited, from the viewpoint of productivity, freeze drying, flash jet drying, fluidizing drying, vibration fluidizing drying and the like are preferable. Various external additives described above can be added to the toner particles after drying in accordance with necessity.

Next, physical properties of the toner of the invention will be explained.

In the toner of the invention, it is preferable that a ratio (G'(65)/G'(90)) of a storage modulus G'(65) at 65° C. and a storage modulus G'(90) at 90° C. at a measurement frequency of 1 (rad/sec) in dynamic viscoelasticity measurement by a sine wave vibration method is in a range of about $1\times10^3$ to $1\times10^5$. By setting the ratio in this range, a viscosity necessary at a desired fixation temperature (around 110 to 130° C.) can be obtained, and low temperature fixability can be assured.

In a case where the ratio is less than about $1\times10^3$, since a viscosity necessary for fixation may not be obtained, it may be necessary to raise a fixation temperature in some cases, and in a case where the ratio exceeds about $1\times10^5$, hot offset resistance and a fixation strength may not be obtained in some cases. A more preferable value of G'(65)/G'(90) is in a range of about $1\times10^3$ to $1\times10^4$.

It is thought that such storage modulus ratio is in the aforementioned range, and sharp melting property is obtained because, particularly, by setting existence ratios of the IIA Group element, the IIIB Group element and the IVB Group element (excluding carbon) in the toner in a certain range, compatibility and dispersability between materials including the elements, and the releasing agent and the crystalline resin are improved, and the releasing agent and the crystalline resin are sufficiently included in the toner.

The storage modulus of the toner is obtained from dynamic viscoelasticity measured by a sine wave vibration method. For measuring dynamic viscoelasticity, the ARES measuring apparatus manufactured by Rheometric Scientific is used. In the dynamic viscoelasticity measurent, a toner is molded into a tablet, this is set in a parallel plate having a diameter of about 8 mm, a normal force is adjusted to 0, and sine wave vibration is applied at a vibration frequency of about 1 rad/sec. Measurement is initiated from about 20° C. and is continued up to about 100° C.

In addition, a measurement time interval is about 30 seconds, and the temperature is raised at about 1° C./min. Before measurement, dependency of a strain amount on a stress is confirmed at an interval of about 10° C. from about 20° C. to 100° C., and a strain amount range in which a stress and a strain amount are in a linear relationship at each temperature is obtained. During measurement, a strain amount at each measurement temperature is maintained in a range of about 0.01% to 0.5%, control is performed so that a stress and a strain amount are in the linear relationship at all temperatures, and a storage modulus is obtained from results of these measurements.

The volume-average particle diameter $D_{50v}$ of the toner of the invention is preferably in a range of about 3 to 7 μm. When the volume-average particle diameter is smaller than about 3 μm, charging properties may become insufficient so that the toner may be scattered around to cause image fogging, while when the particle diameter is greater than about 7 μm, the resolution of an image lowers and achievement of high qualities may be difficult. The volume-average particle diameter $D_{50}v$ of the toner of the invention is more preferably in a range of about 5 to 6.5 μm.

The average-volume particle size distribution index GSDv of the toner is preferably about 1.28 or less. When the GSDv is greater than about 1.28, the vividness and resolution of the resulting image may be deteriorated. On the other hand, the number-average particle size distribution index GSDp is preferably about 1.30 or less. When the GSDp is greater than about 1.30, the ratio of small particle toner is high, so there is significant influence not only on initial performance but also on reliability. That is, the adhesion of small-diameter toner is high as conventionally known, so the electrostatic regulation tends to be made difficult, and when a two-component developer is used, the toner tends to remain on a carrier. In this case, when repeated mechanical force is applied, the carrier is contaminated, resulting in acceleration of deterioration of the carrier.

Particularly, in the transferring, transfer of smaller diameter components among toners developed on a photosensitive material tends to become difficult, and consequently, a transfer efficiency is deteriorated, whereby problems such as increase in waste toner or insufficient image quality are caused. As a result of these problems, toner which is not electrostatically controlled and reverse polar toner is increased, and these come to pollute their surroundings. In particular, since these uncontrolled toners are accumulated on an electrification roll via a photosensitive material, unpreferable deterioration in electrification is caused.

Particularly, in a toner containing a crystalline resin component like the toner of the invention, there is a tendency that crystalline resin having insufficient includability is increased in small diameter components, and this may become a cause for unfavorable filming onto a photosensitive material. On the other hand, in large particle diameter components as well, there is a tendency for oversizing via crystalline resin having insufficient includability, and this may become a cause for unfavorable phenomena such as toner cracking in a developing machine, blowing out from a developing machine, deterioration in image quality due to insufficient electrification or the like.

By containing specific elements, there is an action for uniformly aggregating crystalline resin particles and amorphous resin particles, and reduction in a ratio of small-diameter particles and suppression of production of large-diameter particles due to includability improvement can be attained in the invention.

It is more preferable that a volume average particle size distribution index GSDv is about 1.25 or less, and a number average particle size is distribution index GSDp is about 1.25 or less.

In the invention, the volume-average particle diameter $D_{50v}$ and various particle distribution indexes can be determined by using measuring instruments such as COULTER COUNTER TAII (trade name, manufactured by Beckman Coulter, Inc) or MULTISIZER II (trade name, manufactured by Beckman Coulter, Inc.) and electrolytes such as ISOTON-II (trade name, manufacture by Beckman Coulter, Inc.). In the measurement, about 0.5 to 50 mg of a sample for being measured is added to an aqueous solution containing a dispersant, which is a surfactant and is preferably 2 ml of 5% aqueous sodium alkyl benzene sulfonate, and the resultant is added to 100 to 150 ml of the electrolyte.

The electrolyte containing the sample suspended therein is dispersed for about 1 minute with a sonicator, and the particle size distribution of the particles having particle diameters in the range of 2 to 50 μm is measured with an aperture having a diameter of 100 μm by the MULTISIZER II (trade name, described above). The number of particles sampled therein is 50,000.

A cumulative distribution is drawn with respect to each of volume and number by plotting from the side of smallest corresponding to the particle size range (channel) divided on the basis of the particle size distribution thus determined, and the particle diameter at 16% accumulation is defined as cumulative volume particle diameter $D_{16v}$ and cumulative number particle diameter $D_{16P}$, the particle diameter at 50% accumulation is defined as cumulative volume-average particle diameter $D_{50v}$ and cumulative number-average particle diameter $D_{50P}$, and the particle diameter at 84% accumulation is defined as cumulative volume particle diameter $D_{84v}$ and cumulative number particle diameter $D_{84P}$.

Using them, the volume-average particle size distribution index (GSDv) is determined from Formula $(D_{84v}/D_{16v})^{1/2}$, the number-average particle size distribution index (GSDp) from Formula $(D_{84P}/D_{16P})^{1/2}$.

Since a toner having a small particle diameter toner has large adhesion, the efficiency of development is lowered resulting in defects in image qualities. Particularly in the transferring, transfer of components having small diameters in the toner developed on the photoreceptor tends to be difficult, resulting in poor efficiency of transfer, so as to result in increases of amounts of wasted toners and generation of defects in image qualities. These problems result in increases of toners which are not electrostatically regulated and toners having reverse polarity, which may pollute therearound. In particular, these unregulated toners are unfavorable since they are accumulated on a charging roll via the photoreceptor and the like to cause insufficient charging.

The average circularity of the toner of the invention is preferably in a range of about 0.940 to 0.980. When the average circularity is lower than the range, the shape of the toner becomes amorphous and the transferability, durability and flowability thereof are lowered, while when the average circularity is higher than the range, a proportion of spherical particles in the toner increases and cleaning thereof may become difficult in some cases.

The average circularity of the toner of the invention is more preferably in a range of about 0.950 to 0.970.

In a case where a toner contains a crystalline resin as in the invention, when an average circularity of the toner is near the circularity of a sphere, spherical toner having a large amount of crystalline resin components may be increased in some cases, and this may cause unfavorable phenomena such as filming due to accumulation at a part contacting with a cleaning member, deterioration in members due to a rise in torque, filming onto a photosensitive material or the like. On the other hand, in a case where an average circularity of the toner is near that of particles having indeterminate shapes, this may cause unfavorable phenomena such as toner cracking in a developing machine, which may cause exposure of a crystalline resin component at a cracked interface in some cases, whereby chargeability or the like may be deteriorate in some cases.

The average circularity of the toner can be measured by a flow-type particle image analyzer FPIA-2000 (trade name, manufactured by Toairyo Denshi Co., Ltd.). In a specific measurement method, approximately 0.1 to 0.5 ml of a surfactant, preferably alkyl benzene sulfonate, is added as a dispersant to approximately 100 to 150 ml of water, from which impurities is removed in advance, and about 0.1 to 0.5 g of a sample to be measured is further added thereto. The resulting suspension having the sample dispersed therein is dispersed for about 1 to 3 minutes with a sonicator, and the average circularity of the toner is measured at a dispersion density of 3,000 to 10,000 toner particles/μl by the analyzer.

While the glass transition temperature Tg of the toner of the invention is not particularly limited, it is preferably selected in the range of about 40 to 70° C. When the glass transition temperature is lower than this range, there may cause problems in toner storage, storage of fixed images and durability of the toner in a machine. When the glass transition temperature is higher than this range, there may cause problems such as an increase in fixation temperature and an increase in temperature required for granulation.

Tg is measured in accordance with ASTMD3418-8 (the disclosure of which is incorporated herein by reference) by using a differential scanning calorimeter (DSC) such as a differential thermal analyzer DSC-7 (trade name, manufactured by Perkin Elmer, Inc.) or the like. The melting points of indium and zinc are used in temperature correction in a detection part of the apparatus, and the heat of melting of indium is used in correction of calory. With an empty pan set for comparison, a sample is placed on an aluminum pan and measured at an increasing temperature rate of about 10° C./min.

The absolute value of charging of the toner for electrostatic image development according to the invention is preferably in the range of about 10 to 40 μC/g, more preferably about 15 to 35 μC/g. When the absolute value is lower than about 10 μC/g, background staining may tend to occur, while when the absolute value is higher than about 40 μC/g, image density may tend to be lowered.

The ratio of the charging of the toner for electrostatic image development in summer (28° C., 85% RH) to the charging thereof in winter (10° C., 30% RH) is preferably about 0.5 to 1.5, more preferably about 0.7 to 1.3. A ratio outside of the above range is practically not preferable in some cases because the dependence of the toner on the environment may be increased and the charging properties may not be stable.

Electrostatic Image Developer

The electrostatic image developer of the invention (hereinafter, sometimes referred to as merely "developer") contains at least the toner of the invention, and may further contain other components in accordance with objects.

Specifically, when the toner of the invention is used singly, the developer of the invention is prepared as a one-component electrostatic image developer, and when the toner is used in combination with a carrier, the developer is prepared as a two-component electrostatic image developer. A concentration of the toner in the developer is preferably in a range of about 1 to 10% by mass.

The carrier is not particularly limited, and known carriers can be used in the invention. Examples of the known carriers include a carrier having a core material coated with a resin layer (resin-coated carrier) which is described in JP-A No. 62-39879 or JP-A No. 56-11461.

The core material of the resin-coated carrier includes shaped products such as iron powder, ferrite or magnetite, and the average particle diameter thereof is in a range of about 30 to 200 μm.

Examples of the coating resin which forms the coating layer includes styrene and styrene compounds such as parachlorostyrene or ax-methyl styrene, α-methylene fatty monocarboxylic acids such as methyl acrylate, ethyl acrylate, n-propyl acrylate, lauryl acrylate, 2-ethylhexyl acrylate, methyl methacrylate, n-propyl methacrylate, lauryl methacrylate or 2-ethylhexyl methacrylate, nitrogen-containing acryls such as dimethylaminoethyl methacrylate, vinyl nitrites such as acrylonitrile or methacrylonitrile, vinyl pyridines such as 2-vinyl pyridine or 4-vinyl pyridine, vinyl ethers such as vinyl methyl ether or vinyl isobutyl ether, vinyl ketones such as vinyl methyl ketone, vinyl ethyl ketone or vinyl isopropenyl ketone, olefins such as ethylene or propylene, homopolymers or copolymers consisting of two or more monomers selected from vinyl fluorine-containing monomers such as vinylidene fluoride, tetrafluoroethylene or hexafluoroethylene, silicones such as methyl silicone or methyl phenyl silicone, polyesters containing bisphenol, glycol etc., epoxy resin, polyurethane resin, polyamide resin, cellulose resin, polyether resin and polycarbonate resin. These resins may be used singly or as a mixture of two or more thereof.

The amount of the coating resin is in the range of about 0.1 to 10 parts by weight, and preferably about 0.5 to 3.0 parts by weight, relative to 100 parts by weight of the core material. For production of the carrier, a heating kneader, a heating Henschel mixer, an UM mixer or the like can be used, and a heating fluidized rolling bed, a heating kiln etc. can be used depending on the amount of the coating resin. The mixing ratio of the toner/carrier in the electrostatic image developer is not particularly limited, and can be suitably selected depending on the purpose.

Image Forming Method

Hereinafter, the image forming method of the invention is described in detail.

While the image forming method of the invention is not particularly limited insofar as the toner (developer) of the invention is used, it preferably includes at least forming an electrostatic latent image on the surface of a latent image carrier, developing the electrostatic latent image with a developer containing at least the toner of the invention to form a toner image, transferring the toner image onto a recording medium, and fixing the toner image on the recording medium.

The image forming method of the invention can be combined with known processes usable in image forming methods by electrophotography, in addition to the processes described above, and the method may further comprise, for example, cleaning and recovering residual toner remaining on the surface of the latent image carrier after the transferring so as to recover the toner, and toner recycling where the residual toner recovered in the cleaning is re-utilized as the developer.

The electrostatic latent image-forming includes charging the surface of a latent image carrier evenly with a charging means (charging device) and then exposing the latent image carrier to light with a laser optical system or an LED array so as to form an electrostatic latent image. The charging means (charging device) may be any kind of charger, and examples thereof include non-contact-type chargers such as corotron and scorotron and contact-type chargers that charges a surface of a latent image carrier by applying voltage to an electroconductive member contacting with the surface of the latent image carrier. From the viewpoints of exhibiting the effects of less generation of ozone, environmental compatibility and excellent printing durability, a charger of contact charging type is preferable. In the charger of contact charging type, the shape of the electroconductive member is not limited, and may be in the form of a brush, blade, pin electrode or roller. The image forming method of the invention is not particularly limited with respect to the latent image forming process.

The development process is a process wherein a developer carrier having a developer layer containing at least a toner formed on the surface thereof is contacted with, or made close to, the surface of a latent image carrier thereby allowing toner particles to adhere to an electrostatic latent image on the surface of the latent image carrier so as to form a toner image on the surface of the latent image carrier. Known systems can be used in the development system in the invention, and examples of a developer system where the developer is a two-component developer include a cascade system, a magnetic brush system and the like. The image forming method of the invention is not particularly limited with respect to the development system.

The transferring is a process of transferring a toner image formed on the surface of the latent image carrier onto a recording medium. The transferring is not particularly limited and may be a system of directly transferring a toner image onto a recording medium such as paper or a system including transferring a toner image onto a drum- or belt-shaped intermediate transfer material and then transferring it onto a recording medium such as paper.

A corotron can be used as the transfer apparatus for transferring a toner image from the latent image carrier onto paper or the like. The corotron is effective as a means of uniformly charging paper, and for applying predetermined charge to paper as a recording medium, high voltage of several kV should be applied, and a high-voltage power source is necessary. Because ozone is generated due to corona discharge, rubber parts and the latent image carrier are deteriorated. Accordingly, a contact-transfer system is preferable in which an electroconductive transfer roll made of an elastic material is abutted on the latent image carrier to transfer a toner image onto paper. The image forming method of the invention is not particularly limited with respect to the transfer apparatus.

The cleaning process is a process of removing a toner, paper powder, dust etc. adhering to the surface of the latent image carrier by directly contacting a blade, brush, roll or the like with the surface of the latent image carrier.

The most generally used system is a blade cleaning system wherein a blade made of rubber such as polyurethane is abutted on the latent image carrier. Use can also be made of a magnetic brush system having a magnet fixed therein and provided with a rotatable cylindrical non-magnetic sleeve arranged in the outer periphery of the magnet, wherein a magnetic carrier is carried on the surface of the sleeve to recover a toner, or a system wherein a semi-electroconductive resin fiber or animal hair is rendered rotatable in a rolled state, and bias of polarity opposite to the toner is applied to the roll to remove the toner. In the former magnetic brush system, a corotron for cleaning pretreatment may be arranged. In the image forming method of the invention, the cleaning system is not particularly limited.

The fixing is a process wherein the toner image transferred on the surface of the recording medium is fixed with a fixation apparatus. As the fixation apparatus, a heating fixation apparatus using a heat roll is preferably used. The heating fixation apparatus includes a fixation roller having a heater lamp for heating arranged in a cylindrical metallic core and provided with a heat-resistant resin coating layer or a heat-resistant rubber coating layer as a release layer on the outer periphery thereof, and a press roller or a press belt abutted on this fixation roller and having a heat-resistant elastic layer formed on the outer periphery of a cylindrical core or on the surface of a belt-shaped substrate. In the process of fixing a toner image, a recording medium having the toner image formed thereon is passed between the fixation roller and the press roller or the press belt, and the binder resin, additives etc. in the toner are fixed by heat melting. In the image forming method of the invention, the fixation system is not particularly limited.

For forming a full-color image in the image forming method of the invention, it is preferable to use the image forming method wherein plural latent image carriers have developer carriers in different colors, and by a series of processes consisting of a latent image forming process, a development process, a transferring and a cleaning process with the respective latent image carriers and developer carriers, toner images in different colors are successively layered on the surface of the same recording medium, and the resulting layered full-color toner image is thermally fixed in the fixing. The developer of the invention is used in the image forming method, whereby stable development, transfer and fixation performance can be obtained even in a tandem system suitable for small size and high-speed color printing.

The system for toner recycling is not particularly limited and examples thereof include a method wherein a toner recovered in a cleaning part is sent on a delivery conveyer or with a transfer screw to a replenishing toner hopper or a developing device, or after being mixed with a replenishing toner in an intermediate chamber, is fed to a developing device. Preferably, the toner recycle system is a system wherein the recycle toner is returned directly to a developing device or the recycle toner is mixed with a replenishing toner in an intermediate chamber and then fed to a developing device.

When the toner is used by recycling, it is necessary that the strength of the toner particles is high and the releasing agent is excellent in dispersibility in the toner and is not exposed to the surface of the toner. The toner of the invention has sufficient strength, thus causing no deterioration in image qualities even if the toner is used for a long time.

The image forming apparatus using the image forming method of the invention is constituted as a process cartridge consisting of elements such as a photoreceptor (latent image carrier), a developing device and a cleaning device connected to one another as one body, and this unit may be constituted to be freely attachable to and detachable from the main body of the apparatus. At least one of a charger, a light exposing device, a developing device, a transfer device or a separator, and a cleaning device may be integrated with the photoreceptor to form a process cartridge as a single unit freely attachable to and detachable from the main body of the apparatus, and may be constituted to be freely attached and detached with a guiding means such as a rail of the main body of the apparatus.

The recording medium onto which a toner image is transferred includes, for example, paper and OHP sheet used in a copier or printer in an electrophotographic system. For further improving the smoothness of the surface of an image after fixation, the surface of the transfer material is also preferably as smooth as possible, and paper coated with resin or the like, coated paper for printing, etc. can be preferably used.

The photoreceptor used in the image forming method of the invention is described in detail.

A known photoreceptor having at least a photosensitive layer formed on an electroconductive support can be used as the photoreceptor used in the invention, and preferable examples thereof include an organic photoreceptor. In the case where an organic photoreceptor is used in the invention, it is preferable that a layer constituting the outermost surface of the photoreceptor contains a resin having a crosslinked structure. Examples of the resin having a crosslinked structure includes a phenol resin, an urethane resin and a siloxane resin, and among them, a siloxane resin and a phenol resin are most preferable.

The photoreceptor wherein the resin having a crosslinked structure is contained in a layer constituting the outermost surface thereof has high strength and can thus have high resistance to abrasion and scratch so as to attain ultra-longevity of the photoreceptor. However, when a cleaning blade is used as a means of cleaning the photoreceptor to secure cleaning properties, the cleaning blade is preferably contacted at a relatively high abutting pressure with the photoreceptor. In this case, the toner remaining on the surface of the photoreceptor can be easily broken in the abutted region between the cleaning blade and the photoreceptor, so the constituent materials of the toner tend to adhere to the surface of the photoreceptor and subsequent change in charging easily occurs. However, the toner of the invention has excellent strength and can thus prevent such problem, and does not cause deterioration in image qualities for a long time even if it is used in combination with the system of re-utilizing the toner by recycling recovered residual toner as a developer.

The layer structure of the photoreceptor used in the invention is not particularly limited insofar as it comprises an electroconductive support and a photosensitive layer arranged on the electroconductive support, and the photoreceptor preferably has photosensitive layer consisting of at least a charge generating layer and a charge transporting layer different in functions each other, and preferably the layer structure specifically comprises an undercoat layer, a charge generating layer, a charge transporting layer and a protective layer in this order on the surface of an electroconductive substrate. Hereinafter, the respective layers are described in detail.

Examples of the electroconductive support include a metal plate, a metal drum and a metal belt using a metal such as aluminum, copper, zinc, stainless steel, chromium, nickel, molybdenum, vanadium, indium, gold and platinum or an alloy of any of these, or a paper, a plastic film and a belt coated, deposited or laminated with an electroconductive polymer, an electroconductive compound such as indium oxide, a metal such as aluminum, palladium and gold or an alloy of any of these. When the photoreceptor is used in a laser printer, the oscillation wavelength of the laser is preferably in a range of about 350 to 850 nm, and shorter wavelength is more preferable for higher resolution of image.

For preventing interference fringes generated upon irradiation with laser beam, the surface of the support is preferably roughened to a central line average roughness (Ra) of about 0.04 μm to 0.5 μm. The roughening method is preferably wet honing of the support with an aqueous suspension of an abrasive, center-less abrasion of continuously abrading the support against a rotating grindstone, anodizing, or formation of a layer containing organic or inorganic semi-electroconductive particles. Roughness outside of the above range is not suitable because when Ra is less than about 0.04 μm, the surface of the support assumes a mirror surface, thus failing to attain an interference preventing effect, while when Ra is greater than about 0.5 μm, image qualities are roughened even if a coating is formed. When a non-interference light is used as the light source, surface roughening for preventing interference fringes is not particularly necessary, generation of defects due to the uneven surface of the substrate can be prevented, and thus longer longevity can be attained.

Anodizing includes anodizing, in an electrolyte solution, aluminum which is set as an anode so as to form an oxide film on the surface of aluminum. The electrolyte solution includes a sulfuric acid solution, oxalic acid solution and the like. However, the porous anodized film itself is chemically active, is easily polluted and significantly changes resistance depending on the environment. Accordingly, the anodized film is subjected to pore sealing wherein fine pores of the anodized film are closed by volume expansion with hydration reaction in pressurized water vapor or boiling water (to which a metallic salt of nickel or the like may be added) thereby converting it into a more stable hydrated oxide. The thickness of the anodized film is preferably in a range of about 0.3 to 15 μm. When the thickness is less than about 0.3 μm, the film is poor in barrier properties against injection and unsatisfactory in effect. When the thickness is greater than about 15 μm, residual potential is increased due to repeated use.

The treatment with an acidic treating solution consisting of phosphoric acid, chromic acid and fluoric acid is carried out in the following manner. The compounding ratio of phosphoric acid, chromic acid and fluoric acid in the acidic treating solution is preferably established such that that phosphoric acid is in the range of about 10 to 11% by mass, chromic acid in the range of about 3 to 5% by mass, and fluoric acid in the range of about 0.5 to 2% by mass, and the total concentration of these acids is in the range of about 13.5 to 18% by mass. The treatment temperature is about 42 to 48° C., and by keeping the treatment temperature high, a thick film can be formed more rapidly. The thickness of the film is preferably about 0.3 to 15 μm. When the thickness of the film is less than about 0.3 μm, the film is poor in barrier properties against injection, and a satisfactory effect can not be attained. When the thickness of the film is greater than about 15 μm, residual electric potential is caused by repeated use.

Boehmite treatment can be carried out by dipping in purified water at about 90 to 100° C. for about 5 to 60 minutes or by contacting with heated water vapor at about 90 to 120° C. for about 5 to 60 minutes. The thickness of the film is preferably about 0.1 to 5 μm. The film can further be subjected to anodizing with an electrolyte solution such as a solution containing adipic acid, boric acid, borate, phosphate, phthalate, maleate, benzoate, tartrate or citrate, in which the film is hardly dissolved. Examples of the organic or inorganic semi-electroconductive particles include organic pigments such as perylene pigments described in JP-A No. 47-30330, bisbenzimidazole perylene pigments, polycyclic quinone pigments, indigo pigments or quinacridone pigments, organic pigments such as bisazo pigment or phthalocyanine pigment having an electron attractive substituent group such as a cyano group, a nitro group, a nitroso group or a halogen atom, and inorganic pigments such as zinc oxide, titanium oxide or aluminum oxide. Among these pigments, zinc oxide and titanium oxide are preferable because they have a high ability to transfer charge and are effective in film thickening.

For the purpose of improving dispersibility or regulating the energy level, the surfaces of these pigments are preferably treated with organic titanium compounds such as titanate coupling agent, aluminum chelate compound and aluminum coupling agent and particularly preferably treated with silane coupling agents such as vinyl trichlorosilane, vinyl trimethoxy silane, vinyl triethoxy silane, vinyl tris-2-methoxy ethoxy silane, vinyl triacetoxy silane, γ-glycidoxy propyl trimethoxy silane, γ-methacryloxy propyl trimethoxy silane, γ-aminopropyl triethoxy silane, γ-chloropropyl trimethoxy silane, γ-2-aminoethyl aminopropyl trimethoxy silane, γ-mercaptopropyl trimethoxy silane, γ-ureidopropyl triethoxy silane and β-3,4-epoxy cyclohexyl trimethoxy silane.

When the amount of the organic or inorganic semi-electroconductive particles is too high, the strength of the undercoat layer is reduced to cause defects in a coating, and thus the semi-electroconductive particles are used in an amount of preferably about 95% by mass or less, more preferably about 90% by mass or less. A method using a ball mill, a roll mill, a sand mill, an attriter or supersonic waves is used as the method of mixing and dispersing the organic or inorganic semi-electroconductive particles. Mixing/dispersion is carried out in an organic solvent which may be any organic solvent dissolving an organometallic compound or resin and not causing gelation or aggregation upon mixing/dispersion of the organic or inorganic semi-electroconductive particles. For example, an usual organic solvent such as methanol, ethanol, n-propanol, n-butanol, benzyl alcohol, methyl cellosolve, ethyl cellosolve, acetone, methyl ethyl ketone, cyclohexanone, methyl acetate, n-butyl acetate, dioxane, tetrahydrofuran, methylene chloride, chloroform, chlorobenzene and toluene may be used singly or a mixed solvent of two or more thereof may be used.

If necessary, an undercoat layer may be further formed between the electroconductive support and the photosensitive layer.

Examples of the material used in forming the undercoat layer include organozirconium compounds such as zirconium chelate compound, zirconium alkoxide compound and zirconium coupling agent, organotitanium compounds such as titanium chelate compound, titanium alkoxide compound and titanate coupling agent, organoaluminum compounds such as aluminum chelate compound and aluminum coupling agent, and organometallic compounds such as antimony alkoxide compound, germanium alkoxide compound, indium alkoxide compound, indium chelate compound, manganese alkoxide compound, manganese chelate compound, tin alkoxide compound, tin chelate compound, aluminum silicon alkoxide compound, aluminum titanium alkoxide compound and aluminum zirconium alkoxide compound, and among them, organozirconium compounds, organotitanium compounds and organoaluminum compounds are preferably used because they exhibit excellent electrophotographic properties with low residual potential.

Further, silane coupling agents such vinyl trichlorosilane, vinyl trimethoxy silane, vinyl triethoxy silane, vinyl tris-2-methoxy ethoxy silane, vinyl triacetoxy silane, γ-glycidoxy propyl trimethoxy silane, γ-methacryloxy propyl trimethoxy silane, γ-aminopropyl triethoxy silane, γ-chloropropyl trimethoxy silane, γ-2-aminoethyl aminopropyl trimethoxy silane, γ-mercaptopropyl trimethoxy silane, γ-ureidopropyl triethoxy silane and β-3,4-epoxy cyclohexyl trimethoxy silane can be used in the undercoat layer.

It is also possible to use known binder resins conventionally used in the undercoat layer, for example polyvinyl alcohol, polyvinyl methyl ether, poly-N-vinylimidazole, polyethylene oxide, ethyl cellulose, methyl cellulose, ethylene-acrylic acid copolymer, polyamide, polyimide, casein, gelatin, polyethylene, polyester, phenol resin, vinyl chloride-vinyl acetate copolymer, epoxy resin, polyvinyl pyrrolidone, polyvinyl pyridine, polyurethane, polyglutamic acid and polyacrylic acid. The mixing ratio of these materials can be suitably selected depending on necessity.

An electron transporting pigment can be mixed and/or dispersed in the undercoat layer. Examples of the electron transporting pigments include organic pigments such as perylene pigment described in JP-A No. 47-30330, bisbenzimidazole perylene pigment, polycyclic quinone pigment, indigo pigment and quinacridone pigment, organic pigments such as bisazo pigment and phthalocyanine pigment having an electron attractive substituent group such as cyano group, nitro group, nitroso group or halogen atom, and inorganic pigments such as zinc oxide and titanium oxide.

Among these pigments, perylene pigment, bisbenzimidazole perylene pigment, polycyclic quinone pigment, zinc oxide and titanium oxide are preferably used because of their high electron mobility. These pigments may be surface-treated with the above-mentioned coupling agent, binder etc. for the purpose of regulating dispersibility and charge transportability. When the amount of the electron transport pigment is too high, the strength of the undercoat layer is reduced, and coating defects are generated, and thus the electron transporting pigment is used in an amount of about 95% by mass or less, preferably about 90% by mass or less.

As the mixing and/or dispersing method, a usual method of using a ball mill, a roll mill, a sand mill, an attriter or supersonic waves is used. Mixing/dispersion is carried out in an organic solvent which may be any organic solvent dissolving an organic metallic compound and resin and not causing gelation or aggregation upon mixing and/or dispersing of the electron transporting pigment. For example, an usual organic solvent such as methanol, ethanol, n-propanol, n-butanol, benzyl alcohol, methyl cellosolve, ethyl cellosolve, acetone, methyl ethyl ketone, cyclohexanone, methyl acetate, n-butyl acetate, dioxane, tetrahydrofuran, methylene chloride, chloroform, chlorobenzene and toluene may be used singly, or a mixed solvent of two or more thereof may be used.

The thickness of the undercoat layer is generally in a range of about 0.1 to 30 μm, preferably in a range of about 0.2 to 25 μm. Examples of the coating method usable in forming the undercoat layer include usual methods such as blade coating, Meyer bar coating, spray coating, dipping coating, bead coating, air knife coating and curtain coating. The coating solution is dried to give the undercoat layer, and usually, drying is carried out at a temperature where a coating can be formed by evaporating the solvent. Particularly, a substrate treated with an acidic solution or boehmite becomes poor in ability to hide defects on the substrate, and thus an intermediate layer is preferably formed.

Further, the charge generating layer is described in detail.

As a charge generation material used in forming the charge generating layer, use can be made of all known charge generation materials, for example azo pigments such as bisazo and trisazo, condensed aromatic pigments such as dibromoanthanthrone, organic pigments such as perylene pigment, pyrrolopyrrole pigment and phthalocyanine pigment, and inorganic pigments such as triclinic selenium and zinc oxide, and particularly when an exposure light wavelength of about 380 nm to 500 nm is used, an inorganic pigment is preferable, and when an exposure light wavelength of about 700 nm to 800 nm is used, metallic and nonmetallic phthalocyanine pigments are preferable. Particularly, hydroxy gallium phthalocyanine disclosed in JP-A No. 5-263007 and JP-A No. 5-279591, chlorogallium phthalocyanine in JP-A No.

5-98181, dichlorotin phthalocyanine in JP-A No. 5-140472 and JP-A No. 5-140473, and titanyl phthalocyanine in JP-A No. 4-189873 and JP-A No. 5-43813 are preferable.

The binder resin used for forming the charge generating layer can be selected from a wide variety of insulating resins or can be selected from organic photoelectroconductive polymers such as poly-N-vinyl carbazole, polyvinyl anthracene, polyvinyl pyrene or polysilane. The binder resin is preferably insulating resin which includes, but is not limited to, polyvinyl butyral resin, polyarylate resin (such as a polycondensate of bisphenol A and phthalic acid), polycarbonate resin, polyester resin, phenoxy resin, vinyl chloride-vinyl acetate copolymer, polyamide resin, acryl resin, polyacrylamide resin, polyvinyl pyridine resin, cellulose resin, urethane resin, epoxy resin, casein, polyvinyl alcohol resin and polyvinyl pyrrolidone resin. These binder resins may be used singly or as a mixture of two or more thereof.

The compounding ratio (weight ratio) of the charge generation material to the binder resin is preferably in the range of about 10:1 to 1:10. As the method of dispersing them, use can be made of an usual method such as a ball mill dispersion method, an attriter dispersion method or a sand mill dispersion method, wherein conditions under which the crystalline form is not changed by dispersion are required. It is confirmed that the crystalline form is not changed after dispersion by the dispersion method carried out in the invention. In dispersion, it is effective for the size of the particle to be reduced to a size of about 0.5 μm or less, preferably about 0.3 μm or less, more preferably about 0.15 μm or less.

As the solvent used in the dispersion, ordinary organic solvent such as methanol, ethanol, n-propanol, n-butanol, benzyl alcohol, methyl cellosolve, ethyl cellosolve, acetone, methyl ethyl ketone, cyclohexanone, methyl acetate, n-butyl acetate, dioxane, tetrahydrofuran, methylene chloride, chloroform, chlorobenzene or toluene may be used singly, or a mixed solvent of two or more thereof may be used.

The thickness of the charge generating layer is generally in a range of about 0.1 to 5 μm, preferably in a range of about 0.2 to 2.0 μm. The coating method usable in forming the charge generating layer includes an usual method such as blade coating, Meyer bar coating, spray coating, dipping coating, bead coating, air knife coating and curtain coating.

Further, the charge transporting layer is described in detail.

As the charge transporting layer, a layer formed by known techniques can be used. The charge transporting layer may be formed by using a charge transport material and binder resin or by using a polymeric charge transport material.

Examples of the charge transport material include electron transporting compounds such as quinone compounds such as p-benzoquinone, chloranil, bromanil or anthraquinone, tetracyanoquinodimethane compound, fluorenone compound such as 2,4,7-trinitrofluorenone, xanthone compound, benzophenone compound, cyanovinyl compound or ethylene compound, and hole transporting compounds such as triaryl amine compound, benzidine compound, aryl alkane compound, aryl-substituted ethylene compound, stilbene compound, anthracene compound or hydrazone compound. These charge transport materials can be used singly or as a mixture of two or more thereof, and the charge transport material is not limited thereto. While these charge transport materials can be used singly or as a mixture of two or more thereof, from the viewpoint of mobility, the charge transport materials are preferably those having structures represented by any one of the following Formulae (A) to (C):

Formula (A)

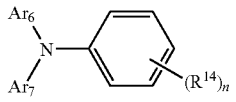

In Formula (A), $R^{14}$ represents a hydrogen atom or a methyl group; n is 1 or 2; $Ar_6$ and $Ar_7$ each represent a substituted or unsubstituted aryl group, and a substituent group of the aryl group is selected from the group consisting of a halogen atom, an alkyl group having 1 to 5 carbon atoms, an alkoxy group having 1 to 5 carbon atoms, or an amino group substituted with an alkyl group having 1 to 3 carbon atoms.

Formula (B)

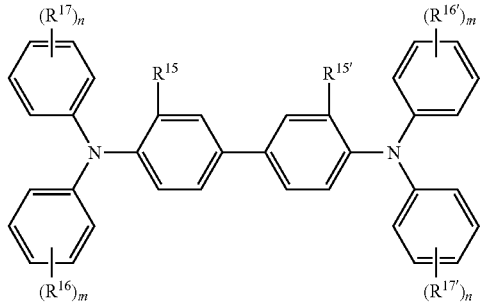

In Formula (B), $R^{15}$ and $R^{15}$, may be the same or different and each represent a hydrogen atom, a halogen atom, an alkyl group having 1 to 5 carbon atoms, or an alkoxy group having 1 to 5 carbon atoms; $R^{16}$, $R^{16'}$, $R^{17}$ and $R^{17'}$ may be the same or different and each represent a hydrogen atom, a halogen atom, an alkyl group having 1 to 5 carbon atoms, an alkoxy group having 1 to 5 carbon atoms, an amino group substituted with an alkyl group having 1 to 2 carbon atoms, a substituted or unsubstituted aryl group, $—C(R^{18})═C(R^{19})(R^{20})$, or $—CH═CH—CH═C(Ar)_2$; $R^{18}$, $R^{19}$ and $R^{20}$ each represent a hydrogen atom, a substituted or unsubstituted alkyl group, or a substituted or unsubstituted aryl group; Ar represents a substituted or unsubstituted aryl group; and each of m and n is an integer of 0 to 2.

Formula (C)

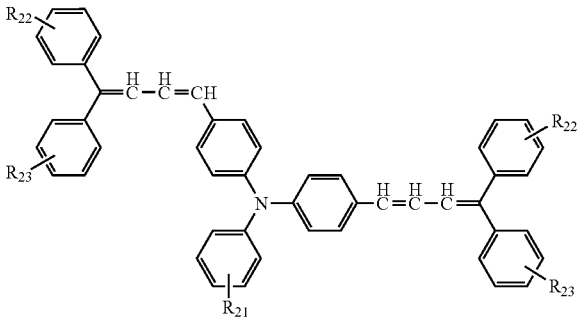

In Formula (C), $R_{21}$ represents a hydrogen atom, an alkyl group having 1 to 5 carbon atoms, an alkoxy group having 1 to 5 carbon atoms, a substituted or unsubstituted aryl group, or —CH═CH—CH═C(Ar)$_2$; Ar represents a substituted or unsubstituted aryl group; $R_{22}$ and $R_{23}$ may be the same or different and each represent a hydrogen atom, a halogen atom, an alkyl group having 1 to 5 carbon atoms, an alkoxy group having 1 to 5 carbon atoms, an amino group substituted with an alkyl group having 1 to 2 carbon atoms, or a substituted or unsubstituted aryl group.

As the binder resin used in the charge transporting layer, it is possible to use polymer charge transport materials such as polycarbonate resin, polyester resin, methacryl resin, acryl resin, polyvinyl chloride resin, polyvinylidene chloride resin, polystyrene resin, polyvinyl acetate resin, styrene-butadiene copolymer, vinylidene chloride-acrylonitrile copolymer, vinyl chloride-vinyl acetate copolymer, vinyl chloride-vinyl acetate-maleic anhydride copolymer, silicone resin, silicone-alkyd resin, phenol-formaldehyde resin, styrene-alkyd resin, poly-N-vinyl carbazole, polysilane, as well as polyester polymeric charge transport materials and polymeric charge transport materials described in JP-A No. 8-176293 or JP-A No. 8-208820. These binder resins can be used singly or as a mixture of two or more thereof. The compounding ratio (weight ratio) of the charge transport material to the binder resin is preferably from about 10:1 to 1:5.

For formation of the charge transporting layer, the polymer charge transport materials can be singly used. As the polymer charge transport materials, known materials having charge transportability, such as poly-N-vinyl carbazole and polysilane, can be used. Particularly polyester polymeric charge transport materials described in JP-A No. 8-176293 and JP-A No. 8-208820 have high charge transportability and are particularly preferable. While the polymeric charge transport material can be singly used as the charge transporting layer, it may be mixed with the binder resin to form a coating.

The thickness of the charge transporting layer is generally in a range of about 5 to 50 μm, preferably in a range of about 10 to 30 μm. As the coating method, it is possible to use an usual method such as blade coating, Meyer bar coating, spray coating, dipping coating, bead coating, air knife coating and curtain coating. The solvent used in forming the charge transporting layer includes usual organic solvents such as aromatic hydrocarbons such as benzene, toluene, xylene and chlorobenzene, ketones such as acetone and 2-butanone, halogenated aliphatic hydrocarbons such as methylene chloride, chloroform and ethylene chloride, and cyclic or linear ethers such as tetrahydrofuran and ethyl ether. These solvents may be used singly or a in a mixture of two or more thereof.

For the purpose of preventing the deterioration of the photoreceptor due to ozone and an oxidized gas generated in a copier or due to light or heat, additives such as an antioxidant, a light stabilizer and a heat stabilizer can be added to the photosensitive layer. For example, the antioxidant includes hindered phenol, hindered amine, paraphenylene diamine, aryl alkane, hydroquinone, spirochroman, spiroindanone and modified compounds thereof, organic sulfur compounds, organic phosphorous compounds, etc. Examples of the light stabilizer include modified compounds of benzophenone, benzotriazole, dithiocarbamate, tetramethyl piperidine or the like.

For the purpose of improvement in sensitivity, reduction in residual potential, reduction in fatigue upon repeated use, etc., at least one kind of electron receptor can be contained. Examples of the electron receptor usable in the photoreceptor of the invention include succinic anhydride, maleic anhydride, dibromomaleic anhydride, phthalic anhydride, tetrabromophthalic anhydride, tetracyanoethylene, tetracyanoquinodimethane, o-dinitrobenzene, m-dinitrobenzene, chloranil, dinitroanthraquinone, trinitrofluorenone, picric acid, o-nitrobenzoic acid, p-nitrobenzoic acid, phthalic acid and compounds represented by Formula (I). Among these compounds, fluorenone electron receptors, quinone electron receptors and benzene compounds having electron attractive substituent groups such as Cl, CN and $NO_2$ are particularly preferable.

Further, the protective layer is described in detail.

To confer resistance to abrasion, scratch etc. on the surface of the photoreceptor, a high-strength protective layer can also be formed. This protective layer is preferably a layer wherein electroconductive particles are dispersed in a binder resin, or lubricating particles such as fluorine resin, acryl resin etc. are dispersed in an usual charge transport material, or a hard coating agent such as silicone and acryl, and from the viewpoint of strength, electric characteristics and image quality maintenance, the protective layer preferably contains resin having a crosslinked structure, and more preferably further contains a charge transport material. As the resin having a crosslinked structure, various materials can be used, and in respect of characteristics, phenol resin, urethane resin, siloxane resin etc. are preferable, and particularly a protective layer having at least a siloxane resin or a phenol resin is preferable.

Specifically, a protective layer having a structure derived from a compound represented by Formula (I) or (II) is excellent in strength and stability and is thus particularly preferable.

$$F\text{-}[D\text{-}Si(R^2)_{(3-a)}Q_a]_b \quad (I)$$

In Formula (I), F is an organic group derived from a compound having hole transportability, D is a flexible subunit, $R^2$ represents hydrogen, an alkyl group or a substituted or unsubstituted aryl group, Q represents a hydrolyzable group, a is an integer of 1 to 3, and b is an integer of 1 to 4.

The flexible subunit represented by D in Formula (I) contain essentially —$(CH_2)_n$— group, which may be combined with —COO—, —O—, —CH═CH— or —CH═N— group to form a divalent linear group. In the —$(CH_2)_n$— group, n is an integer of 1 to 5. The hydrolyzable group represented by Q represents —OR group wherein R represents an alkyl group.

$$F\text{—}((X)_nR_1\text{—}ZH)_m \quad (II)$$

In Formula (II), F is an organic group derived from a compound having hole transportability, $R_1$ is an alkylene group, Z is —O—, —S—, —NH— or —COO—, and m is an integer of 1 to 4. X represents —O— or —S—, and n is integer of 0 or 1.

The compound represented by Formula (I) or (II) is more preferably a compound wherein the organic group F is represented particularly by the following Formula (III):

Formula (III)

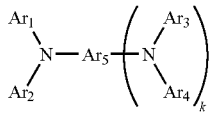

(III)

In Formula (III), $Ar_1$ to $Ar_4$ independently represent a substituted or unsubstituted aryl group; $Ar_5$ represents a substituted or unsubstituted aryl or arylene group and simultaneously two to four of $Ar_1$ to $Ar_5$ have a linking bond represented by $-D-Si(R^2)_{(3-a)}Q_a$ in Formula (I); k represents 0 or 1; D represents a flexible subunit; $R^2$ represents hydrogen, an alkyl group or a substituted or unsubstituted aryl group; Q represents a hydrolyzable group; and a is an integer of 1 to 3.

In Formula (III), $Ar_1$ to $Ar_4$ independently represent a substituted or unsubstituted aryl group, and are specifically preferably groups represented by the following structure group 1.

Structure Group 1:

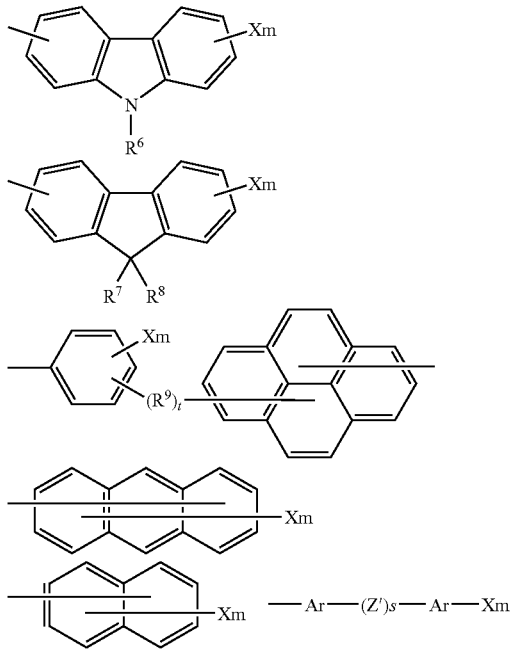

Ar shown in the structure group 1 is preferably selected from the following structure group 2, and Z' is selected preferably from the following structure group 3.

Structure Group 2

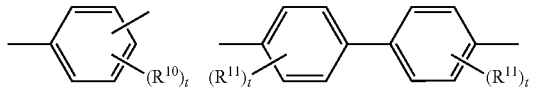

Structure Group 3

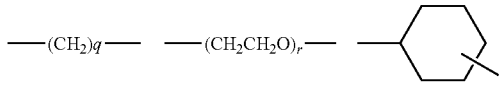

-continued

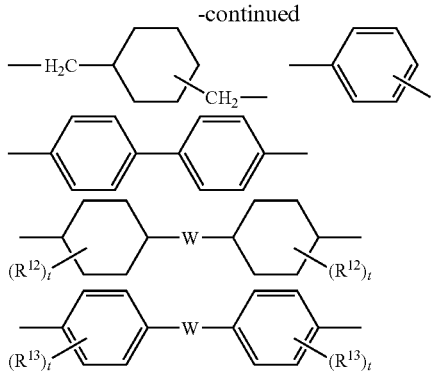

In the structure groups 1 to 3, $R^6$ represents a hydrogen atom or a group which is selected from the group consisting of an alkyl group having 1 to 4 carbon atoms, a phenyl group substituted with an alkyl group having 1 to 4 carbon atoms, a phenyl group substituted with an alkoxy group having 1 to 4 carbon atoms, an unsubstituted phenyl group, or an aralkyl group having 7 to 10 carbon atoms.

Each of $R^7$ to $R^{13}$ is selected from hydrogen, an alkyl group having 1 to 4 carbon atoms, an alkoxy group having 1 to 4 carbon atoms, a phenyl group substituted with an alkoxy group having 1 to 4 carbon atoms, an unsubstituted phenyl group, an aralkyl group having 7 to 10 carbon atoms, or halogen.

m and s each represent 0 or 1; q and r each represent an integer of 1 to 10; and t represents an integer of 1 to 3. X represents a group represented by $-D-Si(R^2)_{(3-a)}Q_a$ in Formula (I).

W shown in the structure group 3 is preferably represented by the following structure group 4. In the structure group 4, s' represents an integer of 0 to 3.

Structure Group 4

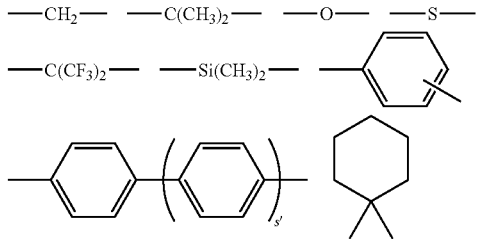

One embodiment of specific structures of $Ar_5$ in Formula (III) include a structure in which m in the structure of $Ar_1$ to $Ar_4$ is 1 when k=0, and a structure in which m in the structure of $Ar_1$ to $Ar_4$ is 0 when k=1.

While specific examples of the compounds represented by Formula (III) include compounds (III-1) to (III-61) shown in Tables 1 to 7 below, the compounds represented by Formula (III) used in the invention are not limited thereto.

In the structural formulae shown in the columns of "$Ar_1$" to "$Ar_5$" in Tables 1 to 7, the benzene ring-bound "—S" group refers to a monovalent group (group corresponding to the structure represented by $-D-Si(R^2)_{(3-a)}Q_a$ in Formula (I)) shown in the columns of "S" in Tables 1 to 7.

TABLE 1
| No. | $Ar^1$ | $Ar^2$ | $Ar^3$ | $Ar^4$ |
|---|---|---|---|---|
| III-1 | 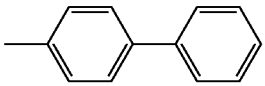 | 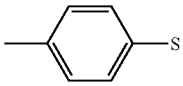 | — | — |
| III-2 | 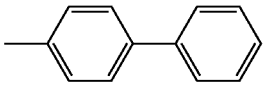 | 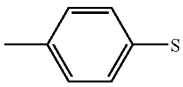 | — | — |
| III-3 | 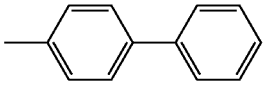 | 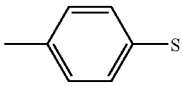 | — | — |
| III-4 | 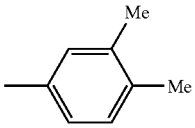 | 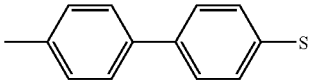 | — | — |
| III-5 | 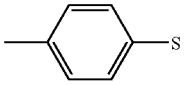 | 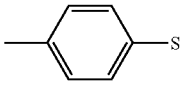 | — | — |
| III-6 | 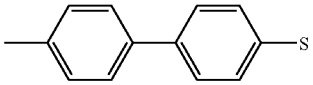 | 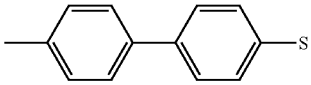 | — | — |
| III-7 | 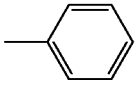 | 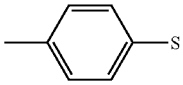 | 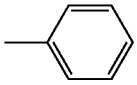 | 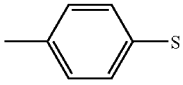 |
| III-8 | 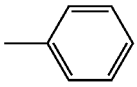 | 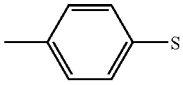 | 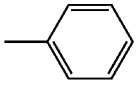 | 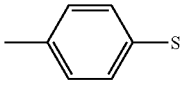 |
| III-9 | 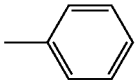 | 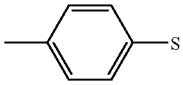 | 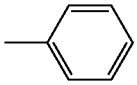 | 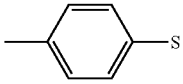 |
| III-10 | 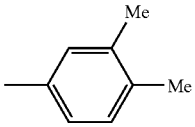 | 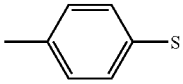 | 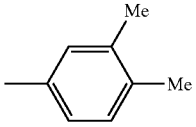 | 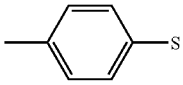 |
| No. | $Ar^5$ | k | S |
|---|---|---|---|
| III-1 | 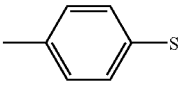 | 0 | —$(CH_2)_2$—COO—$(CH_2)_3$—Si(OiPr)$_3$ |
| III-2 | 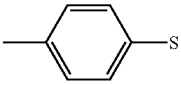 | 0 | —$(CH_2)_2$—COO—$(CH_2)_3$—Si(OiPr)$_2$Me |
| III-3 | 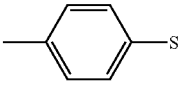 | 0 | —$(CH_2)_2$—COO—$(CH_2)_3$—Si(OiPr)Me$_2$ |
| III-4 | 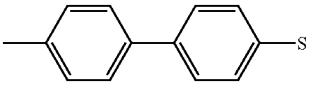 | 0 | —COO—$(CH_2)_3$—Si(OiPr)$_3$ |

TABLE 1-continued
| | | | |
|---|---|---|---|
| III-5 | 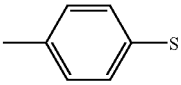 | 0 | —$(CH_2)_2$—COO—$(CH_2)_3$—Si(OiPr)$_3$ |
| III-6 | 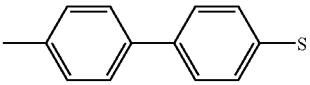 | 0 | —COO—$(CH_2)_3$—Si(OiPr)$_3$ |
| III-7 | 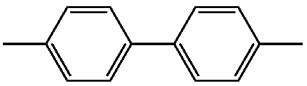 | 1 | —$(CH_2)_4$—Si(OEt)$_3$ |
| III-8 | 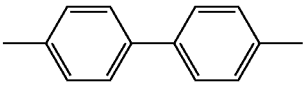 | 1 | —$(CH_2)_4$—Si(OiPr)$_3$ |
| III-9 | 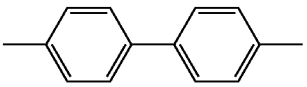 | 1 | —CH═CH—$(CH_2)_2$—Si(OiPr)$_3$ |
| III-10 | 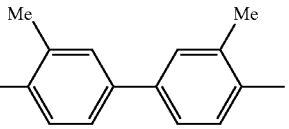 | 1 | —$(CH_2)_4$—Si(OMe)$_3$ |
TABLE 2
| No. | $Ar^1$ | $Ar^2$ | $Ar^3$ | $Ar^4$ |
|---|---|---|---|---|
| III-11 | 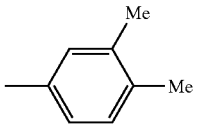 | 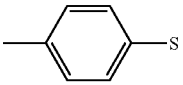 | 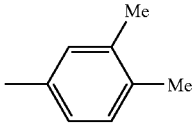 | 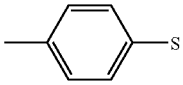 |
| III-12 | 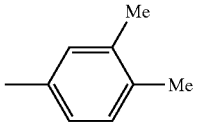 | 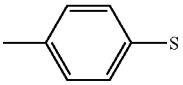 | 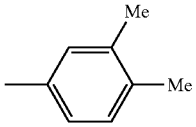 | 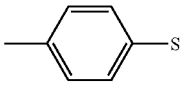 |
| III-13 | 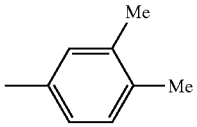 | 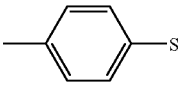 | 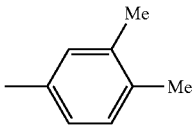 | 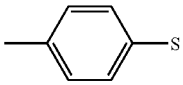 |
| III-14 | 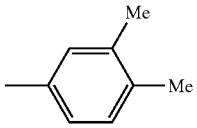 | 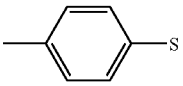 | 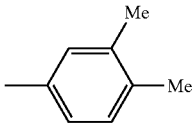 | 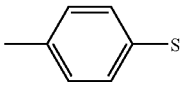 |
| III-15 | 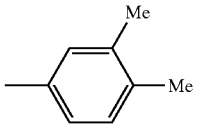 | 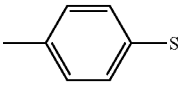 | 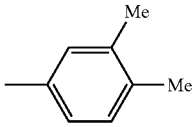 | 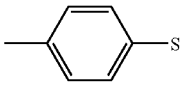 |
| III-16 | 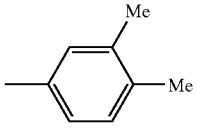 | 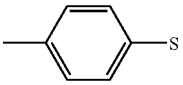 | 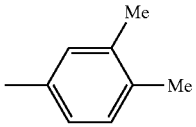 | 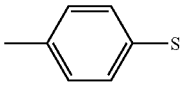 |

TABLE 2-continued
| | | | | |
|---|---|---|---|---|
| III-17 | 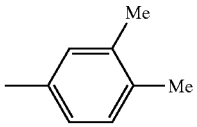 | 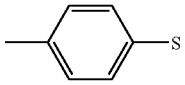 | 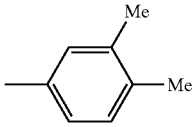 | 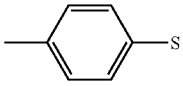 |
| III-18 | 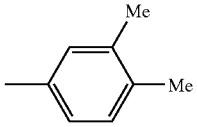 | 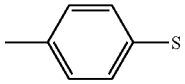 | 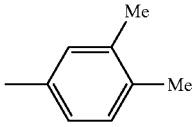 | 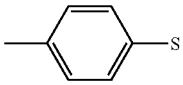 |
| III-19 | 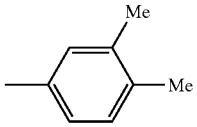 | 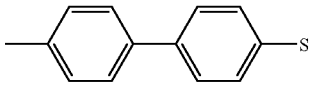 | 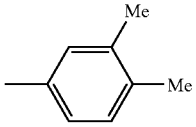 | 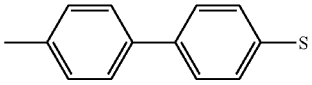 |
| III-20 | 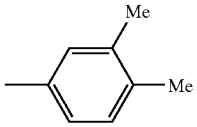 | 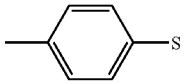 | 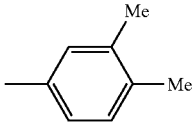 | 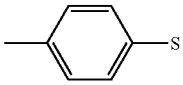 |
| No. | $Ar^5$ | k | S |
|---|---|---|---|
| III-11 | 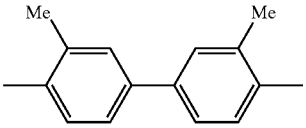 | 1 | —$(CH_2)_4$—Si(OiPr)$_3$ |
| III-12 | 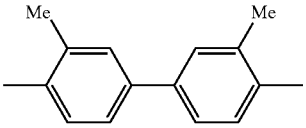 | 1 | —CH═CH—$(CH_2)_2$—Si(OiPr)$_3$ |
| III-13 | 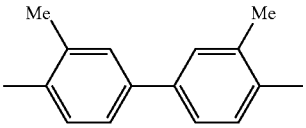 | 1 | —CH═N—$(CH_2)_3$—Si(OiPr)$_3$ |
| III-14 | 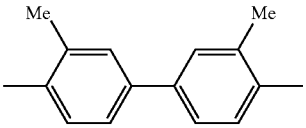 | 1 | —O—$(CH_2)_3$—Si(OiPr)$_3$ |
| III-15 | 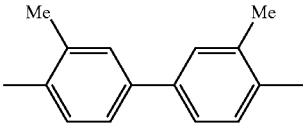 | 1 | —COO—$(CH_2)_3$—Si(OiPr)$_3$ |
| III-16 | 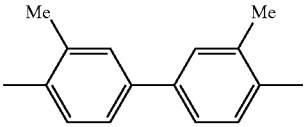 | 1 | —$(CH_2)_2$—COO—$(CH_2)_3$—Si(OiPr)$_3$ |
| III-17 | 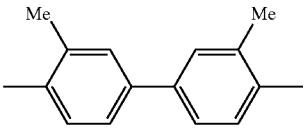 | 1 | —$(CH_2)_2$—COO—$(CH_2)_3$—Si(OiPr)$_2$Me |

TABLE 2-continued
| | | | |
|---|---|---|---|
| III-18 | 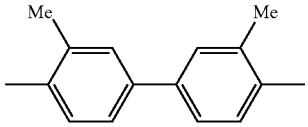 | 1 | —$(CH_2)_2$—COO—$(CH_2)_3$—Si(OiPr)$Me_2$ |
| III-19 | 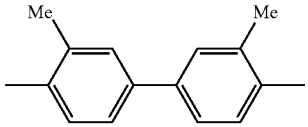 | 1 | —COO—$(CH_2)_3$—Si$(OiPr)_3$ |
| III-20 | 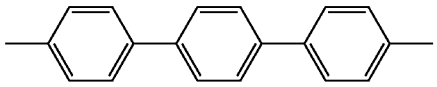 | 1 | —$(CH_2)_4$—Si$(OiPr)_3$ |
TABLE 3
| No. | $Ar^1$ | $Ar^2$ | $Ar^3$ | $Ar^4$ |
|---|---|---|---|---|
| III-21 | 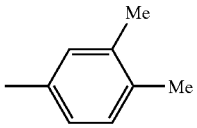 | 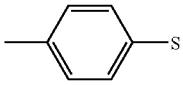 | 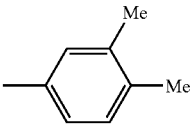 | 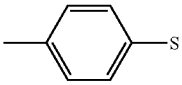 |
| III-22 | 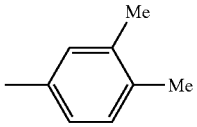 | 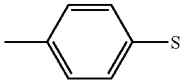 | 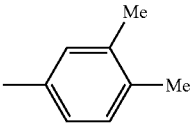 | 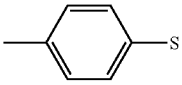 |
| III-23 | 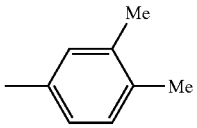 | 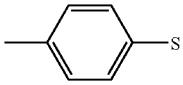 | 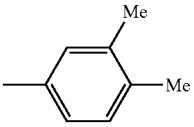 | 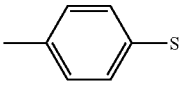 |
| III-24 | 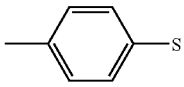 | 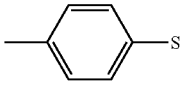 | 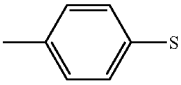 | 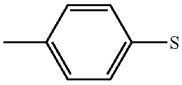 |
| III-25 | 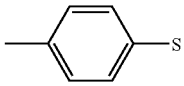 | 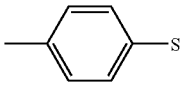 | 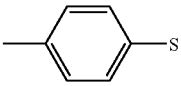 | 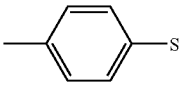 |
| III-26 | 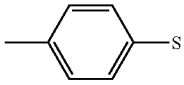 | 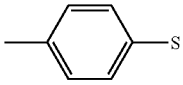 | 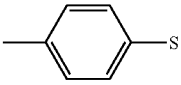 | 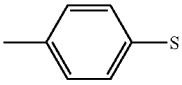 |
| III-27 | 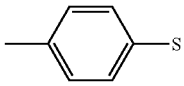 | 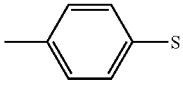 | 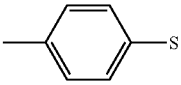 | 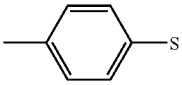 |
| III-28 | 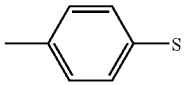 | 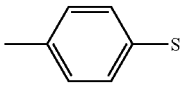 | 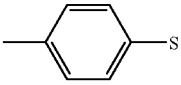 | 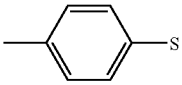 |
| III-29 | 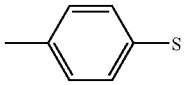 | 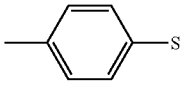 | 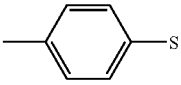 | 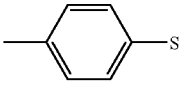 |

TABLE 3-continued
| | | | | |
|---|---|---|---|---|
| III-30 | 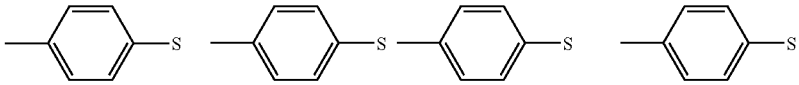 | | | |
| No. | $Ar^5$ | k | S | |
| III-21 | 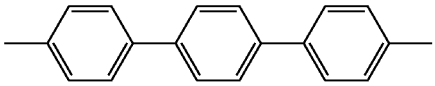 | 1 | —CH═CH—$(CH_2)_2$—Si(OiPr)$_3$ | |
| III-22 | 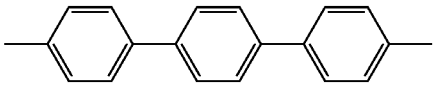 | 1 | —$(CH_2)_2$—COO—$(CH_2)_3$—Si(OiPr)$_3$ | |
| III-23 | 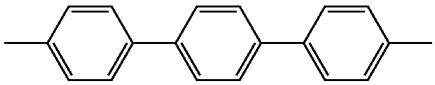 | 1 | —$(CH_2)_2$—COO—$(CH_2)_3$—Si(OiPr)$_2$Me | |
| III-24 | 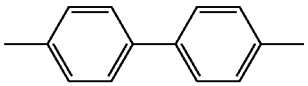 | 1 | —COO—$(CH_2)_3$—Si(OiPr)$_3$ | |
| III-25 | 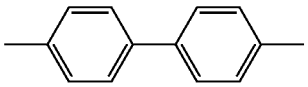 | 1 | —$(CH_2)_2$—COO—$(CH_2)_3$—Si(OiPr)$_3$ | |
| III-26 | 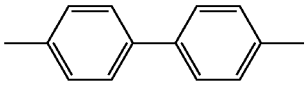 | 1 | —$(CH_2)_2$—COO—$(CH_2)_3$—Si(OiPr)$_2$Me | |
| III-27 | 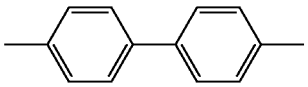 | 1 | —$(CH_2)_2$—COO—$(CH_2)_3$—Si(OiPr)Me$_2$ | |
| III-28 | 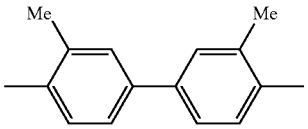 | 1 | —COO—$(CH_2)_3$—Si(OiPr)$_3$ | |
| III-29 | 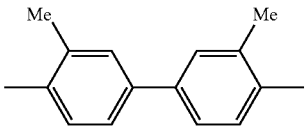 | 1 | —$(CH_2)_2$—COO—$(CH_2)_3$—Si(OiPr)$_3$ | |
| III-30 | 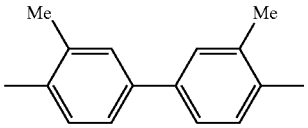 | 1 | —$(CH_2)_2$—COO—$(CH_2)_3$—Si(OiPr)$_2$Me | |
TABLE 4
| No. | $Ar^1$ | $Ar^2$ | $Ar^3$ | $Ar^4$ |
|---|---|---|---|---|
| III-31 | 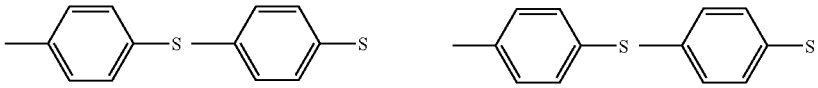 | | | |
| III-32 | 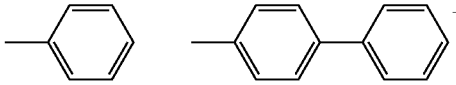 | | — | — |

TABLE 4-continued

| | | | | |
|---|---|---|---|---|
| III-33 | | | — | — |
| III-34 | | | — | — |
| III-35 | | | — | — |
| III-36 | | | — | — |
| III-37 | | | — | — |
| III-38 | | | — | — |
| III-39 | | | — | — |
| III-40 | | | — | — |

| No. | $Ar^5$ | k | S |
|---|---|---|---|
| III-31 | Me Me | 1 | —$(CH_2)_2$—COO—$(CH_2)_3$—Si(OiPr)$Me_2$ |
| III-32 | S | 0 | —$(CH_2)_4$—Si$(OiPr)_3$ |
| III-33 | S | 0 | —$(CH_2)_4$—Si$(OEt)_3$ |
| III-34 | S | 0 | —$(CH_2)_4$—Si$(OMe)_3$ |
| III-35 | S | 0 | —$(CH_2)_4$—SiMe$(OMe)_2$ |
| III-36 | S | 0 | —$(CH_2)_4$—SiMe$(OiPr)_2$ |
| III-37 | S | 0 | —CH═CH—$(CH_2)_2$—Si$(OiPr)_3$ |

TABLE 4-continued
| | | | |
|---|---|---|---|
| III-38 | 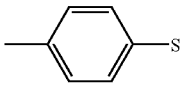 | 0 | —CH═CH—$(CH_2)_2$—Si(OMe)$_3$ |
| III-39 | 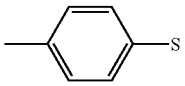 | 0 | —CH═N—$(CH_2)_3$—Si(OiMe)$_3$ |
| III-40 | 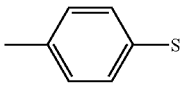 | 0 | —CH═N—$(CH_2)_3$—Si(OiPr)$_3$ |
TABLE 5
| No. | $Ar^1$ | $Ar^2$ | $Ar^3$ | $Ar^4$ |
|---|---|---|---|---|
| III-41 | 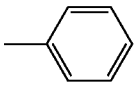 | 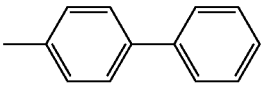 | — | — |
| III-42 | 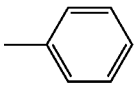 | 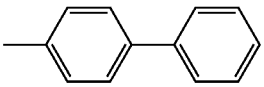 | — | — |
| III-43 | 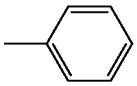 | 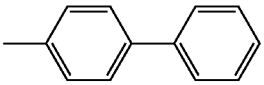 | — | — |
| III-44 | 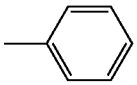 | 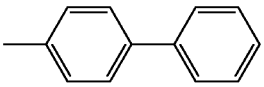 | — | — |
| III-45 | 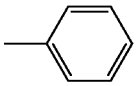 | 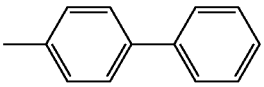 | — | — |
| III-46 | 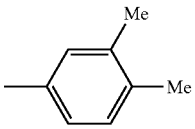 | 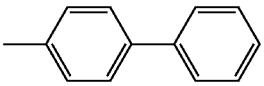 | — | — |
| III-47 | 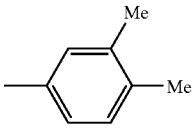 | 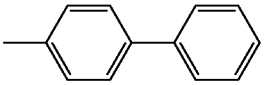 | — | — |
| III-48 | 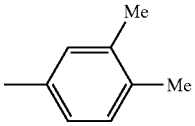 | 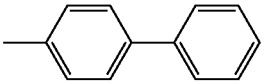 | — | — |
| III-49 | 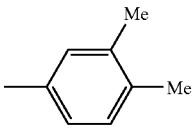 | 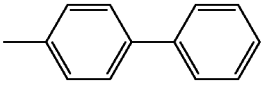 | — | — |

TABLE 5-continued
| | | | | |
|---|---|---|---|---|
| III-50 | 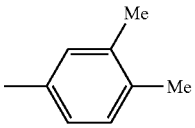 | 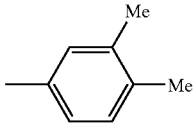 | — | — |
| No. | $Ar^5$ | k | S |
|---|---|---|---|
| III-41 | 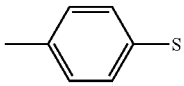 | 0 | —O—$(CH_2)_3$—Si(OiPr)$_3$ |
| III-42 | 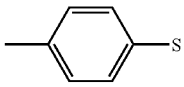 | 0 | —COO—$(CH_2)_3$—Si(OiPr)$_3$ |
| III-43 | 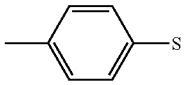 | 0 | —$(CH_2)_2$—COO—$(CH_2)_3$—Si(OiPr)$_3$ |
| III-44 | 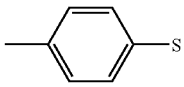 | 0 | —$(CH_2)_2$—COO—$(CH_2)_3$—Si(OiPr)$_2$Me |
| III-45 | 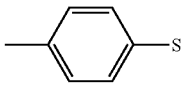 | 0 | —$(CH_2)_2$—COO—$(CH_2)_3$—Si(OiPr)Me$_2$ |
| III-46 | 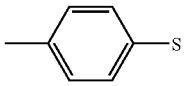 | 0 | —$(CH_2)_4$—Si(OMe)$_3$ |
| III-47 | 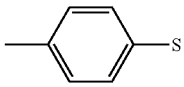 | 0 | —$(CH_2)_2$—COO—$(CH_2)_3$—Si(OiPr)$_3$ |
| III-48 | 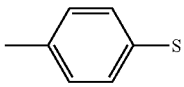 | 0 | —$(CH_2)_2$—COO—$(CH_2)_3$—SiMe(OiPr)$_2$ |
| III-49 | 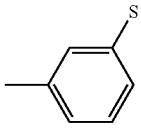 | 0 | —O—$(CH_2)_3$—Si(OiPr)$_3$ |
| III-50 | 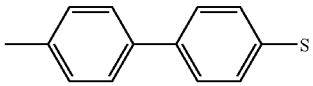 | 0 | —COO—$(CH_2)_3$—Si(OiPr)$_3$ |

TABLE 6
| No. | $Ar^1$ | $Ar^2$ | $Ar^3$ | $Ar^4$ | $Ar^5$ | k | S |
|---|---|---|---|---|---|---|---|
| III-51 | 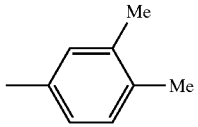 | 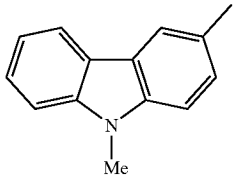 | — | — | 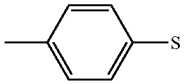 | 0 | $—(CH_2)_4—Si(OiPr)_3$ |
| III-52 | 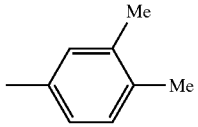 | 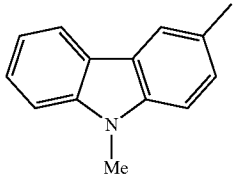 | — | — | 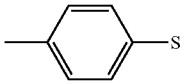 | 0 | $—(CH_2)_2—COO—(CH_2)_3—Si(OiPr)_3$ |
| III-53 | 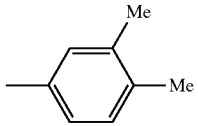 | 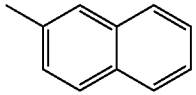 | — | — | 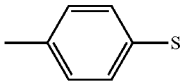 | 0 | $—(CH_2)_4—Si(OiPr)_3$ |
| III-54 | 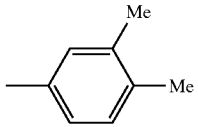 | 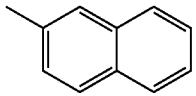 | — | — | 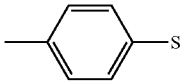 | 0 | $—(CH_2)_2—COO—(CH_2)_3—Si(OiPr)_3$ |
| III-55 | 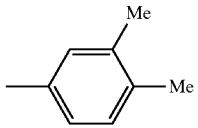 | 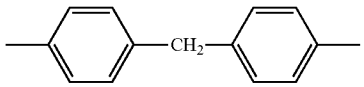 | — | — | 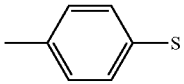 | 0 | $—(CH_2)_4—Si(OiPr)_3$ |

TABLE 6-continued
| No. | $Ar^1$ | $Ar^2$ | $Ar^3$ | $Ar^4$ | $Ar^5$ | k | S |
|---|---|---|---|---|---|---|---|
| III-56 | 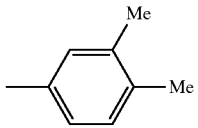 | 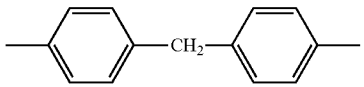 | — | — | 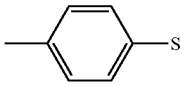 | 0 | —$(CH_2)_2$—COO—$(CH_2)_3$—Si(OiPr)$_3$ |
| III-57 | 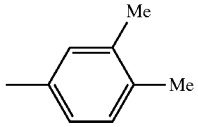 | 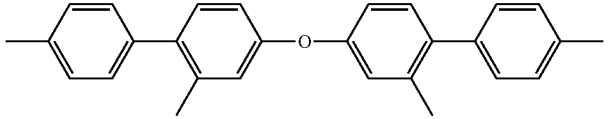 | — | — | 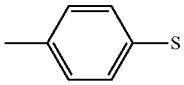 | 0 | —$(CH_2)_4$—Si(OiPr)$_3$ |
| III-58 | 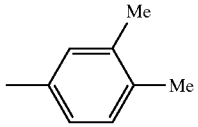 | 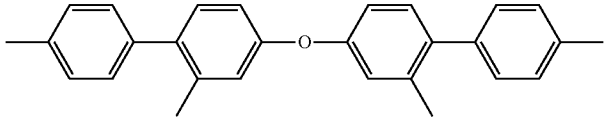 | — | — | 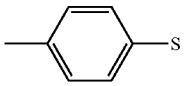 | 0 | —$(CH_2)_2$—COO—$(CH_2)_3$—Si(OiPr)$_3$ |
| III-59 | 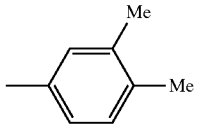 | 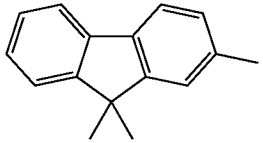 | — | — | 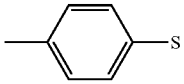 | 0 | —$(CH_2)_2$—COO—$(CH_2)_3$—Si(OiPr)$_3$ |

TABLE 7
| No. | $Ar^1$ | $Ar^2$ | $Ar^3$ | $Ar^4$ |
|---|---|---|---|---|
| III-60 | 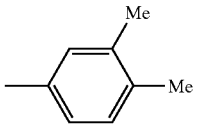 | 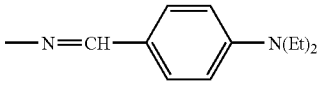 | — | — |
| III-61 | 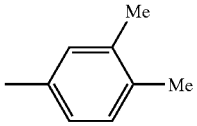 | 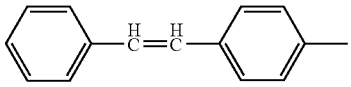 | — | — |
| No. | $Ar^5$ | k | S |
|---|---|---|---|
| III-60 | 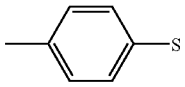 | 0 | $—(CH_2)_2—COO—(CH_2)_3—Si(OiPr)_3$ |
| III-61 | 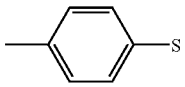 | 0 | $—(CH_2)_2—COO—(CH_2)_3—Si(OiPr)_3$ |
While specific examples of the compounds represented by Formula (II) include compounds represented by the following formulae (II)-1 to (II)-26, the invention is not limited thereto.
(II)-1
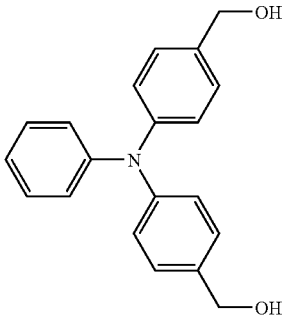
(II)-2
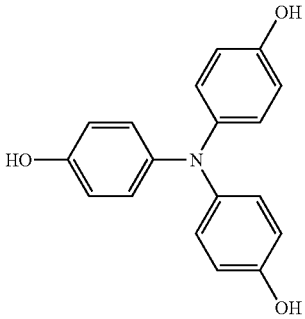
-continued
(II)-3
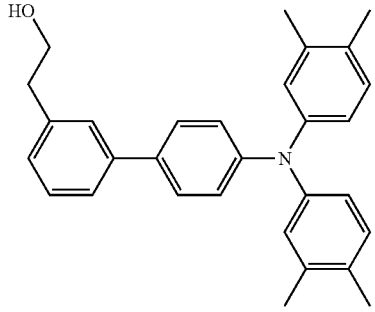
(II)-4
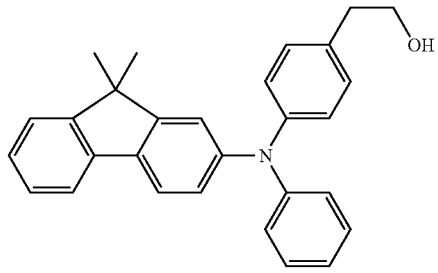
(II)-5
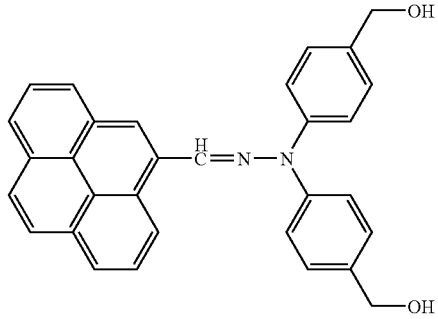

-continued
(II)-6
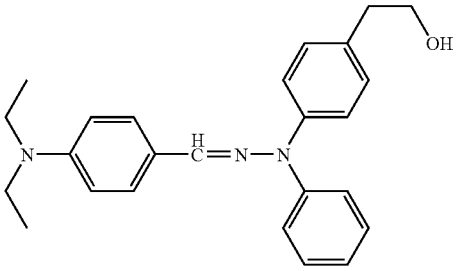
(II)-7
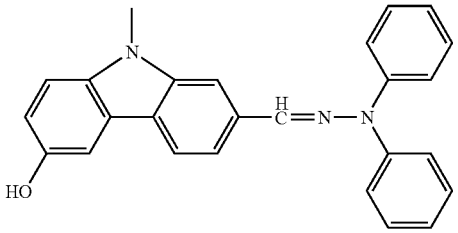
(II)-8
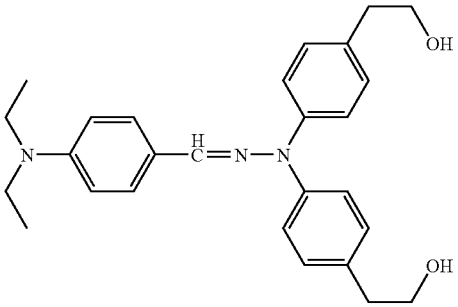
(II)-9
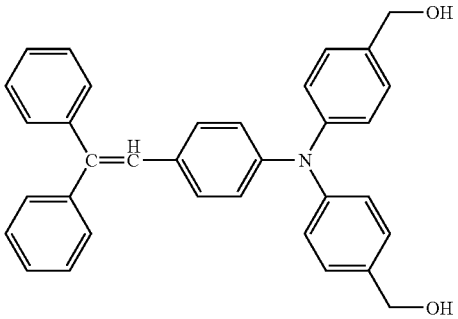
(II)-10
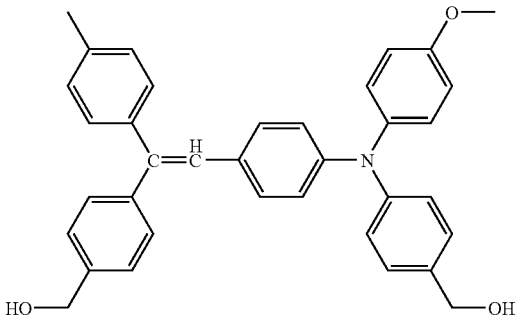
-continued
(II)-11
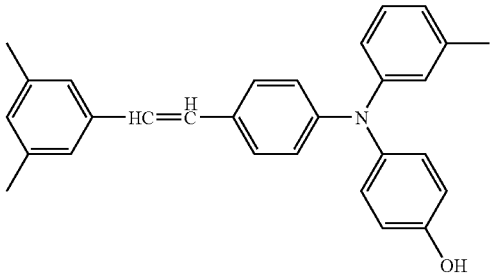
(II)-12
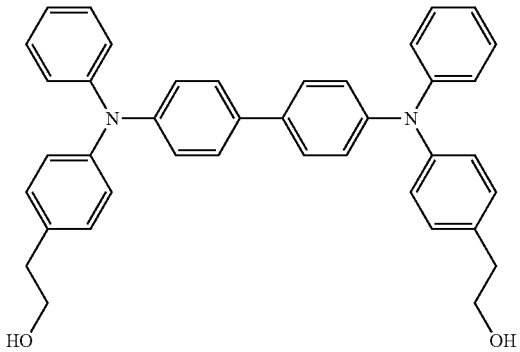
(II)-13
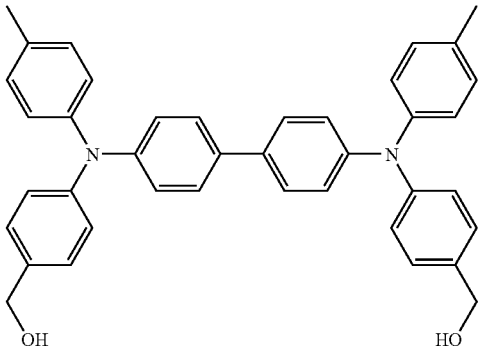
(II)-14
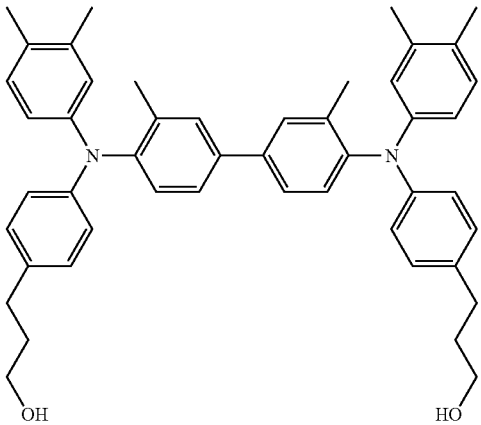

-continued
(II)-15
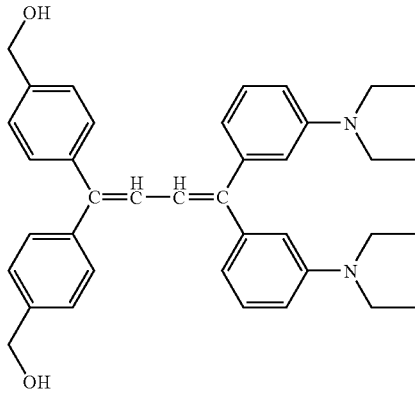
(II)-16
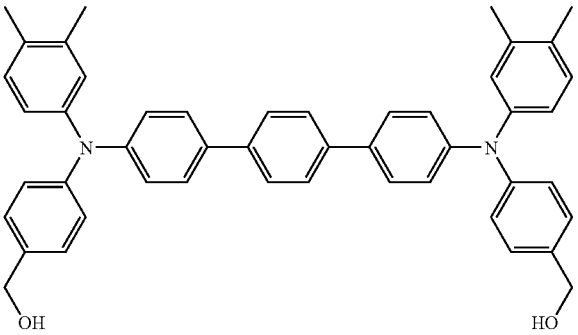
(II)-17
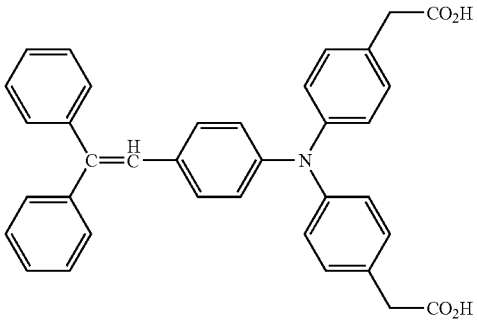
(II)-18
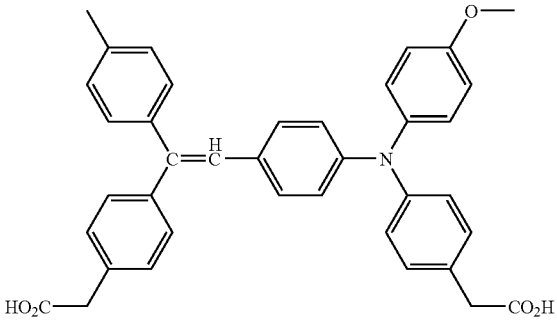
-continued
(II)-19
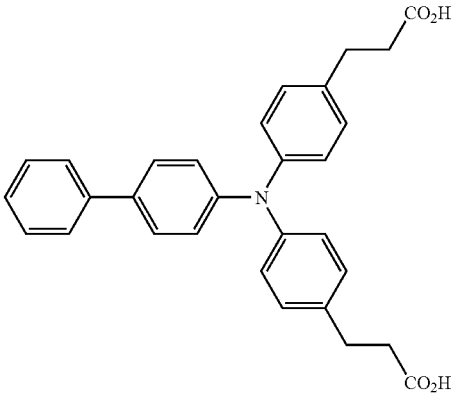
(II)-20
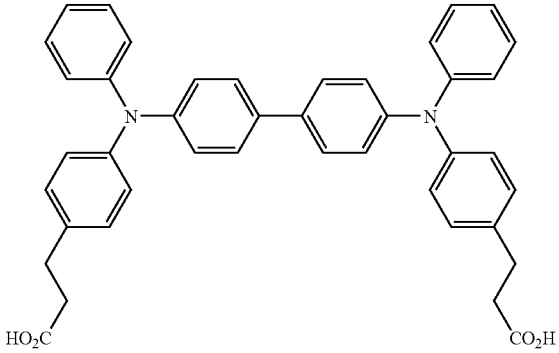
(II)-21
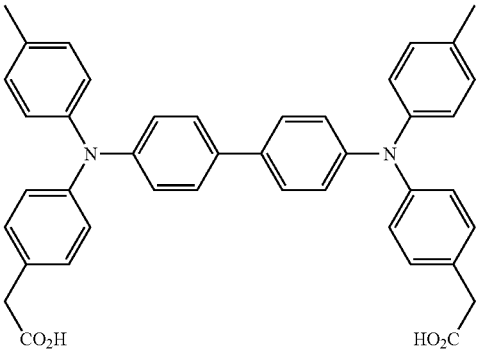
(II)-22
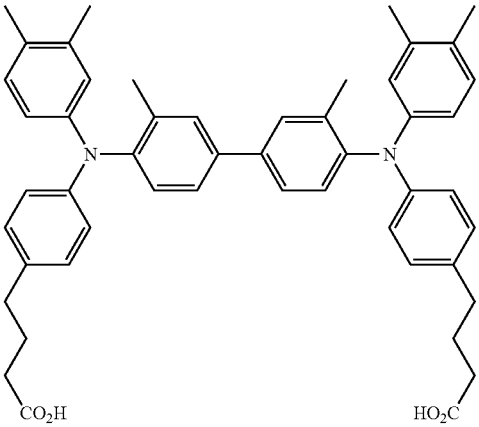

-continued (II)-23

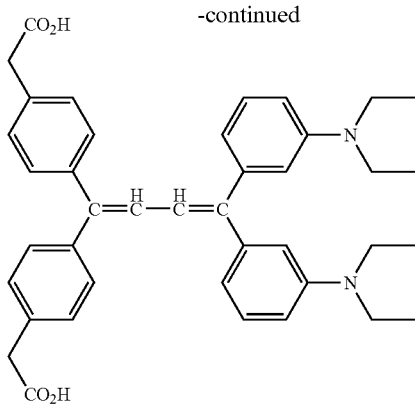

(II)-24

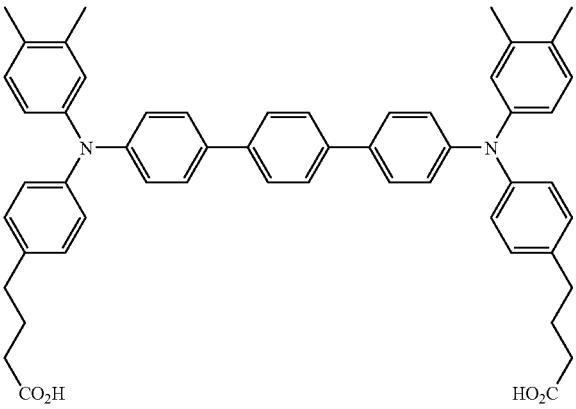

(II)-25

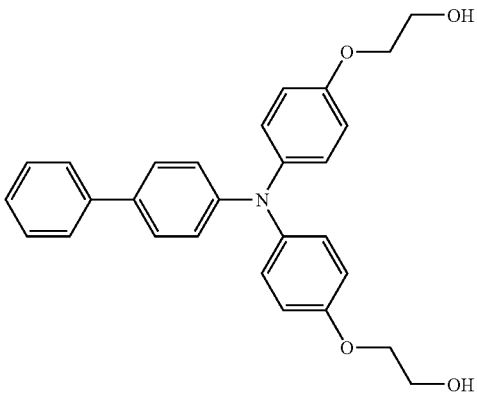

(II)-26

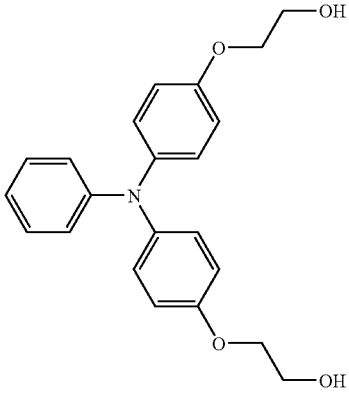

To control various physical properties such as strength or film resistance, a compound represented by the following Formula (IV) may be further added to the protective layer.

$$Si(R^2)_{(4-c)}Q_c \quad \text{(IV)}$$

In Formula (IV), $R^2$ represents a hydrogen atom, an alkyl group or a substituted or unsubstituted aryl group; Q represents a hydrolyzable group; and c is an integer of 1 to 4.

Specific examples of the compounds represented by Formula (VI) include the following silane coupling agents: Tetrafunctional alkoxy silane (c=4) such as tetramethoxy silane and tetraethoxy silane; trifunctional alkoxy silane (c=3) such as methyl trimethoxy silane, methyl triethoxy silane, ethyl trimethoxy silane, methyl trimethoxy ethoxy silane, vinyl trimethoxy silane, vinyl triethoxy silane, phenyl trimethoxy silane, γ-glycidoxy propyl methyl diethoxy silane, γ-glycidoxy propyl trimethoxy silane, γ-glycidoxy propyl trimethoxy silane, γ-aminopropyl triethoxy silane, γ-aminopropyl trimethoxy silane, γ-aminopropyl methyl dimethoxy silane, N-β(aminoethyl) γ-aminopropyl triethoxy silane, (tridecafluoro-1,1,2,2-tetrahydrooctyl) triethoxy silane, (3,3,3-trifluoropropyl)trimethoxy silane, 3-(heptafluoroisopropoxy)propyl triethoxy silane, 1H,1H,2H,2H-perfluoroalkyl triethoxy silane, 1H,1H,2H,2H-perfluorodecyl triethoxy silane and 1H,1H,2H,2H-perfluorooctyl triethoxy silane; bifunctional alkoxy silane (c=2) such as dimethyl dimethoxy silane, diphenyl dimethoxy silane and methyl phenyl dimethoxy silane; and monofunctional alkoxy silane (c=1) such as trimethyl methoxy silane. For improving film strength, tri- and tetrafunctional alkoxy silane is preferable, and for improving flexibility and film formability, di-functional alkoxy silane and monofunctional alkoxy silane are preferable.

Silicone hard coating agents prepared mainly from these coupling agents can also be used. Examples of commercially-available hard coating agent include KP-85, X-40-9740, X-40-2239 (all trade names, manufactured by Shin-Etsu Chemical Co., Ltd.) and AY42-440, AY42-441 and AY49-208 ((all trade names, manufactured by Dow Coming Toray Co., Ltd.).

To increase strength, it is also preferable to use a compound having two or more silicon atoms represented by the following Formula (V):

$$B—(Si(R^2)_{(3-a)}Q_a)_2 \quad \text{(V)}$$

In Formula (V), B represents a divalent organic group, $R^2$ represents hydrogen, an alkyl group or a substituted or unsubstituted aryl group, Q represents a hydrolyzable group, and a is an integer of 1 to 3.

Specifically, preferable examples include materials shown in Table 8 below, while the invention is not limited thereto.

TABLE 8

| No. | Structural Formula |
|---|---|
| V-1 | $(MeO)_3Si—(CH_2)_2—Si(OMe)_3$ |
| V-2 | $(MeO)_2MeSi—(CH_2)_2—SiMe(OMe)_2$ |
| V-3 | $(MeO)_2MeSi—(CH_2)_6—SiMe(OMe)_2$ |
| V-4 | $(MeO)_3Si—(CH_2)_6—Si(OMe)_3$ |
| V-5 | $(EtO)_3Si—(CH_2)_6—Si(OEt)_3$ |
| V-6 | $(MeO)_2MeSi—(CH_2)_{10}—SiMe(OMe)_2$ |
| V-7 | $(MeO)_3Si—(CH_2)_3—NH—(CH_2)_3—Si(OMe)_3$ |
| V-8 | $(MeO)_3Si—(CH_2)_3—NH—(CH_2)_2—NH—(CH_2)_3—Si(OMe)_3$ |
| V-9 | 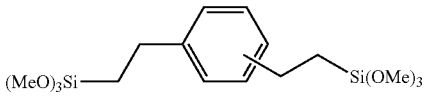 |
| V-10 | 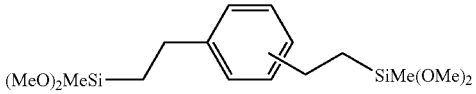 |
| V-11 | 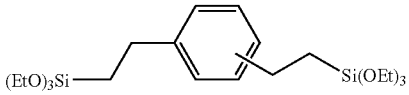 |
| V-12 | 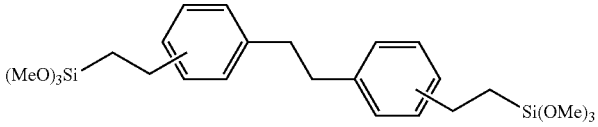 |
| V-13 | 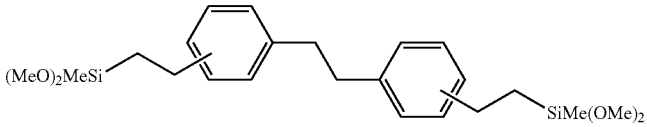 |
| V-14 | 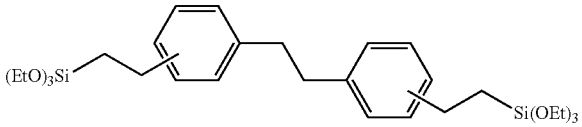 |
| V-15 | $(MeO)_3SiC_3H_6—O—CH_2CH\{—O—C_3H_6Si(OMe)_3\}—CH_2\{—O—C_3H_6Si(OMe)_3\}$ |
| V-16 | $(MeO)_3SiC_2H_4—SiMe_2—O—SiMe_2—O—SiMe_2—C_2H_4Si(OMe)_3$ |

For control of film characteristics, prolongation of liquid life, etc., a resin soluble in an alcohol solvent or a ketone solvent can be added. Such resin includes polyvinyl butyral resin, polyvinyl formal resin, polyvinyl acetal resin such as partially acetalated polyvinyl acetal resin having a part of butyral modified with formal, acetoacetal or the like (for example, S-LEC B and S-LEC K (both trade names, manufactured by Sekisui Chemical Co., Ltd.)), polyamide resin, cellulose resin, phenol resin etc. Particularly, polyvinyl acetal resin is preferable from the viewpoint of electric characteristics.

For the purpose of discharging gas resistance, mechanical strength, scratch resistance, particle dispersibility, viscosity control, torque reduction, abrasion control and prolongation of pot life, etc., various resins can be added. A resin soluble in alcohol is preferably added particularly to the siloxane resin.

Examples of the resin soluble in an alcohol solvent include polyvinyl butyral resin, polyvinyl formal resin, polyvinyl acetal resin such as partially acetalated polyvinyl acetal resin having a part of butyral modified with formal, acetoacetal or the like (for example, S-LEC B and S-LEC K (both trade names, manufactured by Sekisui Chemical Co., Ltd.)), polyamide resin, cellulose resin, phenol resin and the like. Particularly, polyvinyl acetal resin is preferable from the viewpoint of electric characteristics.

The molecular weight of the resin is preferably in a range of about 2,000 to 100,000, more preferably in a range of about 5,000 to 50,000. When the molecular weight is less than about 2,000, the desired effect cannot be achieved, while when the molecular weigh is greater than about 100,000, the solubility is decreased, the amount of the resin added is limited, and coating defects are caused upon coating. The amount of the resin added is preferably about 1 to 40% by mass, more preferably about 1 to 30% by mass, most preferably about 5 to 20% by mass. When the amount is less than about 1% by mass, it is difficult to obtain the desired effect, while when the amount is greater than about 40% by mass, image blurring may easily occur under high temperature and high humidity. These resins may be used singly or as a mixture thereof.

For prolongation of pot life, control of film characteristics, etc., a cyclic compound having a repeating structural unit represented by the following Formula (VI), or a modified compound thereof, can also be included.

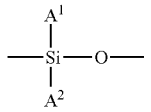

(VI)

In Formula (VI), $A^1$ and $A^2$ independently represent a monovalent organic group.

The cyclic compound having a repeating structural unit represented by Formula (VI) can include commercial cyclic siloxane. Specific examples thereof include cyclic siloxane, for example cyclic dimethyl cyclosiloxane such as hexamethyl cyclotrisiloxane, octamethyl cyclotetrasiloxane, decamethyl cyclopentasiloane and dodecamethyl cyclohexasiloxane, cyclic methyl phenyl cyclosiloxane such as 1,3,5-trimethyl-1,3,5-triphenyl cyclotrisiloxane, 1,3,5,7-tetramethyl-1,3,5,7-tetraphenyl cyclotetrasiloxane, and 1,3,5,7,9-pentamethyl-1,3,5,7,9-pentaphenyl cyclopentasiloxane, cyclic phenyl cyclosiloxane such as hexaphenyl cyclotrisiloxane, fluorine-containing cyclosiloxane such as 3-(3,3,3-trifluoropropyl) methyl cyclotrisiloxane, a methyl hydroxy siloxane mixture, hydrosilyl group-containing cyclosiloxane such as pentamethyl cyclopentasiloxane and phenyl hydrocyclosiloxane, and vinyl group-containing cyclosiloxane such as pentavinyl pentamethyl cyclopentasiloxane. These cyclic siloxane compounds can be used singly or as a mixture thereof.

To improve the stain resistance and lubricating properties of the surface of the photoreceptor, various fine particles can also be added. Such fine particles can be used singly or two or more thereof can be used in combination. Examples of the fine particles include silicon-containing particles. The silicon-containing fine particles are particles containing silicon as a constituent element, and specific examples thereof include colloidal silica and silicone fine particles. The colloidal silica used as the silicon-containing fine particles is selected from those which have an average particle diameter of about 1 to 100 nm, preferably about 10 to 30 nm, and are dispersed in acidic or alkaline aqueous liquids or an organic solvent such as alcohol, ketone or ester, and generally commercially available products can be used therefor. While the solids content of colloidal silica in the outermost surface is not limited, it is generally in a range of about 0.1 to 50% by mass, and preferably about 0.1 to 30% by mass relative to a mass of total solid content of outrmost surface layer of the photoreceptor, from the viewpoints of film formability, electric characteristics and strength.

The silicone fine particles used as the silicon-containing fine particles are selected from spherical silicone resin particles, silicone rubber particles or silicone surface-treated silica particles having an average particle diameter of about 1 to 500 nm, preferably about 10 to 100 nm, and generally commercially available products can be used therefor. The silicone fine particles are chemically inert particles having a small diameter and are excellent in dispersibility in resin. Since the content of the silicone fine particles required for achieving sufficient characteristics is low, the surface state of the photoreceptor can be improved without inhibiting crosslinking reaction. That is, the silicone fine particles can be uniformly incorporated into the rigid crosslinked structure and can simultaneously improve lubricating properties and water repellence of the surface of the photoreceptor so as to maintain excellent abrasion resistance and stain resistance for a long time. The content of the silicone fine particles in the outermost layer of the photoreceptor in the invention is in a range of about 0.1 to 30% by mass, preferably in a range of about 0.5 to 10% by mass, based on the total solids content of the outermost layer.

Other particles can include fluorine-containing particles such as ethylene tetrafluoride, ethylene trifluoride, propylene hexafluoride, vinyl fluoride, vinylidene fluoride etc., particles consisting of a resin produced by copolymerizing the fluorine resin with a monomer having a hydroxyl group, for example particles shown in "Preliminary Collection of Eighth Polymer Material Forum Lectures, p. 89" (in Japanese), and semi-electroconductive metal oxides such as $ZnO—Al_2O_3$, $SnO_2—Sb_2O_3$, $In_2O_3—SnO_2$, $ZnO—TiO_2$, $ZnO—TiO_2$, $MgO—Al_2O_3$, $FeO—TiO_2$, $SnO_2$, $In_2O_3$, ZnO and MgO.

For the same purpose, oil such as silicone oil can also be added. Examples of the silicone oil include silicone oils such as dimethyl polysiloxane, diphenyl polysiloxane or phenyl methyl siloxane, and reactive silicone oils such as amino-modified polysiloxane, epoxy-modified polysiloxane, carboxyl-modified polysiloxane, carbinol-modified polysiloxane, methacryl-modified polysiloxane, mercapto-modified polysiloxane or phenol-modified polysiloxane.

The ratio of exposure of the particles to the surface of the protective layer (namely, a ratio of the surface area coverage of the fine particles exposed on the surface of the protective layer with respect to the total surface area of the protective layer) is preferably 40% or less. When the degree of exposure is higher than the range, the influence of the particles themselves is increased, and image deletion due to low resistance easily occurs. In the preferable range, the degree of exposure is more preferably about 30% by mass or less since the particles exposed to the surface are effectively refreshed with a cleaning member, and depression of filming of toner component on the surface of the photoreceptor, removal of discharge products, and reduction in abrasion of a cleaning member due to torque reduction are maintained for a long period of time.

Additives such as a plasticizer, a surface modifier, an antioxidant or a photo-deterioration inhibitor can also be used. Examples of the plasticizer include biphenyl, biphenyl chloride, terphenyl, dibutyl phthalate, diethylene glycol phthalate, dioctyl phthalate, triphenyl phosphoric acid, methylnaphthalene, benzophenone, chlorinated paraffin, polypropylene, polystyrene and various fluorohydrocarbons.

An antioxidant having a hindered phenol, hindered amine, thioether or phosphite partial structure can be added to the protective layer, and is effective in improving potential stability and image qualities when the environment is changed. Examples of the antioxidant includes: hindered phenol antioxidants such as: "SUMILIZER BHT-R", "SUMILIZER MDP-S", "SUMILIZER BBM-S", "SUMILIZER WX-R", "SUMILIZER NW", "SUMILIZER BP-76", "SUMILIZER BP-101", "SUMILIZER GA-80", "SUMILIZER GM" or "SUMILIZER GS", which are all trade names and manufactured by Sumitomo Chemical Co., Ltd.; "IRGANOX1010", "IRGANOX1035", "IRGANOX1076", "IRGANOX1098", "IRGANOX1135", "IRGANOX1141", "IRGANOX1222", "IRGANOX1330", "IRGANOX1425WL", "IRGANOX1520L", "IRGANOX245", "IRGANOX259", "IRGANOX3114", "IRGANOX3790", "IRGANOX5057" or "IRGANOX565", which are all trade names and manufactured by Ciba Speciality Chemicals; "ADEKASTAB AO-20", "ADEKASTAB AO-30", "ADEKASTAB AO-40", "ADEKASTAB AO-50", "ADEKASTAB AO-60", "ADEKASTAB AO-70", "ADEKASTAB AO-80" and "ADEKASTAB AO-330", which are all trade names and manufactured by Asahi Denka Co., Ltd., hindered amine antioxidants such as: "SANOL LS2626", "SANOL LS765", "SANOL LS770", "SANOL LS744", "TINUBIN 144", "TINUBIN 622LD", "MARK LA57", "MARK LA67", "MARK LA62", "MARK LA68", "MARK LA63" or "SUMILIZER TPS", thioether antioxidants such as "SUMILIZER TP-D", and phosphite antioxidants such as: "MARK 2112", "MARK PEP.8", "MARK PEP-24G", "MARK PEP-36", "MARK 329K" or "MARK HP 10", and particularly preferable examples among these include hindered phenol and hindered amine antioxidants. These may be modified with substituent groups capable of crosslinking with a material forming a crosslinked film, and examples of the substituent groups include an alkoxysilyl group.

A catalyst is preferably added or used in a coating solution used in forming the protective layer or at the time of preparing the coating solution. Examples of the catalyst used include inorganic acids such as hydrochloric acid, acetic acid, phosphoric acid and sulfuric acid, organic acids such as formic acid, propionic acid, oxalic acid, p-toluenesulfonic acid, benzoic acid, phthalic acid and maleic acid, and alkali catalysts such as potassium hydroxide, sodium hydroxide, calcium hydroxide, ammonia and triethylamine, and the following insoluble solid catalysts may be used.

Examples of the insoluble solid catalysts include cation exchange resins such as AMBERLITE 15, AMBERLITE 200C and AMBERLYST 15E (manufactured by Rohm and Haas Company); DOW X MWC-1-H, DOW X 88 and DOW X HCR-W2 (manufactured by Dow Chemical Company); Levatit SPC-108 and Levatit SPC-118 (manufactured by Bayer AG); DIAION RCP-150H (manufactured by Mitsubishi Chemical Industries); SUMIKA ION KC-470, DUOLITE C26-C, DUOLITE C-433 and DUOLITE-464 (manufactured by Sumitomo Chemical Co., Ltd.); and NAPHION-H (manufactured by DuPont); anion exchange resins such as AMBERLITE IRA-400 and AMBERLITE IRA-45 (manufactured by Rohm and Haas Company); inorganic solids having groups containing protonic acid groups such as $Zr(O_3PCH_2CH_2SO_3H)_2$ and $Th(O_3PCH_2CH_2COOH)_2$ bound to the surface thereof; polyorganosiloxane containing protonic acid groups, such as polyorganosiloxane having sulfonic acid groups; heteropoly acids such as cobalt tungstic acid and phosphomolybdic acid; isopoly acids such as niobic acid, tantalic acid and molybdic acid; mono metal oxides such as silica gel, alumina, chromia, zirconia, CaO and MgO; composite metal oxides such as silica-alumina, silica-magnesia, silica-zirconia, and zeolite; clay minerals such as acidic clay, active clay, montmorilonite and kaolinite; metal sulfates such as $Li_2SO_4$ and $MgSO_4$; metal phosphates such as zirconia phosphate and lanthanum phosphate; metal nitrates such as $LiNO_3$ and $Mn(NO_3)_2$; inorganic solids having amino group-containing groups bound to the surface thereof, such as solids obtained by reacting aminopropyl triethoxy silane with silica gel; and polyorganosiloxane containing amino groups, such as amino-modified silicone resin.

It is preferable that a solid catalyst insoluble in a photofunctional compound, reaction products, water and solvent is used in preparing the coating solution, because the stability of the coating solution tends to be improved. The solid catalyst insoluble in the system is not particularly limited insofar as the catalyst component is insoluble to a compound represented by Formula (I), (II), (III) or (V), or is insoluble in other additives, water, solvent etc. The amount of the solid catalyst used is not particularly limited and is preferably in a range of about 0.1 to 100 parts by weight relative to 100 parts by weight of the total amount of compounds having a hydrolyzable group. As described above, the solid catalyst is insoluble in the starting compounds, reaction products and solvent, and can thus be easily removed in a usual manner after the reaction. While the reaction temperature and reaction time are selected suitably depending on the kind and amount of the starting compounds and solid catalyst used, the reaction temperature is usually in a range of about 0 to 100° C., preferably in a range of about 10 to 70° C., and more preferably in a range of about 15 to 50° C., and the reaction temperature is preferably in a range of about 10 minutes to 100 hours. When the reaction time is longer than the upper limit mentioned above, gelation tends to easily occur.

When a catalyst insoluble in the system is used in preparing the coating solution, another catalyst which can be dissolved in the system is preferably simultaneously used for the purpose of improving strength, liquid storage stability, and the like. In addition to the above-mentioned catalysts, examples of such another catalyst further include organoaluminum compounds such as aluminum triethylate, aluminum triisopropylate, aluminum tri(sec-butyrate), mono(sec-butoxy) aluminum diisopropylate, diisopropoxy aluminum(ethyl acetoacetate), aluminum tris(ethyl acetoacetate), aluminum bis(ethyl acetoacetate)monoacetyl acetonate, aluminum tris (acetyl acetonate), aluminum diisopropoxy(acetyl acetonate), aluminum isopropoxy-bis(acetyl acetonate), aluminum tris(trifluoroacetyl acetonate), aluminum tris (hexafluoroacetyl acetonate), etc.

In addition to the organoaluminum compounds, it is also possible to use organotin compounds such as dibutyltin dilaurate, dibutyltin dioctiate and dibutyltin diacetate; organotitanium compounds such as titanium tetrakis(acetyl acetonate), titanium bis(butoxy)bis(acetyl acetonate) and titanium bis (isopropoxy)bis(acetyl acetonate); and zirconium compounds such as zirconium tetrakis(acetyl acetonate), zirconium bis(butoxy)bis(acetyl acetoate) and zirconium bis (isopropoxy)bis(acetyl acetonate), but from the viewpoints of safety, low cost, and pot-life length, the organoaluminum compounds are preferably used, and particularly the aluminum chelate compounds are more preferable. While the amount of these catalysts used is not particularly limited, it is preferably in a range of about 0.1 to 20 parts by weight, more preferably in a range of about 0.3 to 10 parts by weight, relative to 100 parts by weight of the total amount of compounds having a hydrolyzable group.

When the organometallic compound is used as a catalyst, a multidentate ligand is preferably added from the viewpoints of pot life and curing efficiency. While examples of the multidentate ligand includes the following ligands and ligands derived therefrom, the invention is not limited thereto.

Specific examples of the multidentate ligand include β-diketones such as acetyl acetone, trifluoroacetyl acetone, hexafluoroacetyl acetone and dipivaloyl methyl acetone; acetoacetates such as methyl acetoacetate and ethyl acetoacetate; bipyridine and modified compounds thereof; glycine and modified compounds thereof; ethylene diamine and modified compounds thereof; 8-oxyquinoline and modified compounds thereof; salicylaldehyde and modified compounds thereof; catechol and modified compounds thereof; bidentate ligands such as 2-oxyazo compounds; diethyl triamine and modified compounds thereof; tridendate ligands such as nitrilotriacetic acid and modified compounds thereof; and hexadentate ligands such as ethylenediaminetetraacetic acid (EDTA) and modified compounds thereof. In addition to the organic ligands described above, inorganic ligands such as pyrophosphoric acid and triphosphoric acid can be mentioned. The multidentate ligand is particularly preferably a bidentate ligand, and specific examples thereof include bidentate ligands represented by Formula (VII) in addition to those described above. Among these ligands, the bidentate ligands represented by formula (VII) below are more preferable, and those of Formula (VII) wherein $R^5$ and $R^6$ are the same are particularly preferable. When $R^5$ is the same as $R^6$, the coordination strength of the ligand in the vicinity of room temperature can be increased to achieve further stabilization of the coating solution.

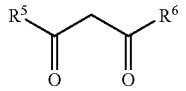

(VII)

In Formula (VII), $R^5$ and $R^6$ independently represent an alkyl group having 1 to 10 carbon atoms, an alkyl fluoride group, or an alkoxy group having 1 to 10 carbon atoms.

While the amount of the multidentate ligand incorporated can be arbitrarily selected, it is preferable that the amount is about 0.01 mole or more, preferably about 0.1 mole or more, more preferably about 1 mole or more, relative to 1 mole of the organometallic compound used.

While the production of the coating solution can also be conducted in the absence of a solvent, various solvents may be used in addition to alcohols such as methanol, ethanol, propanol and butanol; ketones such as acetone and methyl ethyl ketone; tetrahydrofuran; and ethers such as diethyl ether and dioxane in accordance with necessity. Such solvents preferably have a boiling point of about 100° C. or less and can be arbitrarily mixed before use. While the amount of the solvent can be arbitrarily selected, in consideration to the fact that the organosilicon compound can be easily precipitated when the amount is too low, it is preferable that the amount of the solvent is preferably about 0.5 to 30 parts by weight, preferably about 1 to 20 parts by weight, relative to 1 part by weight of the organosilicon compound.

While the reaction temperature and reaction time for curing the coating solution are not particularly limited, from the viewpoints of the mechanical strength and chemical stability of the resulting silicone resin, the reaction temperature is preferably about 60° C. or more, more preferably in a range of about 80 to 200° C., and the reaction time is preferably about 10 minutes to 5 hours. To allow a protective layer obtained by curing the coating solution to be kept in a highly humid state is effective in improving the properties of the protective layer. Depending on applications, the protective layer can be hydrophobilized by surface treatment with hexamethyl disilazane or trimethyl chlorosilane.

On the other hand, it is more preferable that the phenol resin is that containing at least one kind charge transporting material (structural unit having a charge transporting ability) selected from a hydroxyl group, a carboxyl group, an alkoxysilyl group, an epoxy group, a thiol group and an amino group.

Examples of the phenol compound used in synthesizing the phenol resin include compounds having a phenol structure, such as resorcine, bisphenol, substituted phenols having one hydroxy group such as phenol, cresol, xylenol, paraalkylphenol, or paraphenylphenol, substituted phenols having two hydroxy groups such as catechol, resorcinol, or hydroquinone, bisphenols such as bisphenol A or bisphenol Z, and biphenols. Compounds which are generally commercially available as a raw material for synthesizing a phenol resin can be utilized in the invention.

Compounds having a methylol group can also be utilized as the phenol compound, and examples thereof include monomers of monomethylolphenols, dimethylolphenols or trimethylolphenols, mixtures thereof, oligomers thereof, and mixtures of those monomers and oligomers.

In the specification, a relatively large molecule having around 2 to 20 of repeating molecular structural units is referred to as oligomer, and a smaller molecule is referred to as monomer.

Examples of the aldehydes used in synthesizing the phenol resin include formaldehyde and paraformaldehyde. Upon synthesis of the phenol resin, the resin can be obtained by reacting these raw materials under an acid catalyst or an alkali catalyst. Alternatively, aldehydes which are generally commercially available as a phenol resin can also be used in the invention.

Examples of the acid catalyst include sulfuric acid, paratoluenesulfonic acid, and phosphoric acid. Examples of the alkali catalyst include hydroxides of alkali metals and alkaline earth metals such as NaOH, KOH, $Ca(OH)_2$, and $Ba(OH)_2$, and amine catalysts.

Examples of the amine catalyst include ammonia, hexamethylenetetramine, trimethylamine, triethylamine, and triethanolamine, while the amine catalyst is not limited thereto.

When the basic catalyst is used in the invention, carriers can be remarkably trapped by the remaining catalyst, and electrophotographic property can be deteriorated in some cases. For this reason, when the basic catalyst is utilized, it is preferable that the catalyst is inactivated or removed by neutralizing with an acid, or by contacting with an adsorbing agent such as silica gel, or an ion exchange resin, after completion of the reaction utilizing the catalyst.

The phenol resin having a crosslinked structure used in the invention may be a resin obtained by further crosslinking conventionally-known phenol resin, or may be a resin in which a phenol resin itself has a crosslinked structure, such as a novolak resin. In the former case, it is more preferable to use a resol phenol resin.

Particularly, since the toner containing a crystalline resin like the toner of the invention has hygroscopicity, it is more preferably used in view of stably obtaining high image quality over a longer period of time than that obtained by use of a combination with a photosensitive body having a surface layer of the siloxane resin, which is slightly inferior in terms of surface layer properties of water absorbability and gas barrier property.

The protective layer having the charge transportability and further having a crosslinked structure has excellent mechanical strength and satisfactory photoelectric properties, and can thus be directly used as a charge transporting layer in a photoreceptor having a laminate configuration. In this case, usual methods such as blade coating, Meyer bar coating, spray coating, dipping coating, bead coating, air knife coating, curtain coating or the like can be used. When necessary film thickness cannot be obtained by applying the coating solution once, the coating solution can be repeatedly applied to obtain a desired film thickness. When the coating solution is repeatedly applied, heating treatment may be carried out after each application or after repeated application.

A photosensitive layer having a single layer configuration is formed by incorporating the charge generation material and the binder resin. The binder resin can be similar to that used in the charge generating layer and the charge transporting layer. The content of the charge generation material in the photosensitive layer of single layer configuration is in a range of about 10 to 85% by mass, preferably in a range of about 20 to 50% by mass. For the purpose of improving photoelectric properties etc., the charge transport material and polymeric charge transport material may be added to the photosensitive layer having a single layer configuration. The amount thereof is preferably in a range of about 5 to 50% by mass. The compound represented by Formula (I) may also be added. As the solvent used in coating and the coating method, those described above can be used. The thickness of the coating is preferably in a range of about 5 to 50 μm, and more preferably in a range of about 10 to 40 μm.

EXAMPLES

Hereinafter, while particularly preferable modes of the invention are listed, the invention is not necessarily limited to these modes. "Parts" used in the following Examples means "parts by mass", and "%" used in the following Examples means "% by mass", unless otherwisely stated.

Measuring Methods for Carious Properties

Firstly, explanations are given for methods for measuring physical properties of the toners and the like used in the Examples and Comparative examples.

Molecular-weight of Resin

Measurement of molecular-weight distribution is conducted in the invention in the following manner. Experiments are conducted by using "HLC-8120GPC, SC-8020" (trade name, manufactured by Tosoh Corporation) as GPC, two columns of "TSKgel, Super HM-H (trade name, manufactured by Tosoh Corporation: 6.0 μm ID×15 cm)", and THF (tetrahydrofuran) as an eluent. The experiment conditions are as follows: the sample concentration is 0.5%, the flow rate is 0.6 ml/min., the volume of a sample injected is 10 μl, the measurement temperature is 40° C., and an IR detector is used in the experiments. A calibration curve is prepared from 10 samples of "POLYSTYRENE STANDARD SAMPLE TSK STANDARD", that is, A-500, F-1, F-10, F-80, F-380, A-2500, F-4, F-40, F-128 and F-700 (all trade names, manufactured by Tosoh Corporation).

Volume Average Particle Diameters of Resin Particle, Colorant Particle and the Like Volume average particle diameters of each of a resin fine particle, a colorant particle and the like are measured with a laser diffraction particle size measuring machine (trade name: SALD2000A, manufactured by Shimadzu Corporation).

Melting Point and Glass Transition Temperature of Resin

Melting points of the toner of the invention and the crystalline polyester resin, and glass transition temperatures of the toner and the amorphous resin are obtained from each maximum peak measured according to ASTMD3418-8. As a glass transition point, a temperature corresponding to an intersection point between a baseline and an extension line of a starting line in an endothermic part is adopted, and as a melting point, a temperature corresponding to an apex of an endothermic peak is adopted.

For measurement, a differential scanning calorimeter (trade name: DSC-7, manufactured by PerkinElmer, Inc.) is used.

Preparation of Developer for Electrostatic Image Development

Preparation of Non-crystalline Polyester Resin (1) and Non-crystalline Resin Particle Dispersion (1a)

A two-necked flask which is dried by heating is charged with 35 mol parts of polyoxyethylene (2,0)-2,2-bis(4-hydroxyphenyl)propane, 65 mol parts of polyoxypropylene (2,2)-2,2-bis(4-hydroxyphenyl)propane, 80 mol parts of terephthalic acid, 15 mol parts of n-dodecenyl succinic acid, 10 mol parts of trimellitic acid, and dibutyl tin oxide in an amount of 0.05 mol parts relative to these acid components (amount of moles in total of the terephthalic acid, n-dodecenyl succinic acid and trimellitic acid), and after a nitrogen gas is introduced into the container so as to maintain the inert atmosphere therein, a temperature therein is raised and the mixture is subjected to condensation polymerization at 150 to 230° C. for about 12 hours and then gradually depressurized at 210 to 250° C. to synthesize a non-crystalline polyester resin (1).

By measurement of molecular weight (in terms of polystyrene) by GPC (gel permeation chromatography), the weight-average molecular weight (Mw) of the resulting non-crystalline polyester resin (1) is turned out to be 15,000, and the number-average molecular weight (Mn) is turned out to be 6,800.

When the non-crystalline polyester resin (1) is measured with a differential scanning calorimeter (DSC), no definite peak is shown, and a stepwise endothermic change is observed. A glass transition point in the center of the stepwise endothermic change is 62° C.

An emulsifying tank in a high-temperature/high pressure emulsifier (CAVITRON® CD1010, manufactured by Dentsply International, slit: 0.4 mm) is charged with 3,000 parts of the resulting non-crystalline polyester resin (1), 10,000 parts of ion-exchanged water and 90 parts of surfactant, sodium dodecyl benzene sulfonate, and the mixture is melted by heating at 130° C., dispersed at 110° C. in a flow rate of 3 L/m at 10,000 rpm for 30 minutes and passed through a cooling tank to recover a non-crystalline resin particle dispersion (high temperature/high pressure emulsifier (CAVITRON® CD1010, described above, slit: 0.4 mm)), so as to obtain a non-crystalline resin particle dispersion (1a).

A volume volume-average particle diameter $D_{50v}$ of the particles contained in the resulting non-crystalline resin particle dispersion (1a) is 0.3 μm, and the standard deviation thereof is 1.2.

Preparation of Non-crystalline Polyester Resin (2) and Non-crystalline Resin Particle Dispersion (2a)

A non-crystalline polyester resin (2) is prepared under the same conditions as for the non-crystalline polyester resin (1) except that the amount of n-dodecenyl succinic acid is changed into 30 mol parts, and a non-crystalline resin particle dispersion (2a) is prepared under the same conditions as for the non-crystalline resin particle dispersion (1a).

The weight-average molecular weight (Mw) of the resulting non-crystalline polyester resin (2) is 12,000, the number-average molecular weight (Mn) thereof is 6,000, and the glass transition point thereof is 56° C. The volume-average particle diameter $D_{50v}$ contained in the resulting resin particle dispersion is 0.35 μm, and the standard deviation is 1.4.

Preparation of Crystalline Polyester Compound (3) and Crystalline Resin Particle Dispersion (3a)

A three-necked flask dried by heating is charged with 293 parts by weight of 1,4-butane diol (manufactured by Wako Pure Chemical Industries, Ltd.), 750 parts by weight of dodecane dicarboxylic acid (manufactured by Wako Pure Chemical Industries, Ltd.) and 0.3 part by weight of dibutyltin oxide as a catalyst, and after the air in the container is replaced by a nitrogen gas through depressurization so as to provide an inert atmosphere, the mixture is stirred under mechanical stirring at 180° C. for 2 hours. Thereafter, the mixture is gradually heated to 230° C. and stirred for 5 hours, and when the mixture has become viscous, it is air-cooled to terminate the reaction, whereby a crystalline polyester compound (3) is synthesized.

By measurement (expressed by polystyrene) of the molecular weight by gel permeation chromatography (GPC), the weight-average molecular weight of the resulting crystalline polyester compound (3) is 18,000.

When the melting point (Tm) of the crystalline polyester compound (3) is measured with a differential scanning calorimeter (DSC) by the measurement method described above, a clear peak appears and the temperature of a peak top thereof is 70° C.

A crystalline ester compound particle dispersion (3a) is prepared under the same conditions as those for the resin particle dispersion (1a) except that the crystalline polyester compound (3) is used. The volume average particle diameter $D_{50v}$ of the particles contained in the resulting dispersion is 0.25 μm and the standard deviation thereof is 1.3.

Preparation of Colorant Particle Dispersion (1)

Phthalocyanine pigment (trade name: PVFASTBLUE, manufactured by Dainipponseika Color & Chemicals Mfg. Co., Ltd.): 25 parts Anionic surfactant (trade name: NEOGEN RK, manufactured by DAI-ICHI KOGYO SEIYAKU CO., LTD.): 2 parts Ion-exchanged water: 125 parts The above ingredients are mixed, dissolved and dispersed by a homogenizer (trade name: ULTRA-TURRAX®, manufactured by IKA Co., Ltd.) to provide a colorant particle dispersion (1).

Preparation of Releasing Agent Particle Dispersion (1)

Pentaerythritol behenic acid tetraester wax: 100 parts

Anionic surfactant (trade name: NEWLEX R, manufactured by NOF CORPORATION): 2 parts Ion-exchanged water: 300 parts The above ingredients are mixed, dissolved and dispersed by a homogenizer (ULTRA-TURRAX®, manufactured by IKA Co., Ltd.) and then dispersed by a pressure discharging homogenizer to provide a releasing agent particle dispersion (1).

Preparation of Inorganic Particle Dispersion (1)

Hydrophobic silica (trade name: RX200, manufactured by Nippon Aerosil): 100 parts Anionic surfactant (trade name: NEWLEX R, manufactured by NOF CORPORATION): 2 parts Ion-exchanged water: 1,000 parts The above ingredients are mixed, dissolved and dispersed by a homogenizer (ULTRA-TURRAX®, manufactured by IKA Co., Ltd.) and then dispersed by an ultrasonic homogenizer (trade name: RUS-600CCVP, manufactured by Nippon Seiki Co., Ltd.) for 200 times passing so as to provide an inorganic particle dispersion (1).

Preparation of Inorganic Particle Dispersion (2)

Hydrophobic silica (trade name: RX974, manufactured by Nippon Aerosil): 100 parts Anionic surfactant (trade name: NEWLEX R, manufactured by NOF CORPORATION): 2 parts Ion-exchanged water: 1,000 parts The above ingredients are mixed, dissolved and dispersed by a homogenizer (ULTRA-TURRAX®, manufactured by IKA Co., Ltd.) and then dispersed by an ultrasonic homogenizer (trade name: RUS-600CCVP, manufactured by Nippon Seiki Co., Ltd.) for 200 times passing so as to provide an inorganic particle dispersion (2).

Preparation of Inorganic Particle Dispersion (3)

Hydrophilic silica (trade name: A200, manufactured by Nippon Aerosil): 100 parts Anionic surfactant (trade name: NEWLEX R, manufactured by NOF CORPORATION): 2 parts Ion-exchanged water: 1,000 parts The above ingredients are mixed, dissolved and dispersed by a homogenizer (ULTRA-TURRAX®, manufactured by IKA Co., Ltd.) and then dispersed by an ultrasonic homogenizer (trade name: RUS-600CVP, manufactured by Nippon Seiki Co., Ltd.) for 200 times passing so as to provide an inorganic particle dispersion (3).

Production of Developer (1)

Preparation of Toner Matrix Particle (1)

Non-crystalline resin particle dispersion (1a): 145 parts

Crystalline polyester compound particle dispersion (3a): 30 parts

Colorant particle dispersion (1): 42 parts

Releasing agent particle dispersion (1): 36 parts

Inorganic particle dispersion (1): 10 parts

Aluminum sulfate (manufactured by Wako Pure Chemical Industries, Ltd.): 0.5 parts Ion-exchanged water: 300 parts The above ingredients are placed in a round stainless steel flask, adjusted to pH 2.7, dispersed with a homogenizer (ULTRA-TURRAX® T50, manufactured by IKA Co., Ltd.) and heated to 45° C. under stirring in a heating oil bath. When the mixture is kept at 48° C. for 120 minutes and then observed using an optical microscope so as to confirm the formation of aggregated particles having an average particle diameter of about 5.6 μm.

After this dispersion is further heated under stirring for 30 minutes at 48° C., it is confirmed by observation using an optical microscope that aggregated particles having an average particle diameter of about 6.5 μm are formed. The pH of the aggregated particle dispersion is 3.2. Subsequently, 1 N aqueous sodium hydroxide is gently added thereto to adjust a pH of the dispersion to 8.0, and then the dispersion is heated at 90° C. under stirring for 3 hours. Thereafter, the reaction product is filtered off, washed sufficiently with ion-exchanged water and dried with a vacuum dryer to give a toner matrix particle (1).

The volume average particle diameter $D_{50v}$ of the resulting toner matrix particles is 6.5 μm. 1 part of colloidal silica (trade name: R972, manufactured by NIPPON AEROSIL CO., LTD.) is externally added to 100 parts of the toner particles by mixing therewith in a Henschel mixer to give an electrostatic image development toner (1).

Separately, 100 parts of ferrite particles (manufactured by Powder-Tech Associate, Inc., average particle diameter: 50 μm) and 2.5 parts of methylmethacrylate resin (manufactured by MITSUBISHI RAYON CO., LTD., weight-average molecular weight: 95,000) together with 500 parts of toluene are introduced into a pressurizing kneader, mixed under stirring at room temperature for 15 minutes, then mixed under reduced pressure and simultaneously heated to 700C, to distill toluene off, then cooled, classified through a screen having an opening of 105 μm, whereby a ferrite carrier (resin-coated carrier) is prepared. This ferrite carrier is mixed with the toner for the electrostatic image development (1) to prepare a two-component developer (1) having a toner concentration of 7% by mass.

Production of Developer (2)

A toner matrix particle (2) is obtained under the same conditions as for the toner matrix particle (1) except that the inorganic particle dispersion (2) is used in place of the inorganic particle dispersion (1), the non-crystalline resin particle dispersion (2a) is used in place of the non-crystalline resin particle dispersion (1a), and the compound amount of the crystalline resin particle dispersion (3a) is changed to 20 parts.

The volume average particle diameter $D_{50v}$ of the resulting toner matrix particles is 6.3 μm. Subsequently, a developer (2) is prepared by mixing with the external additive and mixing the toner matrix particle with the carrier in the same manner as for the developer (1).

Production of Developer (3)

A toner matrix particle (3) is obtained under the same conditions as for the toner matrix particle (1) except that the inorganic particle dispersion (3) is used in place of the inorganic particle dispersion (1), and the compound amount of the crystalline resin particle dispersion (3a) is changed to 10 parts.

The volume average particle diameter $D_{50v}$ of the resulting toner matrix particles is 5.8 μm. Subsequently, a developer (3) is prepared by mixing the toner matrix particle with the external additive and mixing with the carrier in the same manner as for the developer (1).

Production of Developer (4)

A toner matrix particle (4) is obtained under the same conditions as for the toner matrix particle (1) except that the inorganic particle dispersion (2) is used in place of the inorganic particle dispersion (1), and the pH of the dispersion to be adjusted by the addition of 1 N aqueous sodium hydroxide before heating to 90° C. is changed to 8.5.

The volume average particle diameter $D_{50v}$ of the resulting toner matrix particles is 5.6 μm. Subsequently, a developer (4) is prepared by mixing the toner matrix particle with the external additive and mixing with the carrier in the same manner as for the developer (1).

Production of Developer (5)

A toner matrix particle (5) is obtained under the same conditions as for the toner matrix particle (1) except that the inorganic particle dispersion (2) is used in place of the inorganic particle dispersion (1), and the pH of the dispersion to be adjusted by the addition of 1 N aqueous sodium hydroxide before heating to 90° C. is changed to 7.0.

The volume average particle diameter $D_{50}$, of the resulting toner matrix particles is 5.5 μm. Subsequently, a developer (5) is prepared by mixing the toner matrix particle with the external additive and mixing with the carrier in the same manner as for the developer (1).

Production of Developer (6)

Preparation of Toner Matrix Particle (6)

Non-crystalline resin particle dispersion (1a): 145 parts

Colorant particle dispersion (1): 42 parts

Releasing agent particle dispersion (1): 36 parts

Aluminum sulfate (Wako Pure Chemical Industries, Ltd.): 0.5 parts

Ion-exchanged water: 300 parts

A developer (6) is prepared under the same conditions as for the developer (1) except that the starting dispersion used in the aggregating is changed to the composition shown above. The volume average particle diameter $D_{50v}$ of the resulting toner matrix particles is 5.5 μm.

Production of Developer (7)

A toner matrix particle (7) is obtained under the same conditions as for the toner matrix particle (1) except that the pH of the dispersion to be adjusted by the addition of 1 N aqueous sodium hydroxide before heating to 90° C. is changed to 9.5.

The volume average particle diameter $D_{50v}$ of the resulting toner matrix particles is 5.5 μm. Subsequently, a developer (7) is prepared by mixing the toner matrix particle with the external additive and mixing with the carrier in the same manner as for the developer (1).

Production of Developer (8)

Polyester resin (linear polyester having a glass transition temperature, Tg: 59° C., a weight-average molecular weight (Mw): 3500, and a number-average molecular weight (Mn): 20000, obtained from a terephthalic acid-bisphenol A ethylene oxide adduct-cyclohexane dimethanol): 100 parts Phthalocyanine pigment (trade name: PVFASTBLUE, manufactured by Dainichiseika Color & Chemicals Mfg. Co., Ltd.): 25 parts Carnauba wax (manufactured by TOAKASEI CO., LTD., melting point: 80° C.): 5 parts A mixture having the above composition is kneaded in an extruder, milled with a jet mill and classified with an air classifier to give a toner matrix particle (8) having a volume-average particle diameter $D_{50v}$ of 10.3 μm. Subsequently, a developer (8) is obtained by mixing the toner matrix particle with the external additive and mixing with the carrier in the same manner as for the developer (1).

Production of Developer (9)

A toner matrix particle (9) is obtained under the same conditions as for the toner matrix particle (1) except that the pH of the dispersion to be adjusted by the addition of 1 N aqueous sodium hydroxide after completion of the aggregation is changed to 5.5, and the sodium hydroxide is not used in the melt-coalescing. Subsequently, a developer (9) is prepared in the same manner as for the developer (1) except that the toner matrix particle (9) is used in place of the toner matrix particle (1).

Production of Developer (10)

A toner matrix particle (10) is obtained under the same conditions as for the toner matrix particle (1) except that the temperature for the melt-coalescing is changed to 80° C. Subsequently, a developer (10) is prepared in the same manner as for the developer (1) except that the toner matrix particle (10) is used in place of the toner matrix particle (1).

Production of Developer (11)

A toner matrix particle (11) is obtained under the same conditions as for the toner matrix particle (1) except that the temperature for the melt-coalescing is changed to 98° C. Subsequently, a developer (11) is prepared in the same manner as for the developer (1) except that the toner matrix particle (11) is used in place of the toner matrix particle (1).

Production of Developer (12)

A toner matrix particle (12) is obtained under the same conditions as for the toner matrix particle (1) except that the amount of the ion-exchanged water is changed to 500 parts, and the amount of the aluminum sulfate is changed to 0.3 parts. Subsequently, a developer (12) is prepared in the same manner as for the developer (1) except that the toner matrix particle (12) is used in place of the toner matrix particle (1).

Production of Developer (13)

A toner matrix particle (13) is obtained under the same conditions as for the toner matrix particle (1) except that the amount of the ion-exchanged water is changed to 200 parts, and the amount of the aluminum sulfate is changed to 0.8 parts. Subsequently, a developer (13) is prepared in the same manner as for the developer (1) except that the toner matrix particle (13) is used in place of the toner matrix particle (1).

The properties of the toners used in each of the developers (1) to (13) are shown in the following Table 9.

TABLE 9

| | D50v (μm) | GSDv | GSDp | G'(65)/G'(90) | Average circularity | IA Group existence ratio (atom %) | IIA, IIIB and IVB Groups existence ratios (atom %) |
|---|---|---|---|---|---|---|---|
| Developer (1) | 6.5 | 1.21 | 1.25 | $8 \times 10^4$ | 0.963 | 0.2 | 1.9 |
| Developer (2) | 6.3 | 1.24 | 1.24 | $3 \times 10^4$ | 0.970 | 0.4 | 1.0 |
| Developer (3) | 5.8 | 1.22 | 1.25 | $2 \times 10^3$ | 0.956 | 0.3 | 0.08 |
| Developer (4) | 5.6 | 1.23 | 1.23 | $1 \times 10^4$ | 0.950 | 0.9 | 1.0 |
| Developer (5) | 5.5 | 1.25 | 1.24 | $8 \times 10^3$ | 0.968 | 0.05 | 1.0 |
| Developer (6) | 5.5 | 1.26 | 1.25 | $2 \times 10^2$ | 0.970 | 0.3 | 2.1 |
| Developer (7) | 5.5 | 1.24 | 1.26 | $1 \times 10^4$ | 0.968 | 1.2 | 0.04 |
| Developer (8) | 10.3 | 1.30 | 1.32 | $7 \times 10^2$ | 0.938 | 0.01 | 0 |
| Developer (9) | 6.9 | 1.24 | 1.25 | $8 \times 10^4$ | 0.962 | 0.02 | 1.8 |
| Developer (10) | 6.2 | 1.24 | 1.24 | $4 \times 10^4$ | 0.937 | 0.30 | 1.5 |
| Developer (11) | 6.4 | 1.23 | 1.23 | $4 \times 10^4$ | 0.982 | 0.40 | 1.4 |
| Developer (12) | 6.3 | 1.25 | 1.31 | $1 \times 10^4$ | 0.959 | 0.35 | 1.6 |
| Developer (13) | 5.8 | 1.23 | 1.29 | $3 \times 10^4$ | 0.962 | 0.35 | 1.4 |

Preparation of a Photoreceptor

Preparation of Photoreceptor 1

A cylindrical Al substrate is polished with a center-less polishing apparatus such that the surface roughness Rz comes to be 0.6 μm. In a cleaning process, this cylinder is degreased, then etched for 1 minute in 2% by mass aqueous sodium hydroxide, neutralized and washed with purified water. In anodizing treatment, an anodized film (current density: 1.0 $A/dm^2$) is formed on the surface of the cylinder by 10% by mass sulfuric acid solution. After washing with water, the anodized film is subjected to pore sealing by dipping in 1% by mass nickel acetate solution at 80° C. for 20 minutes. Then, the substrate is washed with purified water and dried. In this manner, 7 μm anodized film is formed on the surface of the aluminum cylinder.

1 part of titanyl phthalocyanine having a strong diffraction peak at a Bragg angle (2θ±0.2°) of 27.2° in an X-ray diffraction spectrum is mixed with 1 part of polyvinyl butyral (trade name: S-LEC BM-S, manufactured by SEKISUI CHEMICAL CO., LTD.) and 100 parts of n-butyl acetate and dispersed together with glass beads in a paint shaker for 1 hour, and the resulting coating solution is applied by dipping coating on the aluminum substrate described above and dried by heating at 100° C. for 10 minutes to form a charge generating layer having about 0.15 μm in thickness.

Then, a coating solution prepared by dissolving 2 parts of a benzidine compound having the following structure (compound 1 below) and 2.5 parts of a polymer compound (compound 2 below, a viscosity average molecular weight: 39,000, n: a number of the repeating unit in the parensis) in 20 parts of chlorobenzene is applied by dipping coating on the charge generating layer and heated at 110° C. for 40 minutes to form a charge transporting layer of 20 μm in thickness, whereby a photoreceptor 1 is obtained.

Compound 1

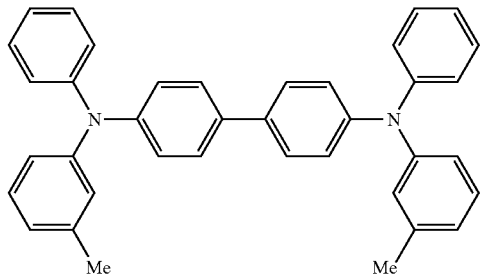

Compound 2

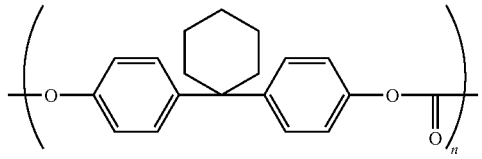

Preparation of Photoreceptor 2

5 parts of methyl alcohol and 0.5 part of ion-exchange resin (trade name: AMBERLYST 15E, manufactured by Rohm and Haas Company) are added to the constituent materials shown below and stirred at room temperature, whereby an exchange reaction of protective groups is carried out for 24 hours.

Constituent Materials:

Compound 3 (shown below): 2 parts

Methyl trimethoxy silane: 2 parts

Tetraethoxy silane: 0.5 parts

Colloidal silica: 0.4 parts $Me(MeO)_2Si—(CH_2)_4—SiMe(OMe)_2$: 0.5 parts (Heptadecafluoro-1,1,2,2-tetrahydrodecyl)methyl dimethoxy silane: 0.1 parts Hexamethyl cyclotrisiloxane: 0.3 parts Compound 3

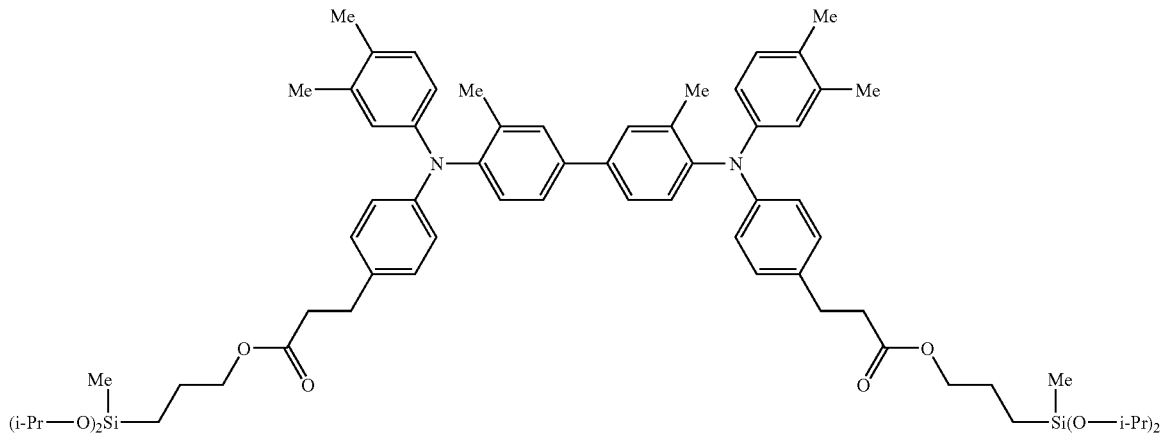

Thereafter, 10 parts of n-butanol and 0.3 part of distilled water are added thereto to carry out hydrolysis for 15 minutes.

After hydrolysis, the ion-exchange resin is separated by filtration to give a filtrate. Further, 0.1 parts of aluminum trisacetyl acetonate ($Al(aqaq)_3$), 0.1 parts of acetyl acetone, 0.4 parts of 3,5-di-t-butyl-4-hydroxy toluene (BHT) and 0.5 parts of S-LEC BX-L (trade name, manufactured by SEKISUI CHEMICAL CO., LTD.) are added to the filtrate, and the resulting coating solution is applied by a ring-type dipping coating method onto the charge transporting layer, air-dried at room temperature for 30 minutes, and cured by heating treatment at 170° C. for 1 hour to give a protective layer of about 3 μm in thickness, whereby a photoreceptor 2 is obtained.

Preparation of Photoreceptor 3

5 parts of the following compound 4,7 parts of resol phenol resin (trade name: PL-4852, manufactured by Gunei Chemical Industry Co., Ltd.), 0.03 parts of methylphenyl polysiloxane and 20 parts of isopropanol are mixed and dissolved so as to obtain a coating liquid for forming a protective layer. The coating liquid for forming a protective layer is applied on the electron transporting layer of the photoreceptor 1 by dipping coating, and dried at 130° C. for 40 minutes so as to obtain a protective layer of about 3 μm in thickness, whereby a photoreceptor 3 is obtained.

Compound 4

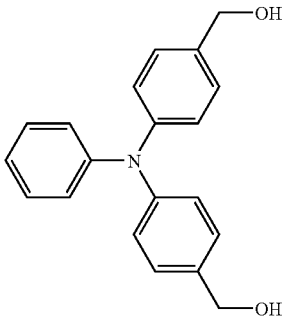

Examples 1 to 7 and Comparative Examples 1 to 4

With respect to each of the combinations of the photoreceptor and the developer shown in Table 10, a test of forming images on 5,000 sheets in a high-temperature and high-humidity (28° C., 85% RH) environment and then a test of forming images on 5,000 sheets in a low-temperature and low-humidity (10C, 15% RH) environment are conducted by using a modified apparatus (equipped with a cleaning blade as a means of cleaning the photoreceptor and having a recycle system returning a toner in a recovery box to the inside of a developing device) of a printer (trade name: DOCUCENTRE COLOR 400CP, manufactured by Fuji Xerox Co., Ltd.) so as to evaluate fixability at low-temperature, toner strength, transferability, image durability, and photoreceptor surface defect. The results are shown in Table 10.

In cases where the photoreceptor 2 or 3 is used, a recycle system is actuated to further carry out a test of forming images on 100,000 sheets in a high-temperature and high-humidity (28.5° C., 85% RH) environment, and the presence or absence of filming on the photoreceptor after the test is visually checked through a 50-power magnifying glass in order to confirm the recycle system.

Evaluation methods and evaluation criteria in the evaluation items shown in Table 10 are as follows:

Fixability at Low-temperature

In evaluation of fixability at low-temperature, regulation of the temperature in a fixation apparatus is carried out by controlling an external power source before the image forming tests, and fixations are conducted at fixation temperatures set at 5-degree intervals in the range of 100 to 140° C., and an image is formed such that the reflective density of the resulting image becomes constant (density of 1.5 to 1.8 on paper (trade name: C2, manufactured by Fuji Xerox Co., Ltd.) determined with a densitometer (trade name:X-RITE 404, manufactured by X-Rite)), and defects on the image upon bending of the image are determined by sensory evaluation.

A: Excellent (no image defect is observed even at fixed at fixation temperature of 110° C. or less)

B: Allowable (Image defects are observed at low fixation temperature (110° C. to 135° C.) while they are recognized as durable)

X: Practically not durable with many image defects at low fixation temperature (110° C. to 135° C.) while they exhibit no image defect at fixation temperature of 135° C. or more Toner Strength In evaluation of toner strength, the developer is collected after the image forming test under high-temperature and high-humidity environment and the image forming test under low-temperature and low-humidity environment are conducted, and the shape of the toner particles and the occurrence of breakage are observed under a scanning electron microscope (SEM) and sensorily evaluated by comparison with those of the unused toner particles. The evaluation criteria are as follows:

A: There is no change in shape or breakage (ratio of a number of damaged particles to that of all particles: 3% or less) as compared with the unused toner particles.

B: Toner cracking and deformation are observed (ratio of a number of damaged particles to that of all particles: 3 to 20%) as compared with the unused toner particles.

X: Toner cracking and deformation are recognized (ratio of a number of damaged particles to that of all particles: 20% or more) as compared with the unused toner particles.

Embedment of External Additive

In evaluation of embedment of the external additive, the developer is collected after the image forming test under high-temperature and high-humidity environment and the image forming test under low-temperature and low-humidity environment are conducted, and the condition of particles of the external additive added to the surfaces of the toner particles is sensorily evaluated under a scanning electron microscope (SEM) as compared with the unused toner particles. The evaluation criteria are as follows:

A: Embedment of particles of the external additive in the surfaces of the toner particles is hardly recognized as compared with the unused toner particles.

B: External additive embedded in the surfaces of the toner particles in a certain degree are observed as compared with the unused toner particles.

X: External additive significantly embedded in the surfaces of the toner particles are observed as compared with the unused toner particles.

Transferability

Transferability is evaluated according to the following criteria by collecting samples having unfixed solid images at a 500th sheet (early stage), and thereafter, per 1,000 sheets at a 1,000th sheet, a 2,000th sheet, etc., and measuring the transfer rate.

A: Excellent (transfer rate: 85 to 95%)

B: Lowered significantly after the 1,000th sheet (transfer rate: 70 to 80%)

C: Lowered at an early stage (transfer rate: 70% or less)

Image Durability

In evaluation of image durability, an image is collected before the image (fixed at 135° C.) is subjected to the test such that the reflective density of the image becomes constant (density of 1.5 to 1.8 measured by a densitometer (trade name:X-RITE 404, manufactured by X-Rite)), and the image is subjected to an image scratching test using a vertical loading of 200 g at a needle transfer rate of 1,500 mm/min. with a surface property tester (trade name: HEIDON Type 14 DR, manufactured by Shinto Scientific Co., Ltd.). Image defects are then determined by sensory evaluation. Evaluation criteria are as follows:

A: Excellent (No significant defect is observed)

B: Practically allowable while image defects are observed

X: Practically not durable with many image defects

Charging Characteristics

Given the equation of ΔTP=[(charge after printing 5,000 sheets)×(toner density after printing 5,000 sheets)]/[(initial charge)×(initial toner density)], charging characteristics is determined under the following criteria.

The "toner density" refers to the ratio by weight of the toner in the developer measured for charging characteristics. The toner charging is evaluated by collecting the developer on a sleeve of the developing device and measuring it by a blow-off method using a charge measuring device (trade name: TB-200, manufactured by Toshiba Chemical Corporation).

A: ΔTP of 0.65 to less than 1.2.

B: ΔTP of 0.5 to less than 0.65.

X: ΔTP of less than 0.5.

Evaluation of Filming Upon Actuation of Recycle System

An occurrence of filming on the photoreceptor after the tests is visually checked through a 50-power magnifying glass and evaluated under the following criteria.

AA: No filming is observed.

A: No influence to the image is observed although filming is observed with the magnifying glass.

B: Not practically problematic although there is an influence to the image.

X: Practically problematic.

TABLE 10

| | | | Evaluation results | | | | | | |
|---|---|---|---|---|---|---|---|---|---|
| | Developer No. | Photoreceptor No. | Fixability at Low-temperature | Toner strength | Embedment of external additive | Transferability | Image durability | Charging characteristics | Filming upon actuation of recycle system |
| Example 1 | Developer 1 | Photoreceptor 1 | A | A | A | A | A | A | — |
| Example 2 | Developer 2 | Photoreceptor 1 | A | A | A | A | A | A | — |
| Example 3 | Developer 3 | Photoreceptor 1 | A | A | A | A | A | A | — |
| Example 4 | Developer 4 | Photoreceptor 1 | A | A | A | A | A | A | — |
| Example 5 | Developer 5 | Photoreceptor 1 | A | A | A | A | A | A | — |
| Example 6 | Developer 2 | Photoreceptor 2 | A | A | A | A | A | A | A |
| Example 7 | Developer 2 | Photoreceptor 3 | A | A | A | A | A | A | AA |
| Example 8 | Developer 10 | Photoreceptor 1 | A | B | A | B | A | A | — |
| Example 9 | Developer 11 | Photoreceptor 1 | A | A | B | B | A | B | — |
| Example 10 | Developer 12 | Photoreceptor 1 | A | A | B | A | A | B | — |
| Example 11 | Developer 13 | Photoreceptor 1 | A | A | A | B | A | A | — |

TABLE 10-continued

| | Developer No. | Photoreceptor No. | Evaluation results | | | | | | |
|---|---|---|---|---|---|---|---|---|---|
| | | | Fixability at Low-temperature | Toner strength | Embedment of external additive | Transferability | Image durability | Charging characteristics | Filming upon actuation of recycle system |
| Comparative Example 1 | Developer 6 | Photoreceptor 1 | B | B | B | B | B | B | — |
| Comparative Example 2 | Developer 8 | Photoreceptor 1 | X | X | X | X | X | X | — |
| Comparative Example 3 | Developer 7 | Photoreceptor 1 | A | X | X | X | X | X | — |
| Comparative Example 4 | Developer 7 | Photoreceptor 2 | A | X | X | X | X | X | B |
| Comparative Example 5 | Developer 9 | Photoreceptor 1 | A | A | A | X | A | X | — |

From the results in Table 10, it is confirmed that Examples in which existence ratios of an IA Groups element, an IIA Group element, an IIIB Group element and an IVB Group element according to XPS (X-ray photoelectron spectroscopy) are in a predetermined range, are excellent in not only low temperature fixing property but also toner strength and image durability.

CROSS-REFERENCE TO RELATED APPLICATION

This application claims priority under 35 USC 119 from Japanese Patent Application No. 2006-188061.

What is claimed is:

1. A toner for electrostatic image development comprising a binder resin and a colorant, wherein an existence ratio of an IA Group element, from which hydrogen is excluded, measured by XPS (X-ray Photoelectron Spectroscopy) is in a range of about 0.03 to 1.0 atom %, and a total of existence ratios of an IIA Group element, an IIIB Group element and an IVB Group element, from which carbon is excluded, measured by XPS is in a range of about 0.05 to 2.0 atom %, and wherein a ratio (G'(65)/G'(90)) of a storage modulus G'(65) at 65° and a storage modulus G'(90) at 90° C. at a measurement frequency of 1 (rad/sec) in dynamic viscoelasticity measurement by a sine wave vibration method is in a range of about $1\times10^3$ to $1\times10^5$.

2. The toner for electrostatic image development according to claim 1, wherein the binder resin is synthesized by a polyaddition reaction or a polycondensation reaction.

3. The toner for electrostatic image development of claim 1, wherein the binder resin comprises a crystalline resin, and the weight average molecular weight of the crystalline resin exceeds about 5,000.

4. The toner for electrostatic image development of claim 1, wherein the binder resin comprises a crystalline resin, and an amount of the crystalline resin is in a range of about 1 to 10% by mass relative to a total amount of the toner particle.

5. The toner for electrostatic image development of claim 1, wherein the binder resin comprises a crystalline resin, and the melting point of the crystalline resin is in the range of about 45 to 110° C.

6. The toner for electrostatic image development of claim 1, wherein the toner further comprises a releasing agent, and an amount of the releasing agent is in the range of about 0.5 to 50% by mass relative to an amount of the toner.

7. The toner for electrostatic image development of claim 1, wherein the toner further comprises a releasing agent, and a ratio of the surface area coverage of the releasing agent exposed on the toner surface with respect to the total surface area of the toner particles is in a range of about 5 to 12 atom %.

8. The toner for electrostatic image development of claim 1, wherein a volume-average particle size distribution index (GSDv) of the toner is about 1.28 or less.

9. The toner for electrostatic image development of claim 1, wherein a number-average particle size distribution index (GSDp) of the toner is about 1.30 or less.

10. The toner for electrostatic image development of claim 1, wherein a volume-average particle size (D50v) of the toner is in a range of about 3 to 7 mm.

11. The toner for electrostatic image development of claim 1, wherein an average circularity of the toner is about 0.940 to 0.980.

12. A method for forming the toner for electrostatic image development of claim 1, comprising:

forming in water, an organic solvent or a mixed solvent thereof, colored particles which comprise the binder resin and the colorant; and washing and drying the colored particles.

13. The method for forming the toner for electrostatic image development of claim 12, comprising:

preparing a binder resin particle dispersion having the binder resin dispersed therein, a colorant particle dispersion having the colorant dispersed therein, and a releasing agent particle dispersion having a releasing agent dispersed therein;

aggregating the binder resin particles, the colorant particles and the releasing agent particles by stirring and mixing the resin particle dispersion, the colorant particle dispersion and the releasing agent particle dispersion so as to form aggregated particles; and melt-coalescing the aggregated particles by heating the aggregated particles at a temperature not lower than the glass transition temperature of the binder resin so as to coalesce each of the aggregated particles.

14. An electrostatic image developer comprising:

a carrier; and the toner for electrostatic image development of claim 1.

15. An image forming method comprising:

forming an electrostatic latent image on a surface of a latent image carrier;

developing the electrostatic latent image with a developer comprising the toner for electrostatic image development of claim 1 to form a toner image;

transferring the toner image onto a recording medium; and fixing the toner image on the recording medium.

16. The image forming method of claim 15, wherein a layer constituting the outermost surface of the latent image carrier comprises a siloxane resin having a crosslinked structure or a phenol resin having a crosslinked structure.

17. The image forming method of claim 15, further comprising:

cleaning the surface of the latent image carrier so as to recover residual toner remaining on the surface of the latent image carrier after the transferring; and recycling the recovered residual toner by re-utilizing the recovered residual toner as the developer.

* * * * *